US007775523B2

(12) United States Patent
Adams

(10) Patent No.: US 7,775,523 B2
(45) **Date of Patent: *Aug. 17, 2010**

(54) CARD GAME

(76) Inventor: Michael Edward Adams, 90 Windsor Dr., Pine Brook, NJ (US) 07058

( * ) Notice: Subject to any disclaimer, the term of this patent is extended or adjusted under 35 U.S.C. 154(b) by 543 days.

This patent is subject to a terminal disclaimer.

(21) Appl. No.: 11/517,561

(22) Filed: Sep. 7, 2006

(65) Prior Publication Data

US 2007/0057467 A1 Mar. 15, 2007

Related U.S. Application Data

(63) Continuation-in-part of application No. 11/133,623, filed on May 20, 2005, now Pat. No. 7,484,732.

(51) Int. Cl.
*A63F 1/10* (2006.01)

(52) U.S. Cl. ..... 273/157 R; 273/150; 40/124.01

(58) Field of Classification Search ..... 273/292, 273/293, 148 R, 309, 150, 151, 148 A, 153 R, 273/156, 157 R; 40/124.01, 124.02, 124.04, 40/371, 373, 377, 124
See application file for complete search history.

(56) References Cited

U.S. PATENT DOCUMENTS 3,620,535 A * 11/1971 Cerney et al. ..... 273/150
3,937,472 A 2/1976 Rice
4,666,163 A 5/1987 Hirschfeld
4,838,551 A 6/1989 Volpert
5,056,793 A 10/1991 Sigle
5,221,094 A 6/1993 Hanson

* cited by examiner

*Primary Examiner*—William M Pierce
(74) *Attorney, Agent, or Firm*—Law Offices of Rita C. Chipperson, P.C.

(57) ABSTRACT

A method and apparatus for assembling one or more coherent images from a plurality of segments of the coherent image reproduced on parts, pieces, blocks, cards, or the like is disclosed. In one embodiment of the present invention, the face of each segment includes a portion of the resulting single coherent image. When all segments are correctly arranged and stacked, or overlapped, with the correct orientation, the visible images on the faces of the segments mesh to form one or more larger coherent images. A variety of plates or stands are disclosed to aid the player in stacking the segments and arranging them with the proper orientation during the reassembly process. Additionally, information or images may be included on the portions of the faces of each segment that are obscured by other segments when the segments are properly assembled, thereby allowing such games to have multiple uses.

5 Claims, 35 Drawing Sheets

CARD GAME

CROSS-REFERENCE TO RELATED APPLICATIONS

This application claims the benefit of and is a continuation-in-part of the U.S. non-provisional patent application entitled "Card Game", having Ser. No. 11/133,623, filed May 20, 2005 now U.S. Pat. No. 7,484,732, which is incorporated by reference in its entirety as if fully set forth herein.

BACKGROUND OF THE INVENTION

Embodiments of the present invention generally relate to a method and apparatus for playing a game and displaying said game. More specifically, the present invention relates to a method and apparatus for playing a game that requires the player to assemble a set of cards to form an image, wherein said cards may optionally be assembled atop an apparatus that aids proper positioning and assembly of said cards, as well as display of the assembled cards.

Many systems and methods have been created to provide people with entertainment via puzzles and games that involve puzzles. Many such systems and methods involve reassembly of segments of an image to recreate an overall image. In its most simplistic form, some such systems and methods include reassembling square segments atop a support surface to create an image. One such system includes a support surface upon which the desired image (i.e., the image that is created when the puzzle is complete) is imprinted or otherwise placed to help the assembler properly piece together the puzzle. In some such systems, cards containing rectangular segments of the image are arranged on the support surface in rows and columns until the image depicted on the support surface is recreated. Alternatively, the cards may be arranged atop a surface other than the support surface. In this scenario, use of the support surface may be omitted or such surface may serve only as a memory aid. Additionally, the cards incorporated in such games may include a picture of the intended image on the back of the card to allow cards related to different puzzles to be distinguished from one another.

Similar games incorporating a support surface exist in which the cards may be affixed or held in place by the support surface. In some such games, the cards may be secured to the support surface by inserting them into slots included within the support surface. Some such games are assembled by first inserting the appropriate cards into the respective slots in the top row of each column. Thereafter, cards are inserted into the respective slots of the lower rows of each column such that they overlap the previously inserted cards. The resulting overall image is created from the visible portions of the inserted cards (i.e., the portions of the cards that are not overlapped by adjacent cards).

Some existing games require players to disassemble one or more puzzles. One such game includes an assembled puzzle image hidden behind an assembled concealing puzzle, wherein the concealing puzzle includes smaller puzzle pieces than the hidden puzzle. In one form, the hidden puzzle image is concealed by a puzzle that contains its own distinct image. In this game, the players take turns removing randomly selected pieces of the concealing puzzle to reveal portions of the concealed puzzle image. When one of the game players correctly guesses the concealed puzzle image, the game is ended and this player is deemed the winner. In more complex versions of such games, the winner must correctly answer a question contained in the concealed puzzle image in addition to identifying the puzzle image.

Another similar game that requires players to disassemble one or more concealing puzzles includes a specific method for removing the pieces of such a puzzle. In one such game, the pieces of the concealing puzzle are square or rectangular, opaque pieces that lie atop a transparent window that protects the surface of the concealed image. Additionally, each piece of the concealing puzzle is color-coded, wherein each color corresponds to a category of questions. To play this game, players take turns choosing pieces of the concealing puzzle. After a player selects a piece, the respective player is asked a question that corresponds to the question category associated with the color of the selected puzzle piece. If the player correctly answers the question, the puzzle piece is removed, revealing a portion of the concealed image. Each player continues to take a turn until one of the players correctly identifies the concealed image, thereby winning the game. In some such games, each piece of the concealing puzzle is assigned a monetary value based on its color to allow the players to earn points as the game progresses.

BRIEF SUMMARY OF THE INVENTION

Briefly stated, a game apparatus is provided. The game apparatus includes at least one support, the at least one support including at least one face, said at least one face including at least two recesses arranged radially about said face in at least one of the group consisting of a clockwise direction of said face and a counterclockwise direction of said face, each of said at least two recesses being progressively more shallow than a preceding one of said at least two recesses along at least one of the group consisting of said clockwise direction of said face and said counterclockwise direction of said face, said at least two recesses including one primary recess for providing at least one of the at least two segments with an orientation guide; at least one post protruding from said at least one face of said at least one support, said at least one post attached to said at least one support at a proximal end of said at least one post; and at least two segments, each of said at least two segments including at least two sides, each of said at least two segments including at least one segment aperture configured to mate with said at least one post, each of said at least two segments including at least one subsection of at least one resultant image; wherein overlapping each of the at least two segments in at least one predetermined orientation combines at least two of the subsections to form the at least one resultant image.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown. In the drawings:

FIGS. 24H and 241 display two configurations for displaying a plate mounted upon the stand of FIGS. 22A-22D in accordance with one embodiment of the present invention, wherein the stand is affixed to the adaptor of FIG. 25.

DETAILED DESCRIPTION OF THE INVENTION

Figure 1:
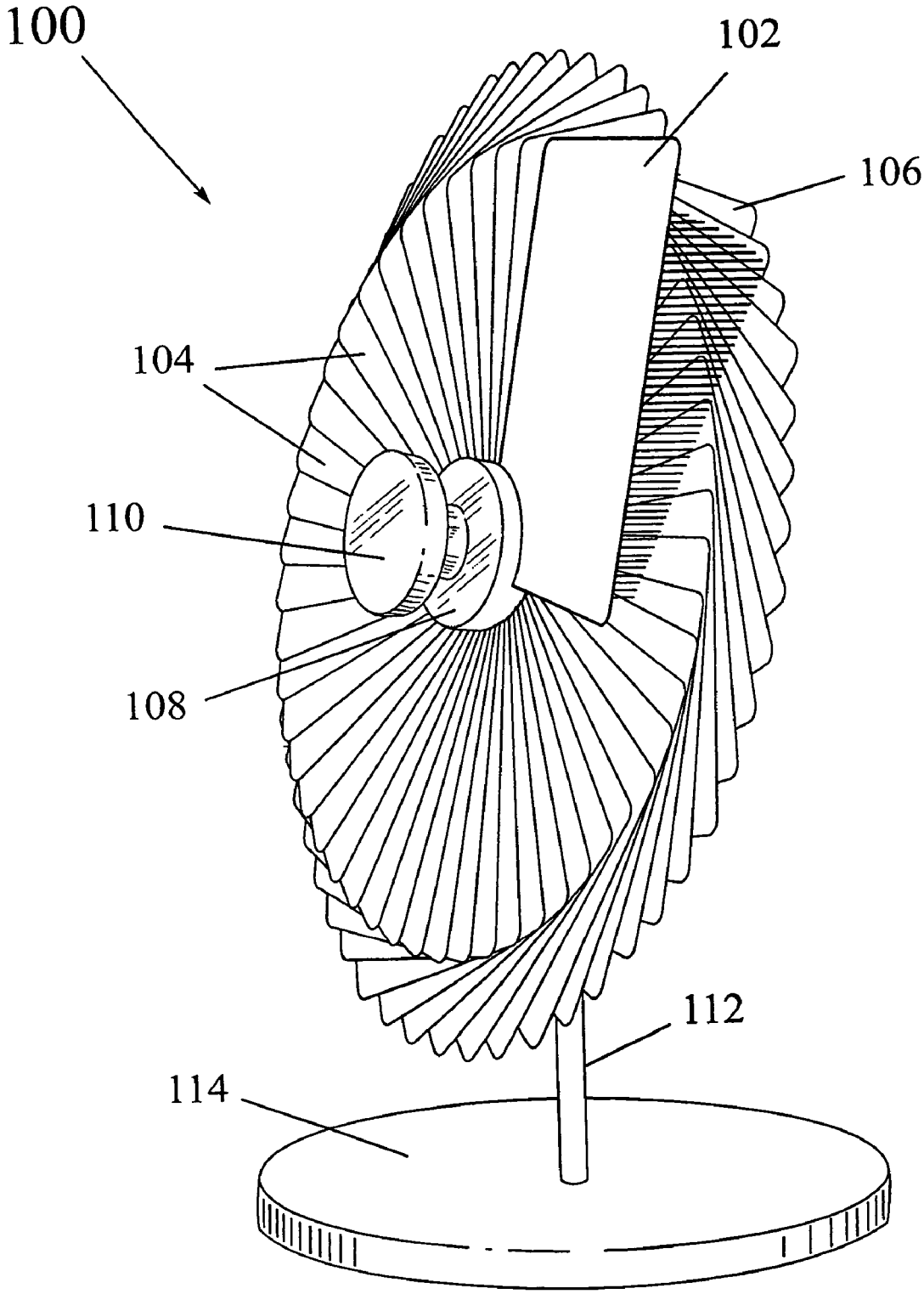
FIG. 1 depicts an angled, front view of an assembled card game in accordance with one embodiment of the present invention including, inter alia, cards, knob, stop, base, and shaft.

Certain terminology is used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a card" includes a plurality of cards. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Figure 2:
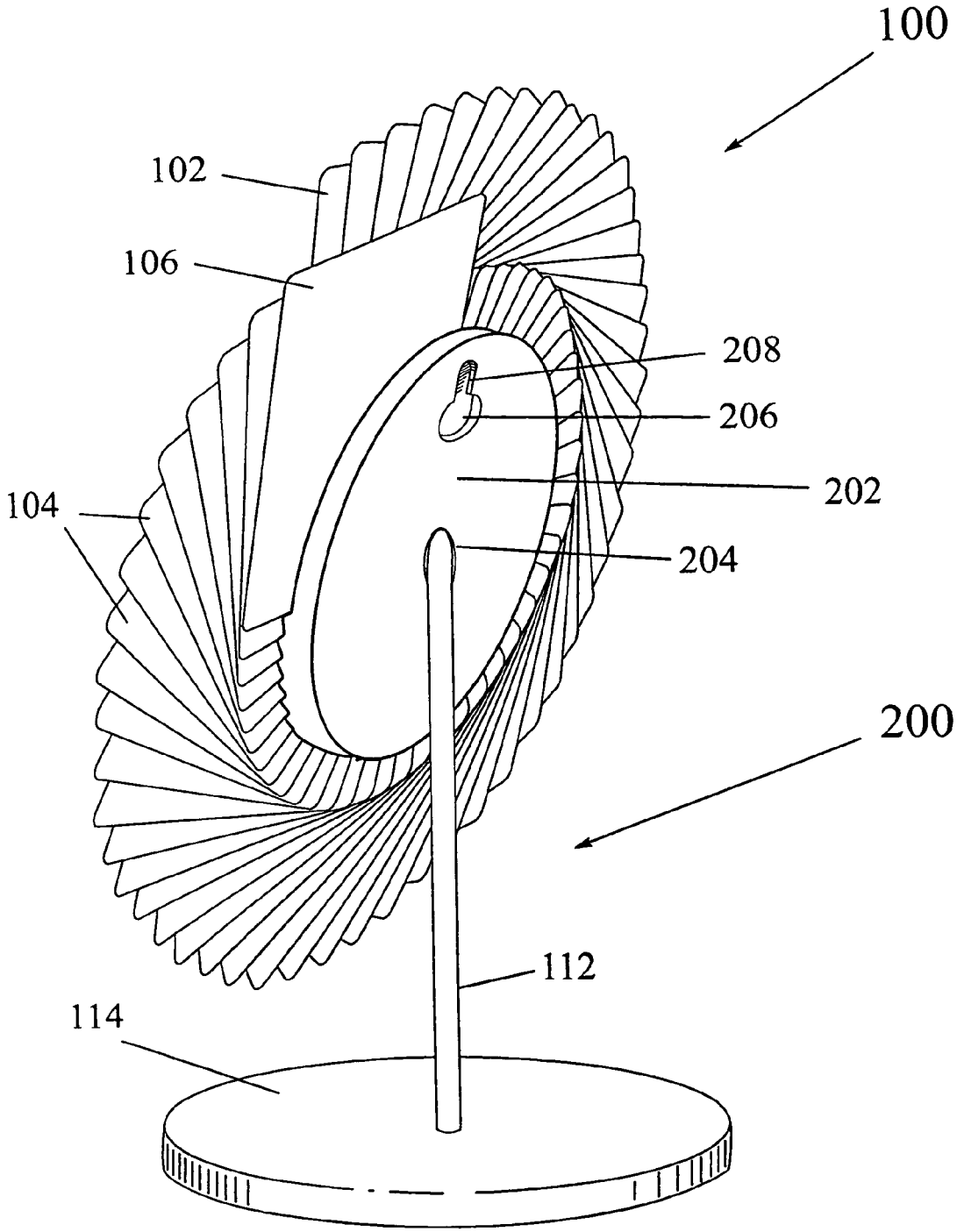
FIG. 2 depicts an angled, rear view of the assembled card game illustrated in FIG. 1 in accordance with one embodiment of the present invention including, inter alia, a plate having plate recesses, a support aperture, and a shaft aperture.

Referring first to FIG. 1, illustrated is an angled front view of an assembled card game 100 in accordance with an embodiment of the present invention. In the depicted embodiment, one topmost card 102, fifty-two intermediate cards 104, and one base card 106 are removably attached to plate 202 (FIG. 2). The total quantity of topmost, intermediate, and base cards, 102, 104, and 106, respectively, is equivalent to the number of cards in a standard deck of cards (i.e., fifty-four cards). Such a quantity allows the combination of topmost card 102, intermediate cards 104, and base card 106 to include two jokers as well as the four standard suits in a typical deck of cards (i.e., diamonds, hearts, spades, and clubs), wherein each of the latter includes the thirteen standard values (i.e., ace, two through ten, jack, queen, and king). Consequently, in some embodiments of the invention, whenever topmost, intermediate, and base cards 102, 104, and 106, respectively, are disengaged from plate 202, they may be used to play alternate card games requiring a standard deck of cards such as poker, solitaire, spades, hearts, rummy, or the like.

Embodiments of the present invention are envisioned having quantities of cards other than fifty-four without departing from the scope of the present invention. For example, card game 100 may be designed with fewer cards to allow topmost, intermediate, and base cards, 102, 104, and 106, respectively, to be used to play games typically requiring a lesser quantity of cards such as Old Maid, Crazy Eights, or the like, whenever such cards are not attached to, or are not being arranged for attachment to, plate 202. Alternatively, topmost card 102, intermediate cards 104, and base card 106 may be designed with greater than fifty-four cards to allow such cards to be used to play games typically requiring a large quantity of cards such as Rook®, Flinch®, UNO®, memory, or the like, whenever such cards are not attached to, or are not being arranged for attachment to, plate 202.

In lieu of using topmost, intermediate, and base cards, 102, 104, and 106, respectively, to play card games whenever such cards are not attached to, or are not being arranged for attachment to, plate 202, such cards may be used for other purposes. For example, each card may be an educational flash card including questions and corresponding answers.

In the embodiment of the present invention depicted in FIG. 1, the faces of topmost, intermediate, and base cards, 102, 104, and 106, respectively, each include a distinct image that may be arranged in a circular, stacked manner to allow one coherent image such as image 400 (FIG. 4) to be created. In such an embodiment, topmost, intermediate, and base cards, 102, 104, and 106, respectively, are anchored to plate 202 at a single point via a mechanism such as stop 108 and knob 110, as discussed in greater detail below with respect to FIG. 3. This anchoring allows topmost, intermediate, and base cards, 102, 104, and 106, respectively, to be fixed in a vertical orientation such that the entire face of topmost card 102 and the edges of the faces of intermediate and base cards, 104 and 106, respectively, can be viewed simultaneously. Such anchoring allows the single coherent image created by successfully stacking and arranging topmost, intermediate, and base cards 102, 104, and 106, respectively, to be displayed in a stationary state such that the created image does not become distorted. Furthermore, as discussed in greater detail below with respect to FIG. 2, plate 202 accommodates display of the created image on a vertical surface and inclusion of a removably attached shaft 112 having an integral or removable base 114 allows the created image to be displayed on a horizontal surface.

Turning next to FIG. 2, depicted is an angled rear view of an assembled card game 100 including an angled rear view of stand 200. In the embodiment of the present invention depicted in FIG. 2, stand 200 includes shaft 112 and base 114. The lowermost end of shaft 112 may be permanently or removably attached to base 114, while the uppermost end of shaft 112 is permanently or removably inserted into and affixed to shaft aperture 204 included in plate 202. Inclusion of an aspect of the present invention such as stand 200 allows an assembled card game 100 to rest atop a table, shelf, or other flat or horizontal surface to facilitate display of an assembled card game 100.

Alternatively, when shaft 112 is removed from shaft aperture 204, an assembled card game 100 may be suspended from a wall or other vertical surface by inserting the head of a nail, screw, or other similar fastener mounted to a wall into support aperture 206 such that the downwardly facing surface of plate 202 located directly above support aperture 206 rests atop the fastener, thereby suspending the assembled card game 100 on the vertical surface. In some embodiments of the present invention such as the embodiment depicted in FIG. 2, support aperture 206 is circular with slit 208 extending vertically from its upper edge. Slit 208 further secures an assembled card game 100 to a wall or other vertical surface by allowing the head of a fastener to be inserted through the support aperture 206 until it completely passes therethrough, and thereafter sliding the shaft of the fastener into slit 208. Such a position causes the head of the fastener to act as a stop because its size does not allow it to pass through slit 208. That is, a support aperture 206 having a slit 208 provides further support for an assembled card game 100 when the width of the head of the employed fastener is greater than the width of slit 208 but smaller than the width of support aperture 206. This relationship is such that when the shaft of the fastener is inserted into slit 208, it may only be removed by sliding plate 202, and its assembled cards, upwardly until the shaft of the fastener is removed from slit 208 and is contained within support aperture 206 such that the head of the fastener may pass therethrough, thereby removing the plate from the fastener.

Figure 3:
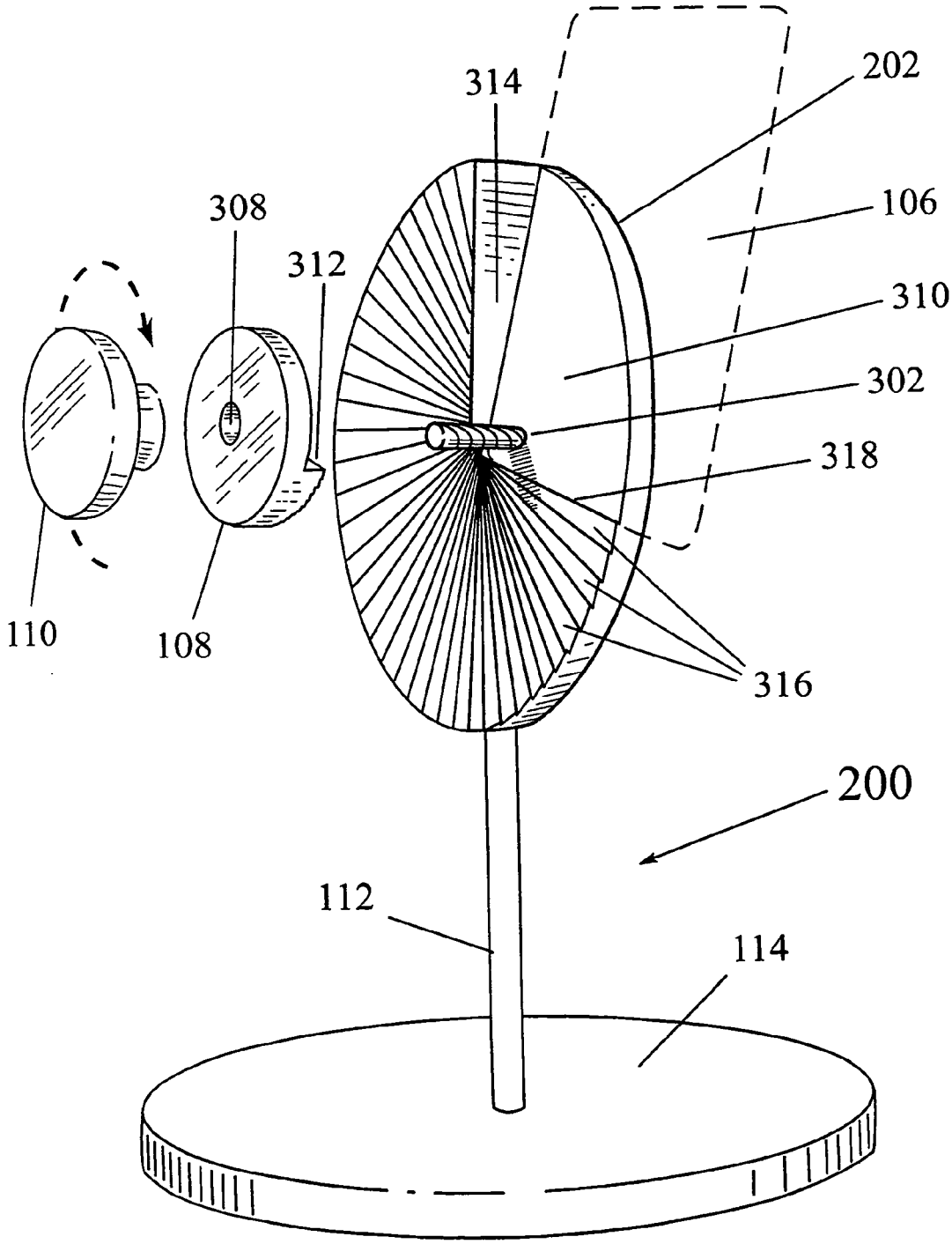
FIG. 3 depicts an angled, front view of the plate, shaft, and base card of the card game illustrated in FIG. 1 with the cards removed in accordance with one embodiment of the present invention including, inter alia, an exploded view of a stop and knob.

Referring now to FIG. 3, illustrated is an angled front view of plate 202 coupled to stand 200, as well as an exploded view of stop 108 and knob 110. As depicted in FIG. 3, plate 202 includes, inter alia, base card plate recess 310, plate wall 314, and intermediate card plate recesses 316. The configuration of plate 202 and its interrelation with stop 108 and knob 110 facilitates stacking and positioning topmost, intermediate, and base cards, 102, 104, and 106, respectively, in a stationary, stacked, circular manner about post 302 such that the faces of such cards create a single coherent image.

To assemble such an image, first, an aperture such as card aperture 502 (FIG. 5) in base card 106 is passed over post 302 until base card 106 is seated in base card plate recess 310. Base card plate recess 310 may have a greater depth than other intermediate plate recesses 316 as it holds base card 106 which is the foundational card for all other cards (i.e., topmost card 102 and intermediate cards 104). In the embodiment of the present invention depicted in FIG. 3, the base card plate recess 310 is located adjacent to and to the right side of plate wall 314, which bisects the upper semicircular half of plate 202. Base card plate recess 310 supports base card 106 such that all corners except the lower left corner of base card 106 extend beyond the perimeter of plate 202. In addition, the bottom edge of base card 106 rests upon lip 318 of base card plate recess 310 such that base card 106 is maintained at the proper angle with respect to post 302. Lip 318 of base card plate recess 310 is a straight edge that radiates approximately from the center of plate 202 to the perimeter of plate 202.

Each intermediate card plate recess 316 is progressively more shallow than base card plate recess 310 such that they form a series of steps beginning at lip 318 of base card plate recess 310 and ending at plate wall 314, thereby ascending in a clockwise direction about post 302. In some embodiments, the depth of each intermediate card plate recess 316 located to the clockwise direction of a previous intermediate or base card plate recess 316 or 310, respectively, is less than the previous plate recess and the difference between the depths of each intermediate card plate recess 316 versus the depth of the previous intermediate card plate recess 316 is an equivalent value. Similar to base card plate recess 310, each intermediate card plate recess 316 forms a lip (i.e., a straight edge that radiates from the approximate center of plate 202 to the perimeter of plate 202) upon which the respective intermediate card 104 rests such that it is maintained at the proper angle with respect to post 302. Maintaining the base and intermediate cards 106 and 104, respectively, at the proper angles with respect to post 302 increases the likelihood that the totality of the faces of such cards will create the desired single coherent image after all cards have been placed in the proper position.

However, virtually any variation of recesses and/or supports may be substituted without departing from the scope of the present invention. For example, embodiments are envisioned in which all or some of the base, intermediate, and top cards do not have a corresponding recess. In some such embodiments, supports may not be provided for such cards or a non-recess support (e.g., a stop) may be substituted.

After placement of base card 106 in base card plate recess 310, an aperture of an intermediate card 104 is passed over post 302 until the respective intermediate card 104 is positioned within the intermediate card plate recess 316 that is adjacent to and to the clockwise direction of base card plate recess 310 such that the bottom edge of intermediate card 104 rests upon the lip of the respective intermediate card plate recess 316. This method continues until all available intermediate card plate recesses 316 are filled in a clockwise manner with the proper intermediate card 104. When the last intermediate card plate recess 316 is filled, the remaining intermediate cards 104 are passed over the post 302 in the correct order and are thereafter supported by a device such as stop 108. Correctly selecting the proper intermediate card 104 to fill each intermediate card plate recess 316 creates the puzzle aspect of the present invention since the final coherent image will not be achieved unless each of the topmost, intermediate, and base cards 102, 104, and 106, respectively, is in the proper position.

After all intermediate card plate recesses 316 have been filled, the card apertures of the remaining intermediate cards 104 are passed over post 302 one by one until all such cards are arranged in a circular fashion with respect to post 302. Thereafter, the card aperture in topmost card 102 is passed over post 302 and positioned such that the totality of the faces of all such cards displays a single coherent image.

Figure 4:
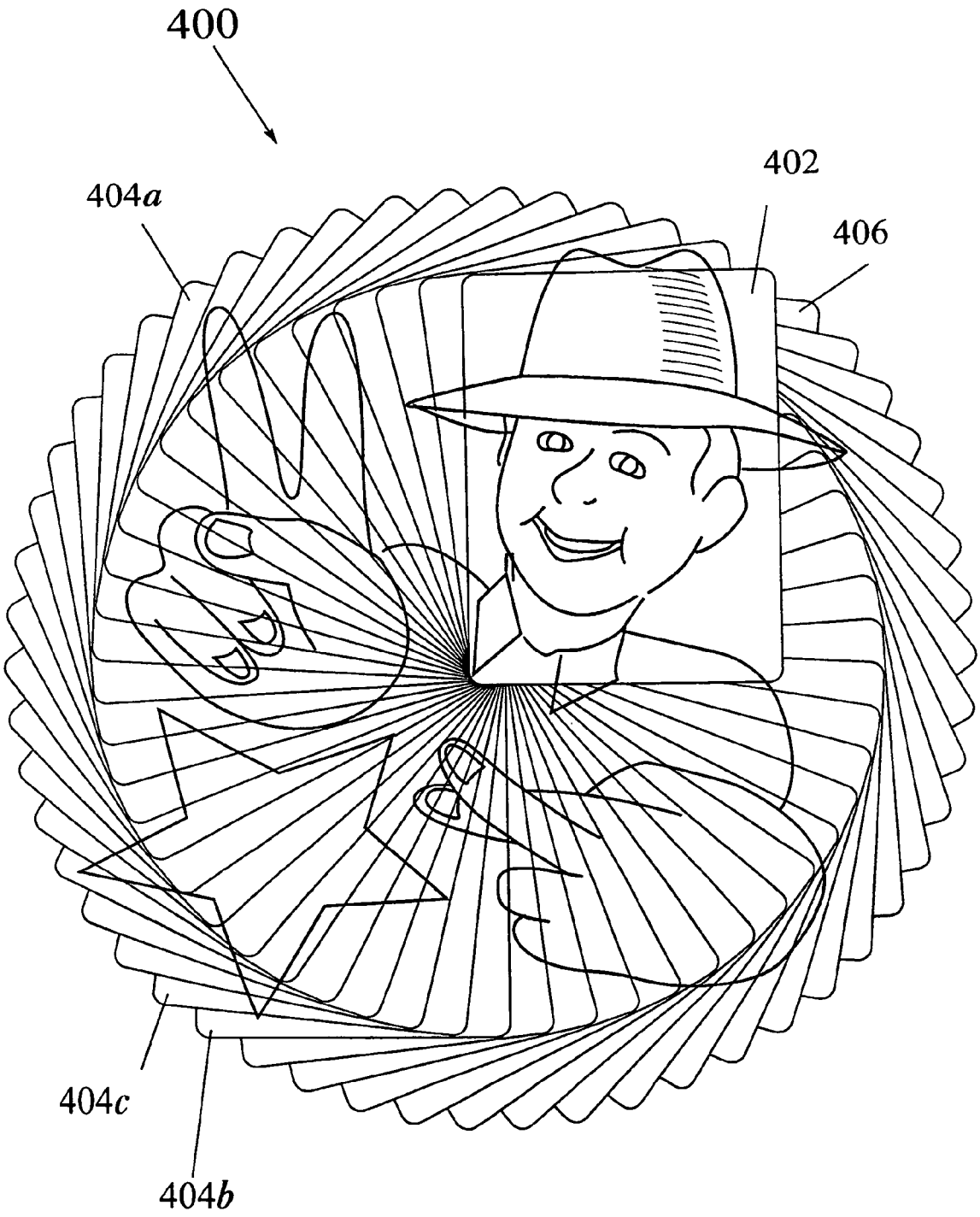
FIG. 4 depicts an assembled coherent image in accordance with one embodiment of the present invention including topmost, intermediate, and base cards.

After topmost, intermediate, and base cards, 102, 104, and 106, respectively, have been properly stacked and positioned to create a single coherent image, they may be secured to plate 202 via knob 110, stop 108, and post 302. Stop 108 includes stop aperture 308 and one or more stop lips 312. Stop aperture 308 allows stop 108 to be removably attached to plate 202 by passing stop aperture 308 over post 302. For example, after the card apertures of all topmost, intermediate, and base cards, 102, 104, and 106, respectively, have been passed over post 302 and such cards have been properly positioned to create a single coherent image, stop aperture 308 of stop 108 is passed over post 302 and positioned such that one or more of stop lips 312 supports side edges of intermediate and topmost cards 104 and 102, respectively. Such stop lips 312 have the identical function of the lips of base and intermediate plate recesses 310 and 316, respectively. Similar to the aforementioned recesses, stop lips 312 may be stepped and may radiate to equally spaced points around the perimeter of stop 108. Additionally, the spacing and quantity of stop lips 312 may be designed such that the totality of the faces of topmost, intermediate, and base cards 102, 104, and 106, respectively, may be arranged to form a single coherent image such as image 400 (FIG. 4). Although embodiments of the present invention are envisioned in which every card of topmost, intermediate, and base cards 102, 104, and 106, respectively, is supported by a recess or stop lip such as the embodiment depicted in FIGS. 1-3, many embodiments of the present invention do not have such a configuration.

Finally, after stop 108 has been properly positioned, knob 110 may be threaded onto post 302 until knob 110 firmly affixes topmost, intermediate, and base cards 102, 104, and 106, respectively, to plate 202 such that the image created by the totality of the faces of such cards is preserved as a single, stationary coherent image. In one embodiment of the present invention, knob 110 includes a threaded aperture that is the female counterpart to a threaded post 302, which protrudes from plate 202. After passing stop 108 over post 302, knob 110 may be threaded to post 302 such that stop 108 and topmost, intermediate, and base cards, 102, 104, and 106, respectively, are secured to plate 202. When knob 110 is fully tightened, stop 108 is flush with knob 110 and topmost and intermediate cards 102 and 104, respectively, rendering topmost, intermediate, and base cards 102, 104, and 106, respectively, immovable. Plate 202 may then be hung on a vertical surface as discussed above with respect to FIG. 2, may be attached to shaft 112 and base 114 for resting on a horizontal surface, or may be otherwise displayed with a greatly minimized possibility of a shift in the position of topmost, intermediate, or base cards 102, 104, and 106, respectively (i.e., a distortion of the single coherent image).

In some embodiments of the present invention, one or more of stop 108 and knob 110 may be manufactured from a rigid transparent material that securely affixes topmost, intermediate, and base cards 102, 104, and 106, respectively, to plate 202 while minimizing any blockage of the single coherent image produced by card game 100. Or, alternatively, stop 108 or knob 110 may be manufactured from a slightly resilient material that acts to more securely anchor topmost, intermediate, and base cards 102, 104, and 106, respectively, in their proper position. Or, plate 202 may be manufactured from a slightly resilient material to allow the tightened stop and knob to more tightly secure topmost, intermediate, and base cards 102, 104, and 106, respectively.

The quantity of intermediate card plate recesses included in a plate may vary with the quantity of cards included with a specific card game. For example, a plate may include a quantity of base and intermediate card plate recesses that allows each intermediate and base card to be supported by a dedicated intermediate or base plate recess. In addition, a topmost card plate recess may be provided to hold and position topmost card. Alternatively, one or more of topmost and intermediate cards may be solely or additionally supported by stop lips. Or, in yet another embodiment, base or intermediate plate recesses, respectively, may be configured to support the base card or more than one intermediate card, respectively. Any combination of configurations for supporting topmost, intermediate, and base cards may be implemented without departing from the scope of the present invention.

Furthermore, although FIGS. 1-3 depict an attachment mechanism such as stop 108 and knob 110, alternate attachment mechanisms may be substituted without departing from the scope of the present invention. For example, post 302 may alternatively have a permanently attached cap at its longitudinal end opposite the affixed plate that is shaped as the head of a nail, and card apertures 502 may be configured as slots rather than circular apertures. Such slot-shaped apertures would slide over the shaft of post 302 and would be prevented from sliding off post 302 via attachment of the cap.

Referring next to FIG. 4, illustrated is an array of topmost, intermediate, and base cards, 402, 404*a*-404*c*, and 406, respectively, assembled such that a single coherent image 400 is created in accordance with one embodiment of the present invention. Topmost, intermediate, and base cards, 402, 404*a*-404*c*, and 406, respectively, have a shape and configuration similar to the topmost, intermediate, and base cards, 102, 104, and 106, respectively, discussed above with respect to FIGS. 1-3. Image 400 is created by arranging the individual images or portions of images that appear on the faces of topmost, intermediate, and base cards, 402, 404*a*-404*c*, and 406, respectively, until the images on the faces of each of such cards meshes with the images on the faces of all adjacent cards in a seamless side-by-side fashion, thereby creating a single, coherent image 400.

Figure 5:
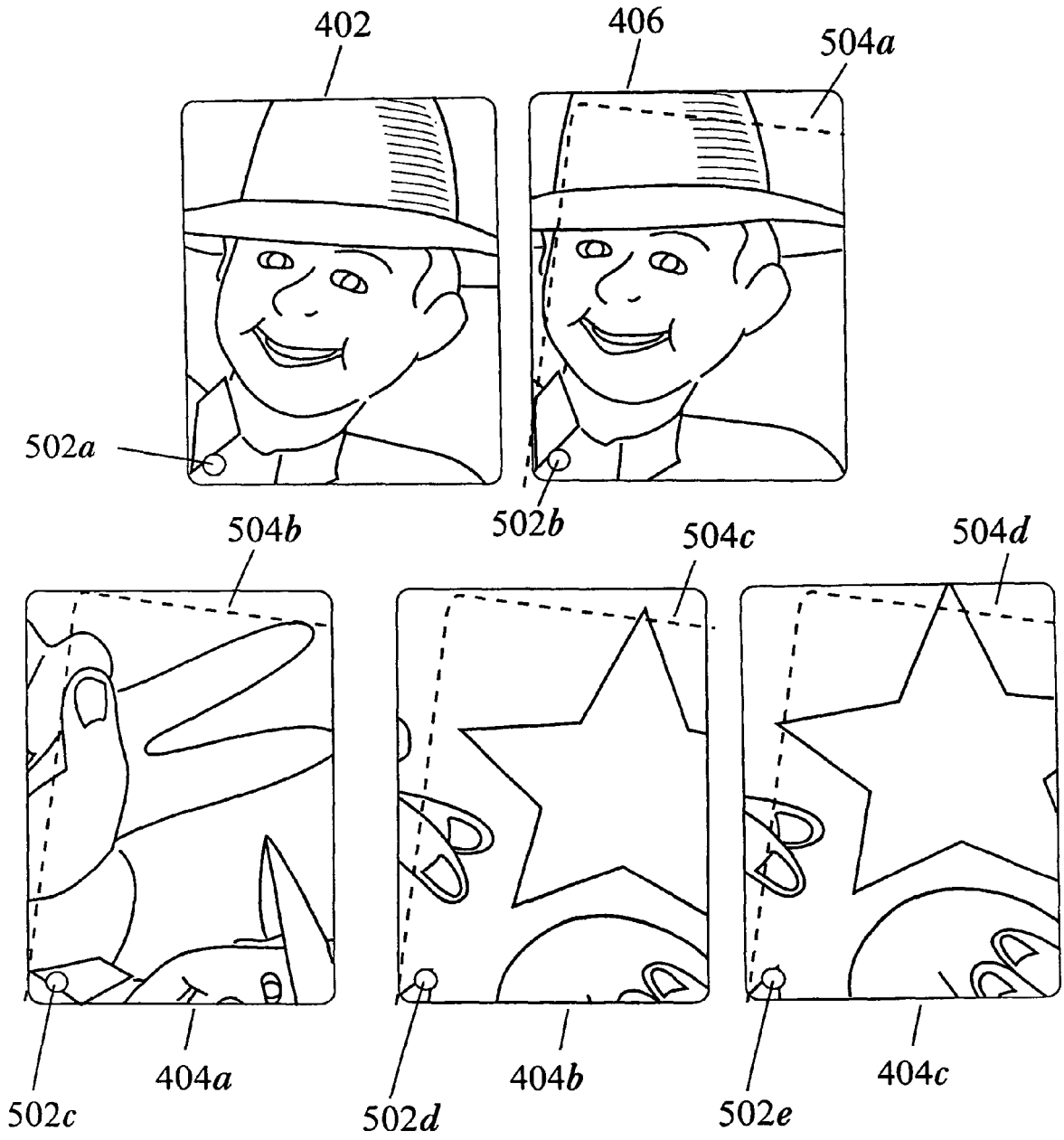
FIG. 5 depicts the faces of a full-figured topmost card, a full-figured base card, and three full-figured intermediate cards in accordance with one embodiment of the present invention including an aperture in each card and dashed lines indicating the obscured portions of each of the base and intermediate cards.
Figure 6:
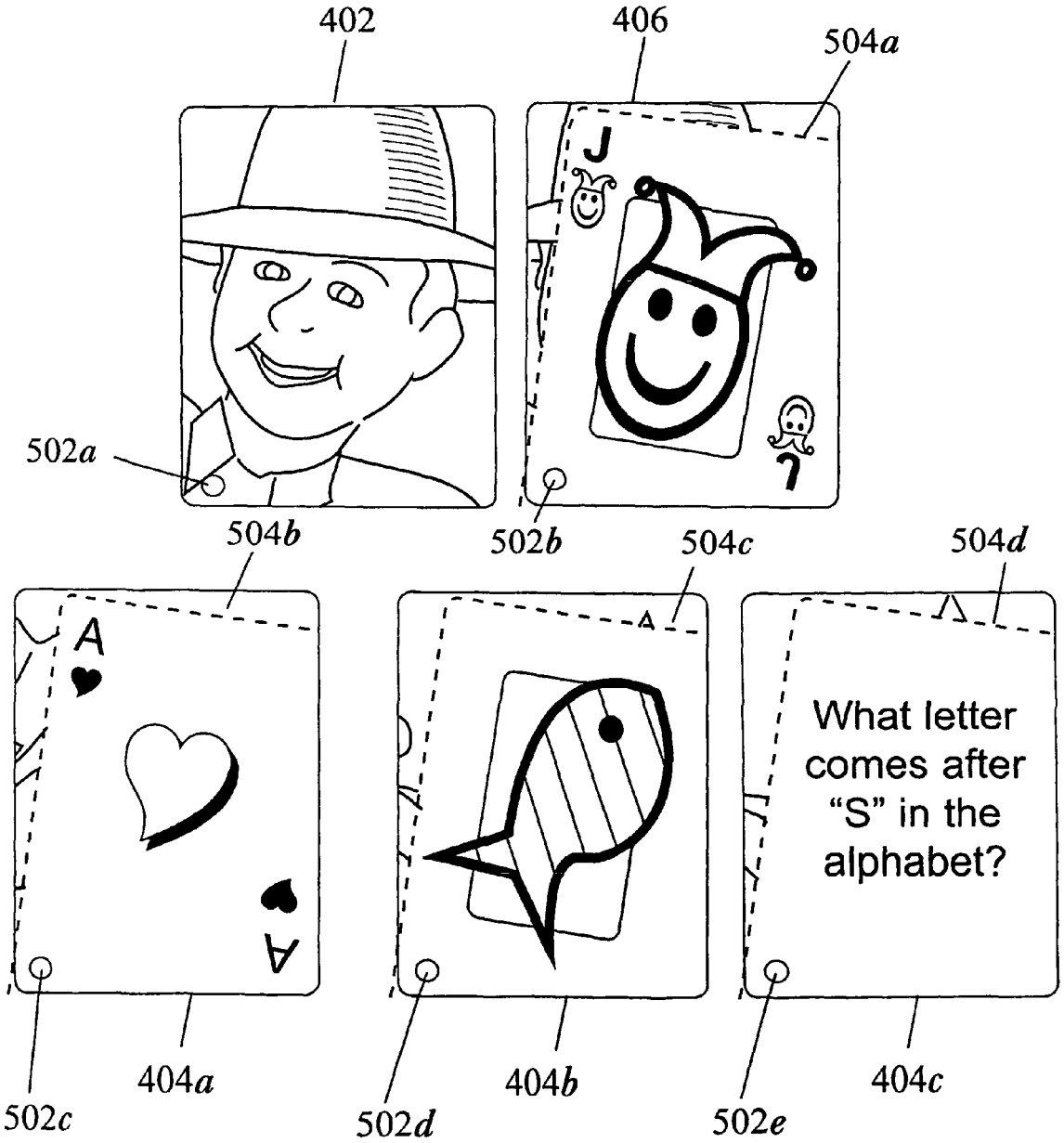
FIG. 6 depicts the faces of a full-figured topmost card, a partially-figured base card, and three partially-figured intermediate cards in accordance with one embodiment of the present invention including an aperture in each card and dashed lines indicating the obscured portions of each of the base and intermediate cards.

The faces of each of topmost, intermediate, and base cards 402, 404*a*-404*c*, and 406, respectively, may include a varying amount of visual information. For example, such faces may be full-figured or partially-figured as illustrated in FIGS. 5 and 6, respectively. Each of the cards depicted in FIGS. 5 and 6 is depicted as it would appear prior to assembly or after removal from plate 202.

Each of the cards depicted in FIGS. 5 and 6 includes one of card apertures 502*a*-502*e* to facilitate assembly of image 400 and attachment of such image to plate 202 as discussed in greater detail above with respect to FIG. 3. In this embodiment of the present invention, card apertures 502 are located at the same position on each of topmost, intermediate, and base cards 402, 404, and 406, respectively, to cause each card to be anchored to plate 202 at the same point. The use of an identical anchor point and identical locations of card apertures 502 facilitates creation of the circular configuration of the resulting image 400.

Referring now to FIG. 5, depicted are topmost, intermediate, and base cards 402, 404*a*-404*c*, and 406, respectively, having full-figured faces. Dashed lines 504*a*-504*d* delineate the portions of base and intermediate cards, 406 and 404*a*-404*c*, respectively, that are visible in image 400 when a card game such as card game 100 is fully assembled. That is, when a card game of the present invention is fully assembled, the portion of the face of each card located above and to the left of dashed lines 504*a*-504*d* comprises a portion of image 400 and the portion of the face of each card located below and to the right of dashed lines 504*a*-504*d* is hidden behind adjacent, overlapping topmost or intermediate cards 402 and 406, respectively.

Turning next to FIG. 6, depicted are topmost, intermediate, and base cards 402, 404*a*-404*c*, and 406, respectively, having partially-figured faces. Similar to the cards depicted in FIG. 5, dashed lines 504*a*-504*d* delineate the portions of base and intermediate cards, 406 and 404*a*-404*c*, respectively, that are visible in image 400 when a card game such as card game 100 is fully assembled. That is, when a card game of the present invention is fully assembled, the portion of the faces of the cards located above and to the left of dashed lines 504*a*-504*d* comprises a portion of image 400 and the portion of the faces of the cards located below and to the right of dashed lines 504*a*-504*d* is hidden behind adjacent, overlapping topmost or intermediate cards 402 and 406, respectively. Since each base and intermediate card, 406 and 404, respectively, includes a relatively small portion of image 400, it is likely that adjacent cards of the assembled card game 100 will closely resemble each other, thereby increasing the complexity of assembling the card game of the present invention.

In contrast to the full-figured card faces depicted in FIG. 5, the partially-figured card faces in FIG. 6 may optionally contain information or images that are not related to image 400, which may appear below and to the right of dashed lines 504*a*-504*d*. For example, each of these portions of the faces of base and intermediate cards, 406 and 404, respectively, may include one card of a standard deck of cards. In this scenario, since the face of topmost card 402 is completely covered with a figure, it will serve as one of the two jokers of a standard deck of cards. Also, in this example, the second joker is included in the portion of the card face of base card 406 located below and to the right of dashed line 504*a*. In another example of this embodiment, the portion of the face of intermediate card 404*a* located below and to the right of dashed line 504*b* includes the ace of hearts. All other cards of the deck similarly represent one of the required cards in a standard deck of playing cards.

Alternatively, information related to a special deck of cards may be included to the right and below dashed lines 504*a*-504*d*. Specifically, these hidden areas may include letters, numbers, or images that allow for the playing of other card games that are either already in existence, or are yet to be invented. For example, FIG. 6 depicts the hidden portion of intermediate card 404*b* as the face of a Go Fish® card in accordance with one embodiment of the present invention. In this embodiment of the present invention, the hidden portion of each of the faces of base and intermediate cards 406 and 404 depicts a different card of an Old Maid® card deck. In this embodiment, topmost card 402 could be employed as a wild card, since topmost card 402 does not have a hidden area for placement of an additional image. Although the embodiment of the present invention depicted with respect to intermediate card 404*b* is that of a Go Fish® card, cards for alternate games could be included without departing from the scope of the present invention.

Similarly, intermediate card 404*c* of FIG. 6 depicts an embodiment of the present invention that includes an educational flash card. In particular, the portion of the face of intermediate card 404*c* located below and to the right of dashed line 504*d* depicts an alphabetical question. However, other types of educational questions (e.g., multiplication tables, history questions, etc.) may be substituted without departing from the scope of the present invention. In such embodiments of the present invention, base card 406 and all intermediate cards 404 may include a different educational question related to or unrelated to the image that results from assembly of the respective card game. In this embodiment, full-figured topmost card 402 may not serve an educational purpose since topmost card 402 does not have a hidden area for placement of an educational question or image. However, such full-figured cards may serve another purpose (e.g., may provide a free point when drawn). Although the educational embodiment depicted with respect to intermediate card 404*c* contains an educational question intended for a young child, questions for other ages (e.g., teenagers, adults, etc.) or non-educational questions (e.g., trivia) could be substituted without departing from the scope of the present invention.

Although, FIG. 6 depicts various specific embodiments of the hidden areas of intermediate and base cards 404 and 406, respectively, other embodiments could be included without departing from the scope of the present invention. Any images or other content could be included in the hidden portion of these cards as long as it is contained within the hidden portion and does not thereby change the appearance of image 400.

Referring now to both FIGS. 5 and 6, topmost card 402 does not include a dashed line since the entire face of topmost card 402 is visible in image 400. Furthermore, in the embodiments of the present invention including cards as depicted in FIG. 5, topmost card 402 bisects the upper semicircular half of image 400 and includes the most significant portion of the coherent image, which in this embodiment depicts a man's head, to provide a more satisfying sense of completion to image 400. Although the image 400 depicted in FIG. 4, depicts a topmost card 402 that bisects the upper semicircular half of image 400, other embodiments of the present invention are envisioned in which topmost card 402 is located in an alternate location without departing from the spirit of the present invention.

Furthermore, as discussed in greater detail below with respect to FIG. 18, the backs of topmost, intermediate, and base cards 402, 404*a*-404*c*, and 406, respectively, may each include one card of a standard deck of cards or one card of a special deck of cards as discussed above with respect to FIG. 1. Alternatively, the backs of each card could contain a portion of a second image similar to image 400 to allow one set of cards to be assembled to create either of two, distinct images. In yet another embodiment, the backs of topmost, intermediate, and base cards 402, 404*a*-404*c*, and 406, respectively, may include information that is either related to or unrelated to image 400, and is included to increase the enjoyment, educational value, or utility of the card game (e.g., such information may create flash cards that allow children to study various subjects).

Figure 7:
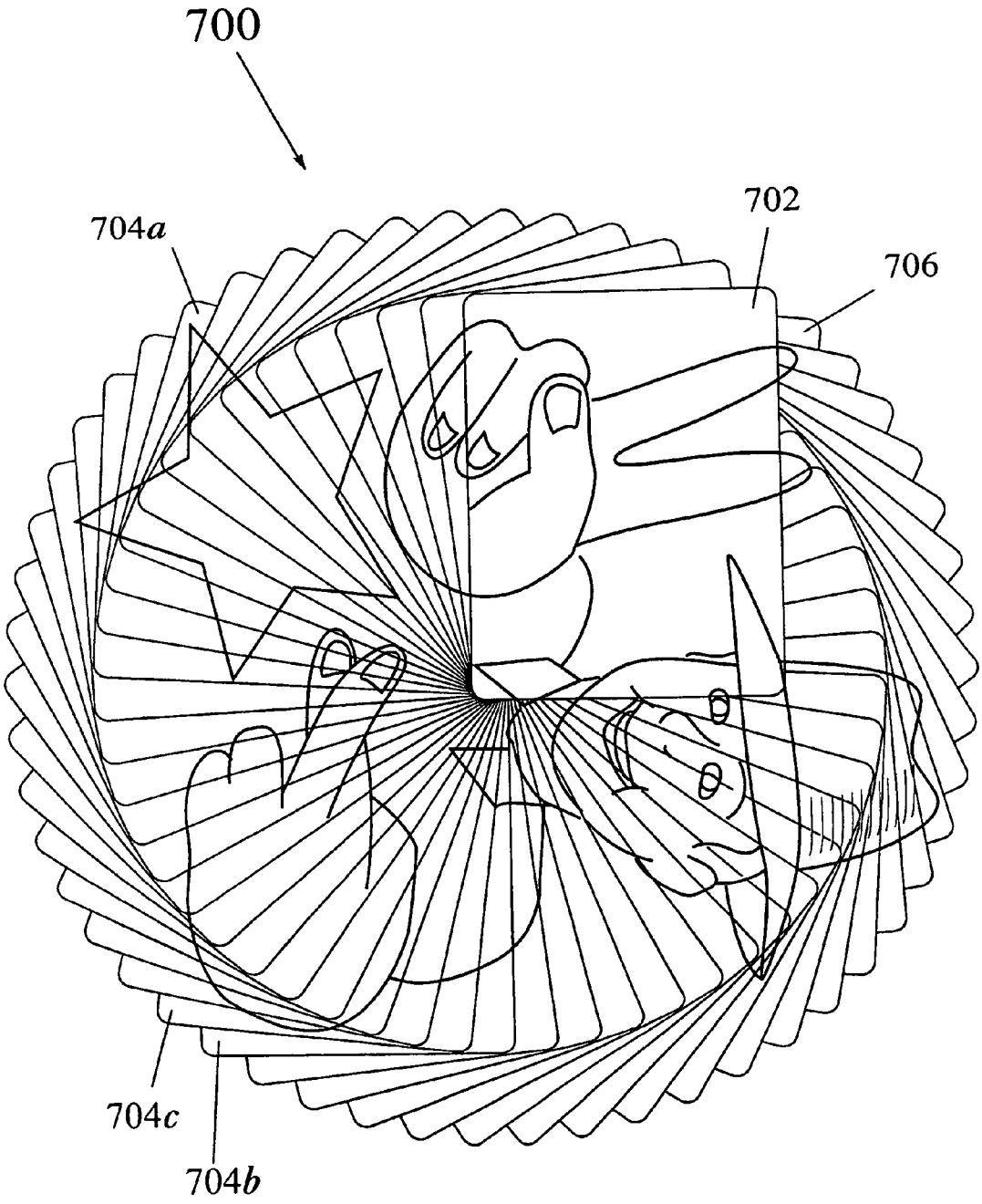
FIG. 7 depicts an assembled coherent image in accordance with the embodiment of the present invention depicted in FIG. 4 including topmost, intermediate, and base cards in which a different card has been selected as the base card causing the image to rotate clockwise ninety degrees.

Turning next to FIG. 7, illustrated is an alternate array of the topmost, intermediate, and base cards 402, 404, and 406, respectively, depicted in FIGS. 4 and 5. In this array of such cards, a different coherent image results due to the selection of a different base card 706 as compared to base card 406 selected for the coherent image depicted in FIG. 4. This selection of base card 706 causes the resulting image 700 to be rotated clockwise with respect to the resulting image 400 that is created when base card 406 is selected as depicted in FIG. 4, despite the fact that an identical deck of cards is employed. Such clockwise rotation occurs since selection of a different base card 706 alters the card that is finally placed as topmost card 702. Since base card 706 is the first card to be placed atop plate 202, changing the card incorporated for base card 706 automatically causes resulting image 700 to be oriented at an angle different than image 400 although topmost card 702 is located in the same position as topmost card 402.

The ability to change the orientation of the resulting single coherent image is best accommodated using a deck of cards comprised completely of full-figured topmost, intermediate, and base cards 702, 704, and 706, respectively. Use of such cards allows a quantity of rotated resulting images equal to the quantity of cards contained in the specific deck of cards (i.e., any one of the cards may be selected as base card 706 allowing any one of the cards to become topmost card 702). For example, the change in the base card from base card 406 as depicted in FIG. 4 to base card 706 as depicted in FIG. 7 changes the image represented on the face of the topmost card from the head of a man as depicted in FIG. 4 to the right hand of the man as depicted in FIG. 7.

Figure 8:
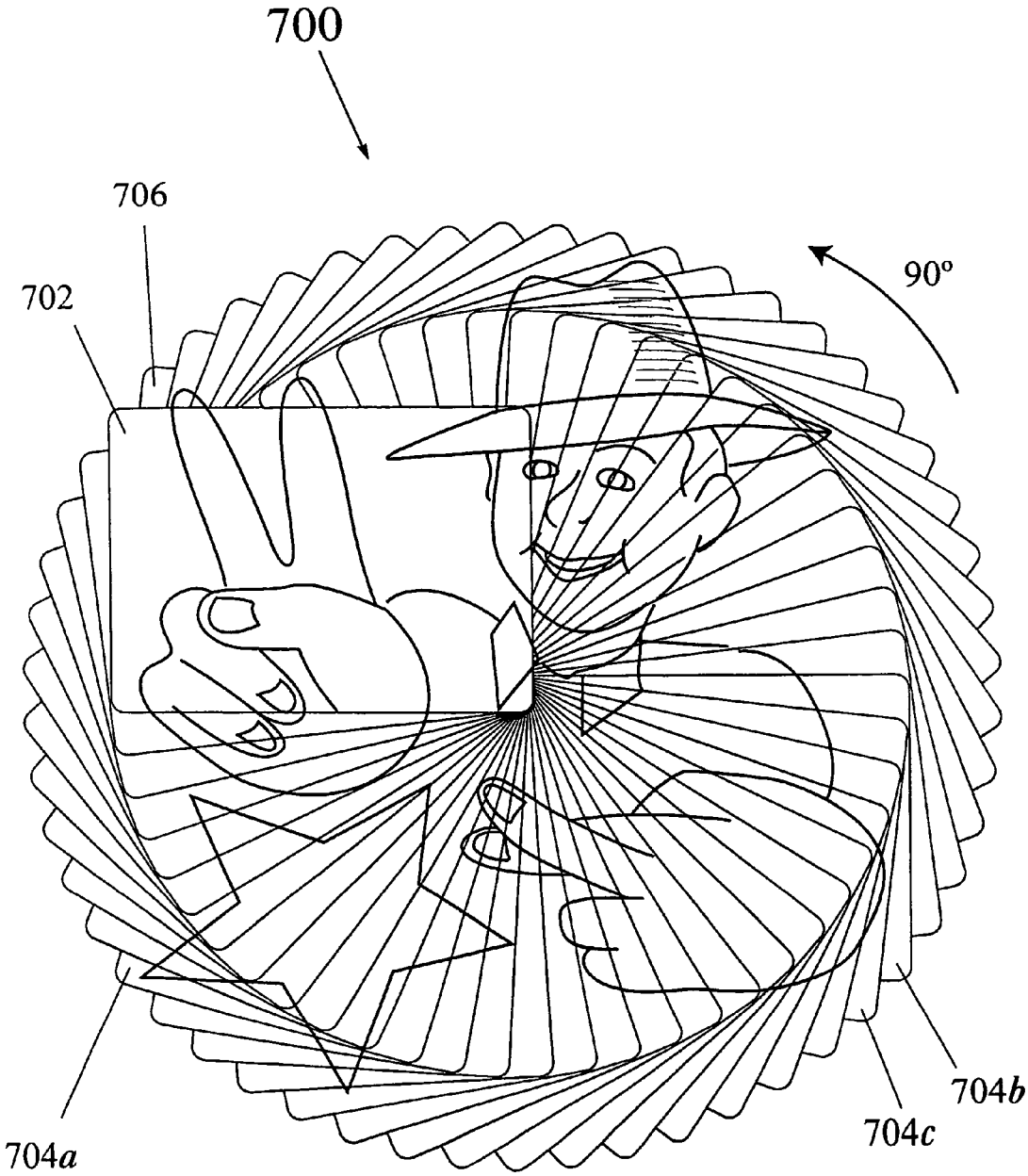
FIG. 8 depicts an assembled coherent image in accordance with the embodiment of the present invention depicted in FIG. 7 in which the image has been rotated counterclockwise ninety degrees to provide a more aesthetically pleasing display.

Depicted in FIG. 8 is image 700 as depicted in FIG. 7 rotated ninety degrees counterclockwise to allow image 700 to be displayed in a more aesthetically pleasing position (i.e., in a position in which the image of the man is upright). The degrees and direction of rotation required to display any final assembled image in an aesthetically pleasing position depends directly on the card that has been selected to be base card 706 and the type of image being displayed. For example, some abstract images may require no rotation whatsoever in order to be aesthetically pleasing as a finished image regardless of which card is selected to be base card 706.

In order to accommodate all of the possible degrees and directions of rotation that may be required for a final assembled coherent image in an embodiment of the present invention wherein any card may be selected at random to be base card 706, an alternate embodiment of plate 202, plate 1302 (FIG. 13), or stand 1408 (FIG. 14) may be incorporated that allows the assembled array of topmost, intermediate, and base cards 702, 704, and 706, respectively, to be rotated 360° while attached to stand 200 (FIG. 2). Alternatively, stand 200 may be configured such that it may be positioned at any angle of rotation atop a horizontal surface or may be hung at any angle of rotation on a vertical surface (e.g., multiple support apertures may be positioned in a circular pattern through the rear of plate 202).

Figure 9:
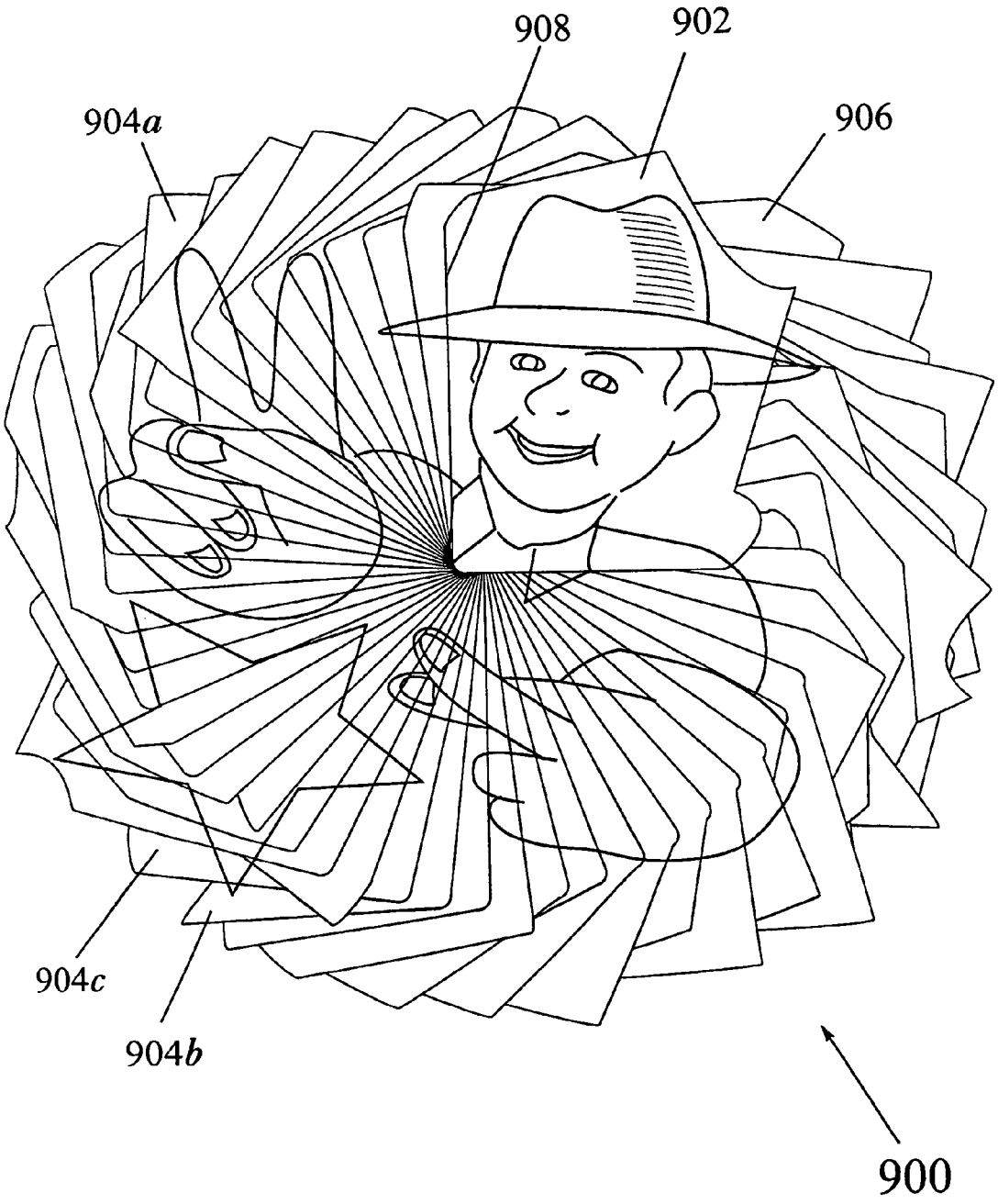
FIG. 9 depicts an assembled coherent image in accordance with one embodiment of the present invention including topmost, intermediate, and base card in which each of the cards has a varying shape and size.

Turning now to FIG. 9, depicted is image 900 in accordance with an alternate embodiment of the present invention in which each card has a varied shape and size. Image 900 is created by a circular configuration of topmost, intermediate, and base cards 902, 904, and 906, respectively, similar to the circular configuration of cards in card game 100 as described above with respect to FIGS. 1-8. However, whereas the embodiments of the present invention depicted in these figures have equal rectangular shapes, the embodiment of the present invention depicted in FIG. 9 includes topmost, intermediate, and base cards 902, 904, and 906, respectively, having varied shapes and sizes.

To accommodate cards having such varied shapes, some embodiments of the present invention include cards having one or more standardized edges 908. For example, the embodiment depicted in FIG. 9 includes cards having a standardized left edge. Standardized edges 908 allow a player of the card game to perform a systematic side-by-side comparison of the cards to determine the order in which such cards should be stacked and/or arranged in a circular manner. Without such a standardized edge, the complexity of the card game is greatly increased. By varying the shapes and sizes of such cards, resulting images having a variety of shapes may be created. For example, each card may be shaped such that the final resulting image is in the shape of an animal, a star, a four-leaf clover, a heart, etc. to allow the card game to be tailored for specific events, holidays, etc.

Figure 10:
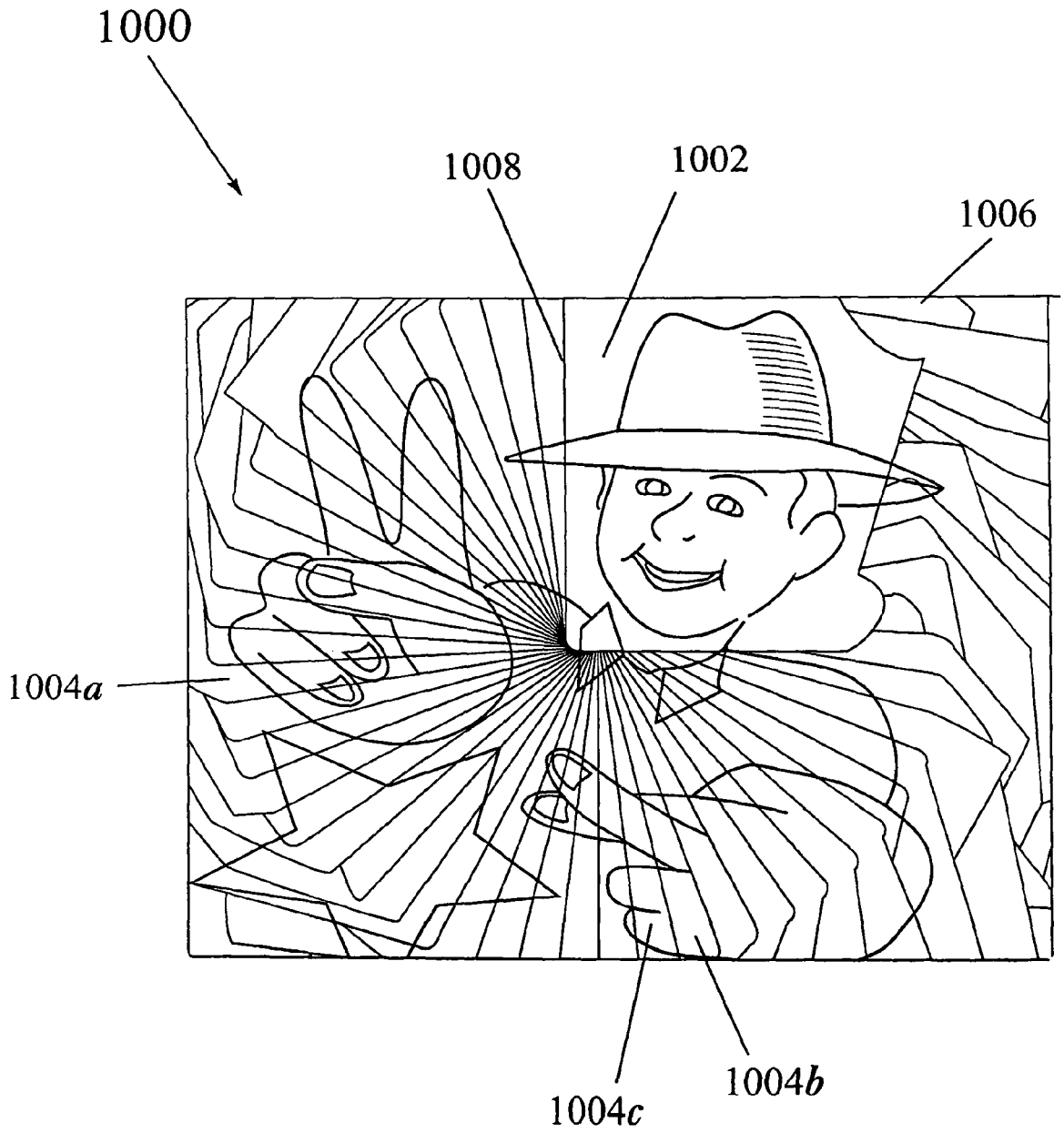
FIG. 10 depicts an assembled coherent image in accordance with one embodiment of the present invention including topmost, intermediate, and base cards in which the cards are assembled such that the resulting coherent image is rectangular.

Furthermore, as depicted in FIG. 10, the shape of topmost, intermediate, and base cards 1002, 1004, and 1006, respectively, may be configured such that the resulting image 1000 is rectangular in shape. Additionally, this rectangular shape may allow image 1000 to be framed using a standard, rather than custom, frame. Similar to the embodiment depicted in FIG. 9, each of topmost, intermediate, and base cards 1002, 1004, and 1006, respectively, includes standardized edge 1008 to facilitate assembly of the card game by allowing the player to perform a systematic side-by-side comparison of the aforementioned cards.

Figure 11A:
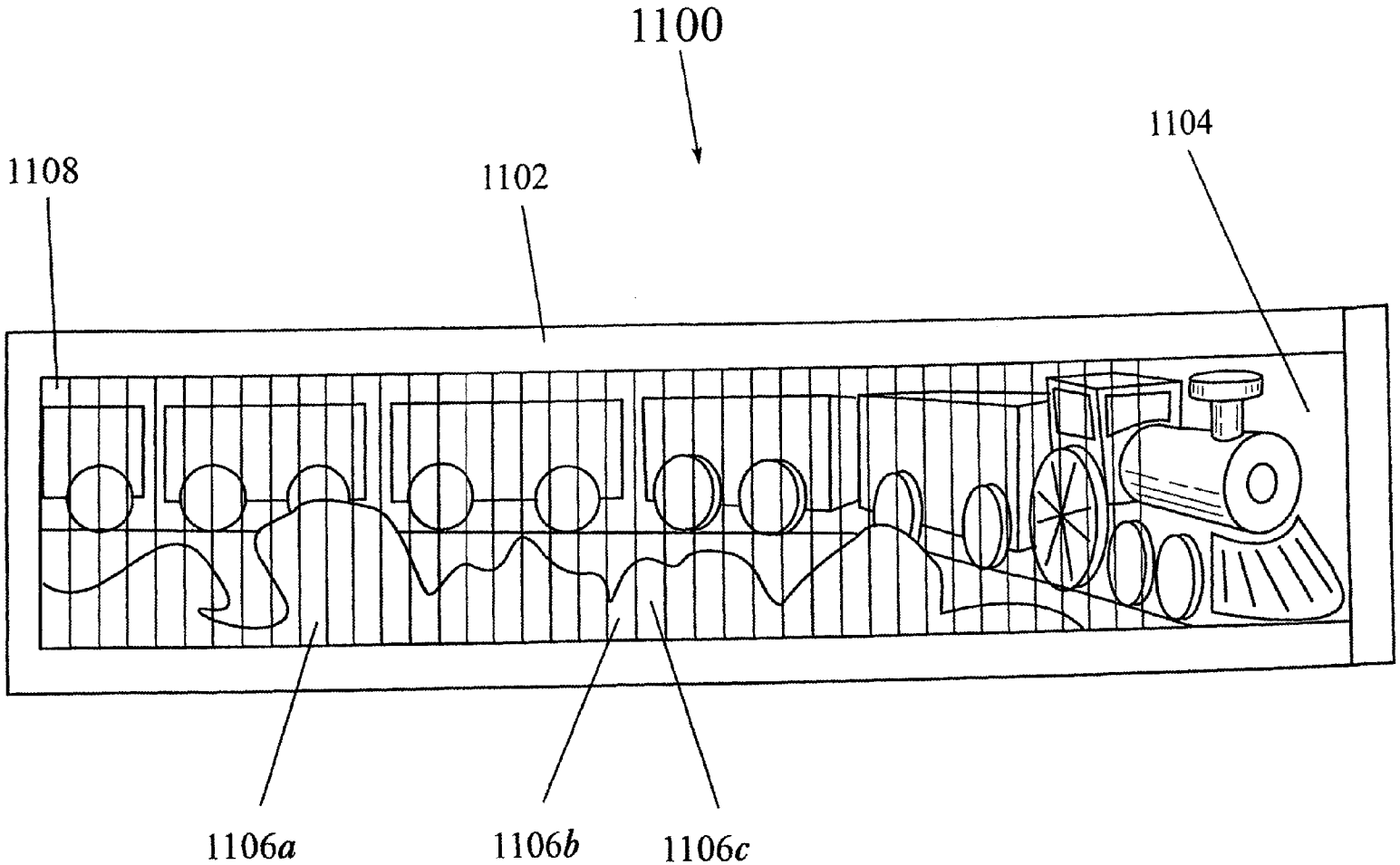
FIG. 11A depicts a front view of an assembled linear card game in accordance with one embodiment of the present invention including, inter alia, cards and rectangular plate.

Referring next to FIG. 11A, depicted is an assembled linear card game 1100 in accordance with an embodiment of the present invention. In this embodiment, stand 1102 may be employed to arrange each of the topmost, intermediate, and base cards 1104, 1106, and 1108, respectively, in a linear fashion. In card game 1100, intermediate and base cards 1106, and 1108, respectively may be full-figured or partially-figured. In the latter embodiment, a segment of the final coherent image is located on the left side of the card face. As discussed herein, the portion of the faces of intermediate and base cards 1106 and 1108, respectively, that does not include a segment of the final coherent image may be blank or printed with other images, numbers, graphics, or the like.

Figure 11B:
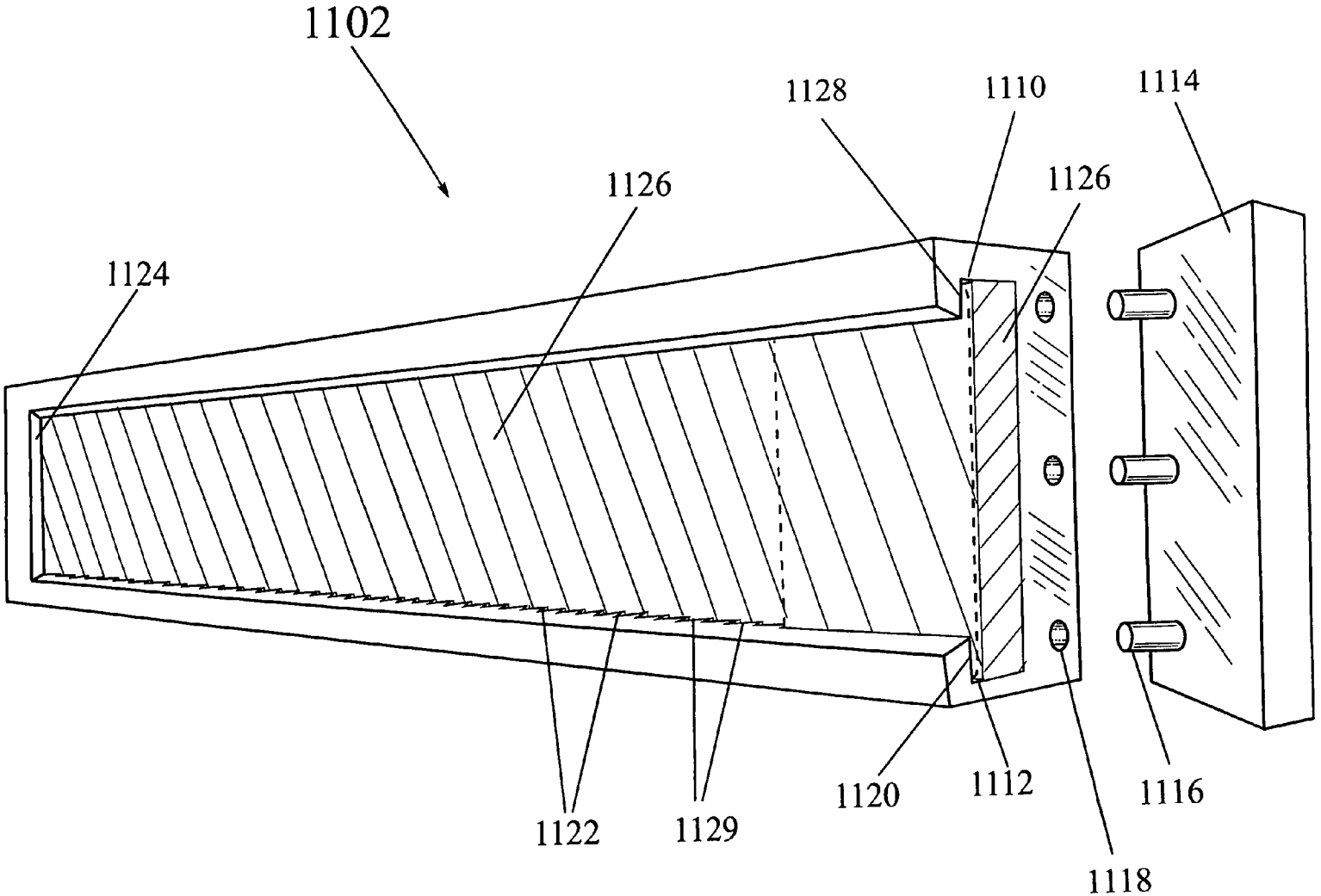
FIG. 11B depicts an angled, front view of the stand of the card game illustrated in FIG. 11A with the cards and cap removed in accordance with one embodiment of the present invention.

Turning next to FIG. 11B, depicted is an angled front view of stand 1102 with cap 1114 removed, which may be used in conjunction with a deck of cards to create an assembled linear card game 1100 (FIG. 11A). First, a player removes cap 1114. In the embodiment of the present invention depicted in FIG. 11B, cap 1114 is affixed to stand 1102 by insertion of pegs 1116 into corresponding peg apertures 1118, however, any method of securing cap 1114 to stand 1102 may be incorporated without departing from the scope of the present invention.

After cap 1114 is removed, topmost, intermediate, and base cards 1104, 1106, and 1108, respectively, may be slid into stand 1102 such that the upper portion of the face of such cards abuts the inwardly facing upper slit wall 1128 of upper slit 1110 and the lower portion of the face of such cards abuts the inwardly facing lower slit wall 1120 of lower slit 1112. Furthermore, lower slit wall 1120 optionally includes recesses 1129 having integral recess lips 1122, which impede the leftward longitudinal motion of cards inserted therein. However, any card may be advanced beyond any recess lip 1122 toward left wall 1124 by applying pressure to the face of the card in the direction of inner wall 1126. Preferably, inner wall 1126 is manufactured from a resilient material such as rubber or synthetic foam that allows motion of a card toward inner wall 1126 when pressure is exerted on the card's face, however, other materials may be substituted without departing from the scope of the present invention. Use of such a material allows inner wall 1126 to remain in an uncompressed state when no pressure is exerted on a card, thereby causing the face of each card to abut lower and upper slit walls 1120 and 1128, respectively. Such material also allows inner wall 1126 to contract when pressure is applied to the card, thereby allowing the card to clear recess lip 1122 such that the card may be slid longitudinally toward left wall 1124. In some embodiments of the present invention, upper slit wall 1128 also includes recesses and recess lips similar to recesses 1129 and recess lips 1122. After insertion of all cards in the deck of cards in the aforementioned manner, stand 1102 supports and secures topmost, intermediate, and base cards 1104, 1106, and 1108, respectively, in a manner suitable to the aesthetic display of the coherent image in an upright position.

Figure 11C:
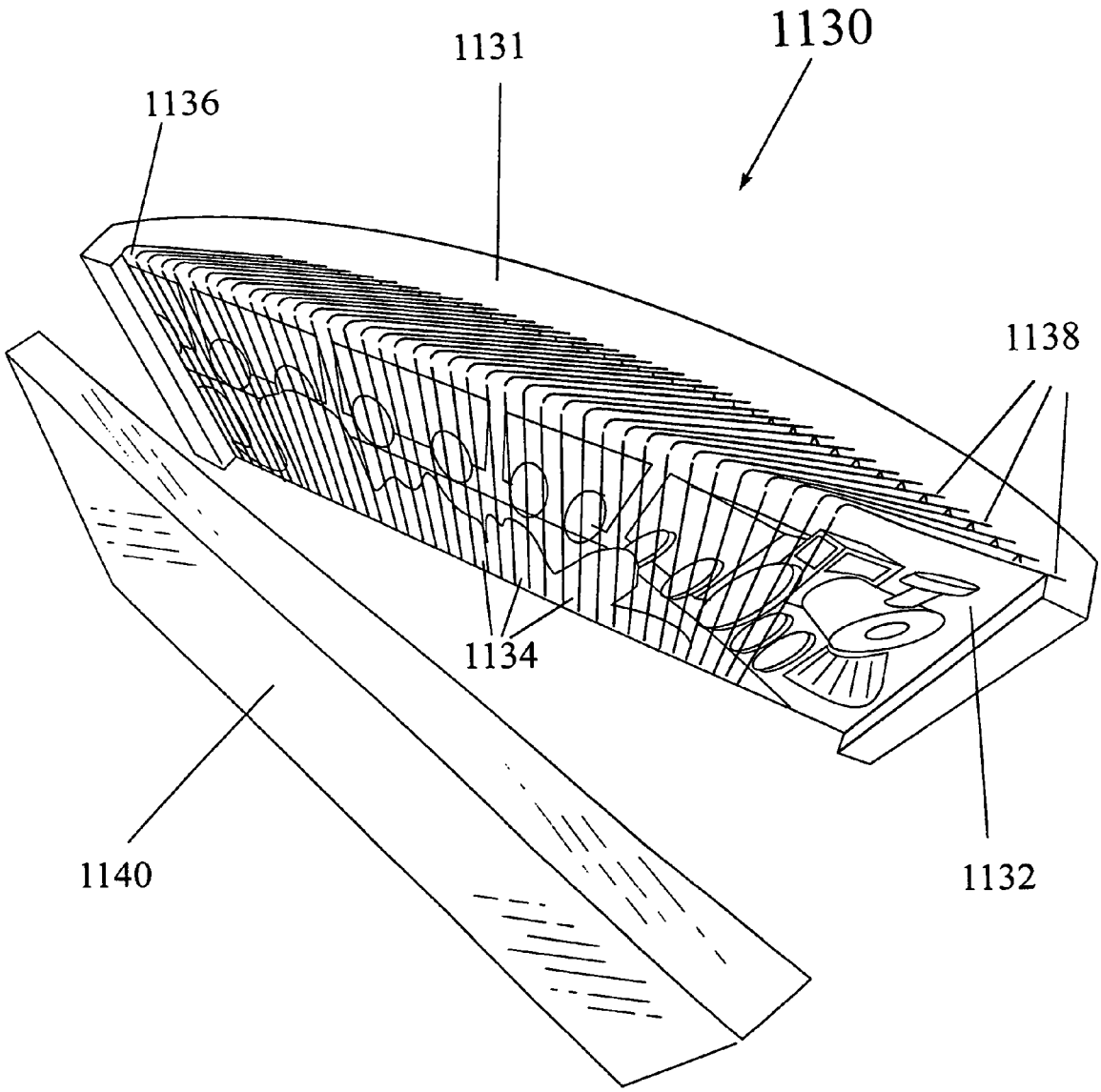
FIG. 11C depicts an angled, top view of an alternate assembled linear card game with the cover removed in accordance with one embodiment of the present invention including, inter alia, cards and stand.

Turning next to FIG. 11C, depicted is an angled top view of another embodiment of an assembled linear card game 1130. Similar to stand 1102, stand 1131 is also designed to hold an assembled deck of topmost, intermediate, and base cards 1132, 1134, and 1136, respectively, in a linear fashion. Cards are anchored within stand 1131 by insertion of such cards into slits 1138, which are individually cut into the inner wall of stand 1131. In some embodiments of the present invention, stand 1131 may include transparent cover 1140, which further secures topmost, intermediate, and base cards 1132, 1134, and 1136, respectively, within stand 1131 by exerting pressure on the faces of such cards. Furthermore, regardless of whether a cover such as cover 1140 is designed to secure cards within a stand, such a cover may be included in some embodiments of the present invention, including circular embodiments, to protect the cards from dust, debris, or the like, or to enhance the display of assembled linear or circular card games.

Figure 11D:
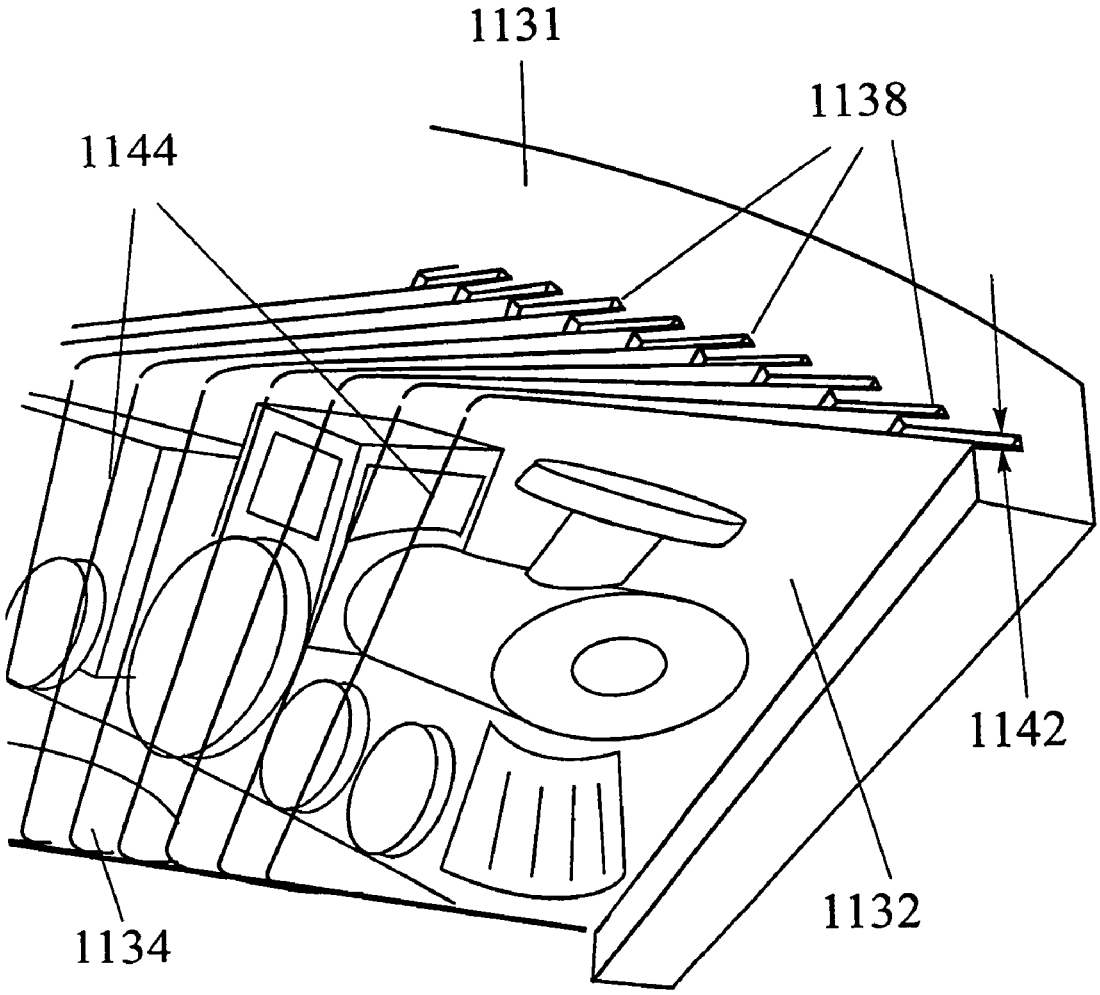
FIG. 11D depicts a magnified, angled, top view of the slits of the card game illustrated in FIG. 11C.

Referring next to FIG. 11D, depicted is a magnified view of slits 1138 of assembled linear card game 1130 as depicted in FIG. 11C. Slits 1138 are configured to firmly hold each of topmost, intermediate, and base cards 1132, 1134, and 1136, respectively, by the compressive stress caused by the constraining width 1142 and the angled cut of slits 1138, and the resilience of the topmost, intermediate, and base cards 1132, 1134, and 1136, respectively. More specifically, the angled cuts that create slits 1138 are designed to vary gradually between adjacent slits 1138 such that left edge 1144 of each card inserted into slit 1138 is in full contact with the face of the card present in an adjacent leftward slit 1138. That is, the angle of each slit 1138 is such that left edge 1144 of each inserted card intersects the plane of the adjacent leftward card, however, the presence of the adjacent leftward card and the resilience of the card material causes the inserted card to bend such that the pressure of the bend maintains the left edge 1144 of the inserted card in full contact with the face of the adjacent leftward card.

In some embodiments of the present invention, the elliptical, oval, or ovate shape of stand 1131 facilitates an intense angling of slits 1138, which helps increase the pressure exerted by each card on the adjacent leftward card. However, such shape is not a required aspect of the present invention. Also, alternate methods of securing cards within plates, stands, or the like whether such configurations are linear, circular, or otherwise, and whether such configurations includes compressive stress, friction, resilient card materials, anchoring methods, or the like may be substituted without departing from the scope of the invention.

As discussed above with respect to alternate embodiments, intermediate and base cards 1106 and 1108, respectively, as well as intermediate and base cards 1134 and 1136, respectively, may be full-figured or partially-figured, wherein the latter embodiment may include information that is not a subsection of the resulting image in the hidden areas. Similarly, such cards may include standardized left edges such as left edges 1144 to accommodate a systematic side-by-side comparison of all cards, thereby allowing a player of the card game to properly arrange such cards to achieve a single coherent image. Furthermore, stands 1102 and 1131 may be modified as necessary to accommodate display on a vertical or horizontal surface.

Figure 12:
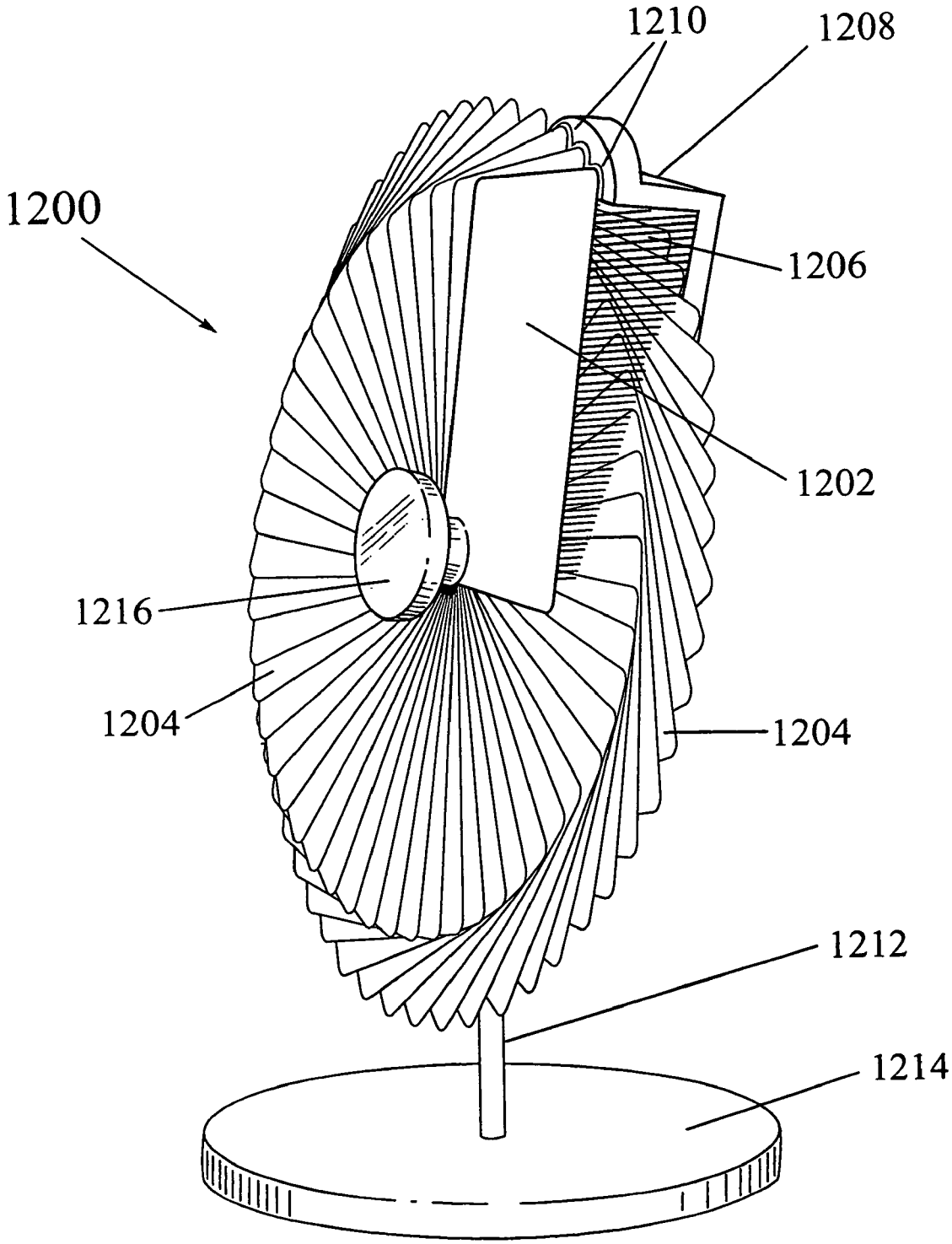
FIG. 12 depicts an angled, front view of an assembled card game in accordance with one embodiment of the present invention including a plate having a plate extension, cards, knob, base, and shaft.

Referring next to FIG. 12, depicted is an alternate embodiment of the present invention substantially equivalent to the embodiment discussed above with respect to FIGS. 1-3. However, the embodiment depicted in FIGS. 12-13 has two anchor points for some cards, in lieu of the one anchor point discussed above with respect to FIGS. 1-3. First, one or more of the topmost, intermediate, and base cards 1202, 1204, and 1206, respectively, are anchored to plate extension 1208 by inserting a corner of such cards into a corresponding recess 1210 of plate extension 1208. Such insertion anchors each of these cards at a point opposite the second anchor point (i.e., the card aperture located in the opposite corner of the cards).

After all intended cards have been inserted in the corresponding recesses 1210 of plate extension 1208, the topmost, intermediate, and base cards 1202, 1204, and 1206, respectively, are further anchored to plate 1302 (FIG. 13) via a mechanism such as knob 1216, or a knob and stop combination, as discussed in greater detail above with respect to FIG. 3. This anchoring allows the topmost, intermediate, and base cards 1202, 1204, and 1206, respectively, to be fixed in an immovable position such that the arrangement of the entire face of topmost card 1202 and the visible edges of the faces of intermediate and base cards, 1204 and 1206, respectively, can be viewed simultaneously. The totality of the face of topmost card 1202 and the exposed edges of the faces of the intermediate and base cards, 1204 and 1206, respectively, creates one larger coherent image as described in greater detail above with respect to FIGS. 4-11. Furthermore, inclusion of a removably attached shaft 1212 having an integral or removable base 1214 allows the assembled cards to be displayed on a horizontal surface as discussed in greater detail above with respect to FIG. 2.

Figure 13:
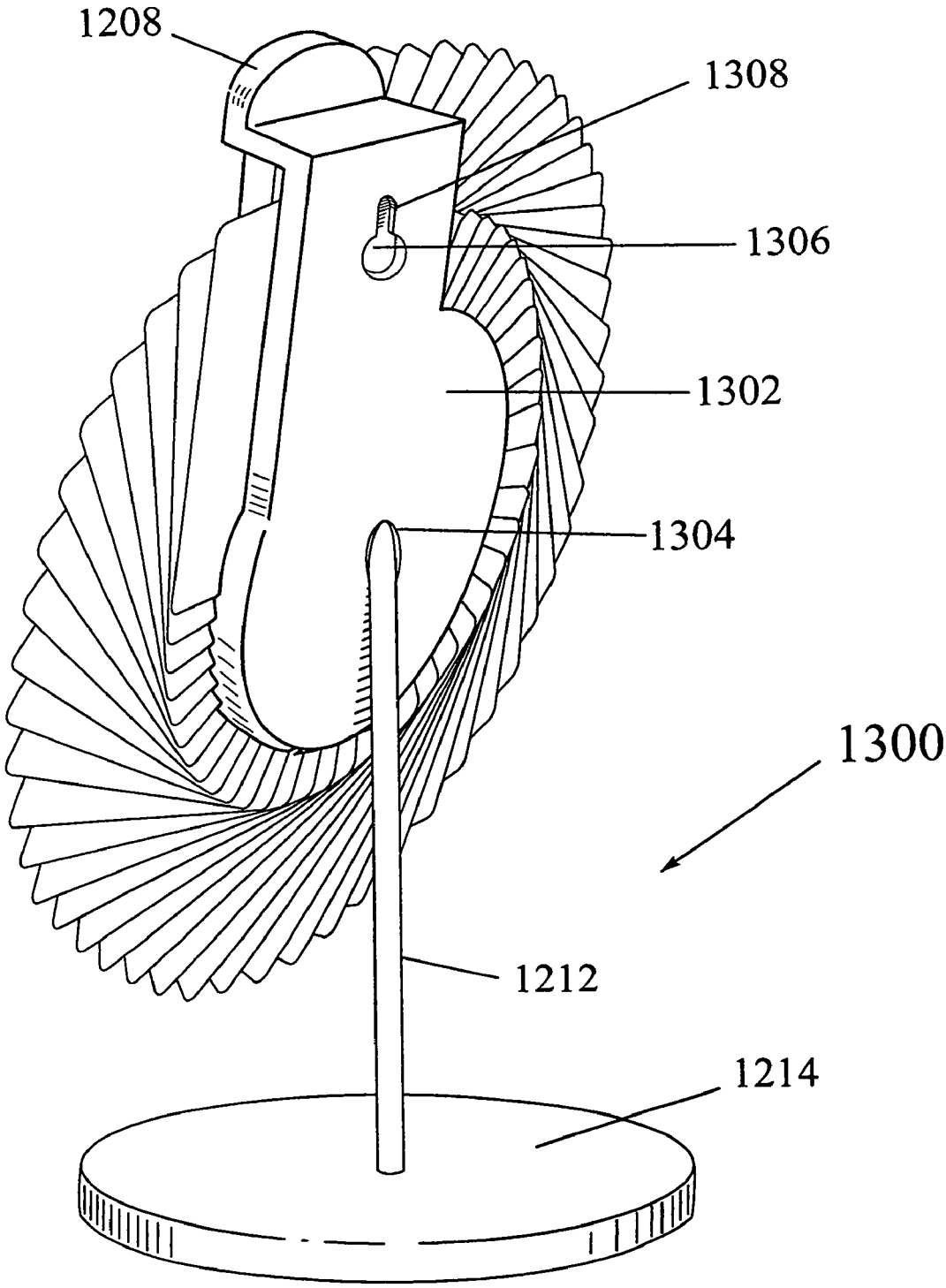
FIG. 13 depicts an angled, rear view of the assembled card game illustrated in FIG. 12 in accordance with one embodiment of the present invention including, inter alia, a plate having a plate extension, plate recesses, a support aperture, and a shaft aperture.

Turning next to FIG. 13, depicted is an angled rear view of an assembled card game 1200 including an angled rear view of stand 1300. In the embodiment of the present invention depicted in FIG. 13, stand 1300 includes shaft 1212 and base 1214. The lowermost end of shaft 1212 may be permanently or removably attached to base 1214, while the uppermost end of shaft 1212 is permanently or removably inserted into and affixed to shaft aperture 1304 included in plate 1302. Inclusion of an aspect of the present invention such as stand 1300 allows an assembled card game such as card game 1200 to rest atop a table, shelf, or other flat surface to facilitate display of card game 1200.

Alternatively, when shaft 1212 is removed from shaft aperture 1304, card game 1200 may be suspended from a wall or other vertical surface by inserting the head of a nail, screw, or other similar fastener mounted to a wall into support aperture 1306 such that the downwardly facing surface of plate 1302 located directly above support aperture 1306 rests atop the fastener, thereby suspending card game 1200 on the vertical surface. In some embodiments of the present invention such as the embodiment depicted in FIG. 12, support aperture 1306 is circular with slit 1308 extending vertically from its upper edge. Slit 1308 further secures card game 1200 to a wall or other vertical surface by allowing the head of a fastener to be inserted through the support aperture 1306 until it completely passes therethrough, and thereafter sliding the shaft of the fastener into slit 1308. Such a position causes the head of the fastener to act as a stop because its size does not allow it to pass through slit 1308. That is, a support aperture 1306 having a slit 1308 provides further support for card game 1200 when the width of the head of the employed fastener is greater than the width of slit 1308 but smaller than the width of support aperture 1306. This relationship is such that when the shaft of the fastener is inserted into slit 1308, it may only be removed by sliding plate 1302, and its assembled cards, upwardly until the shaft of the fastener is removed from slit 1308 and is contained within support aperture 1306 such that the head of the fastener may pass therethrough and release the game from the fastener.

Figure 14:
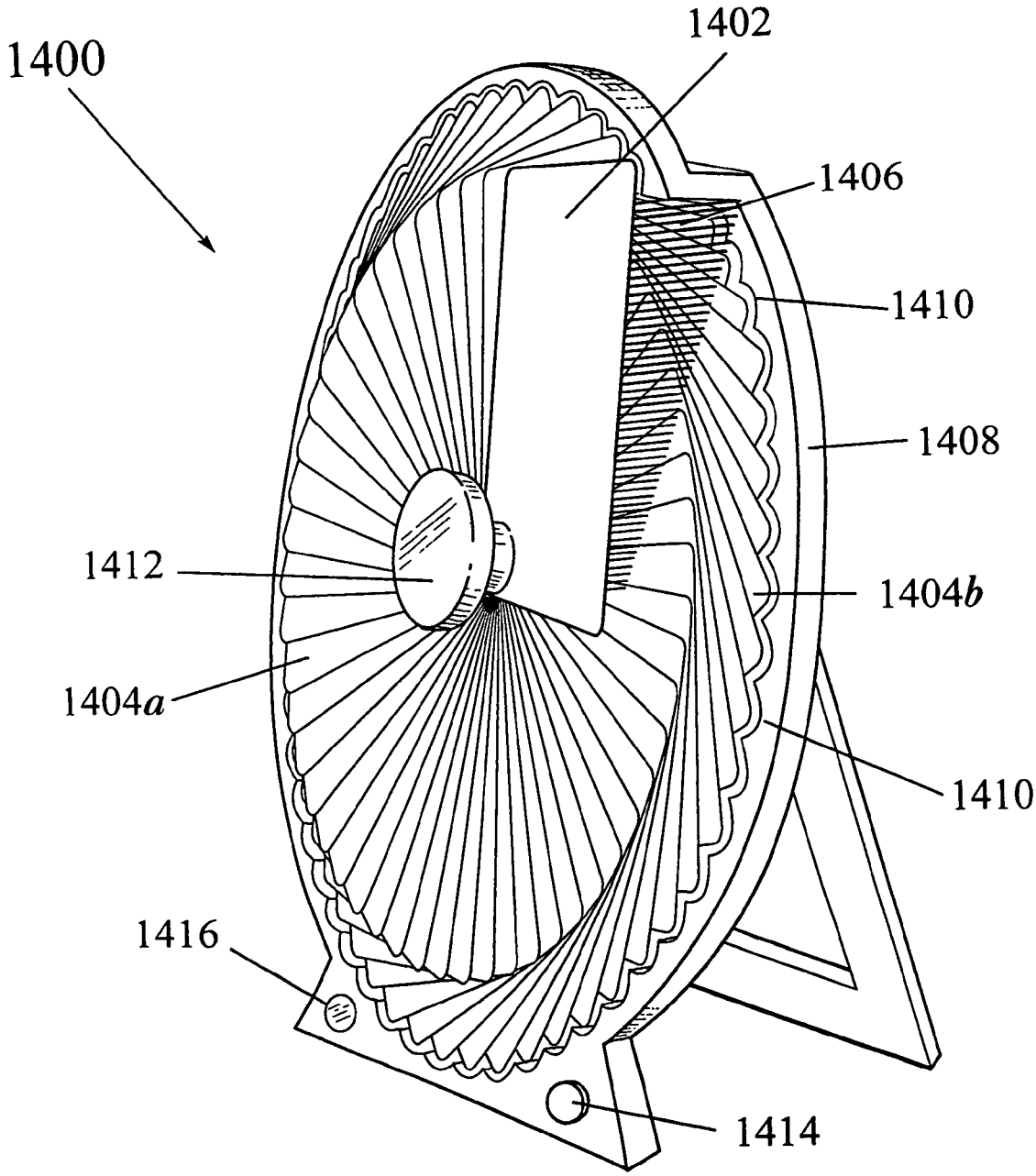
FIG. 14 depicts an angled, front view of an assembled card game in accordance with one embodiment of the present invention including cards, knob, and a stand having an integral base and multiple anchor points.

Turning next to FIG. 14, depicted is card game 1400, which is an alternate embodiment of the present invention substantially equivalent to the embodiment discussed above with respect to FIGS. 12-13. However, whereas the embodiment depicted in FIGS. 12-13 has two anchor points for the topmost card only, or for the topmost card, base card, and a few intermediate cards only, the embodiment of the present invention depicted in FIGS. 14, 15, 16A, and 16B has two anchor points for each of the topmost, base, intermediate cards 1402, 1404, and 1406, respectively.

Figure 15:
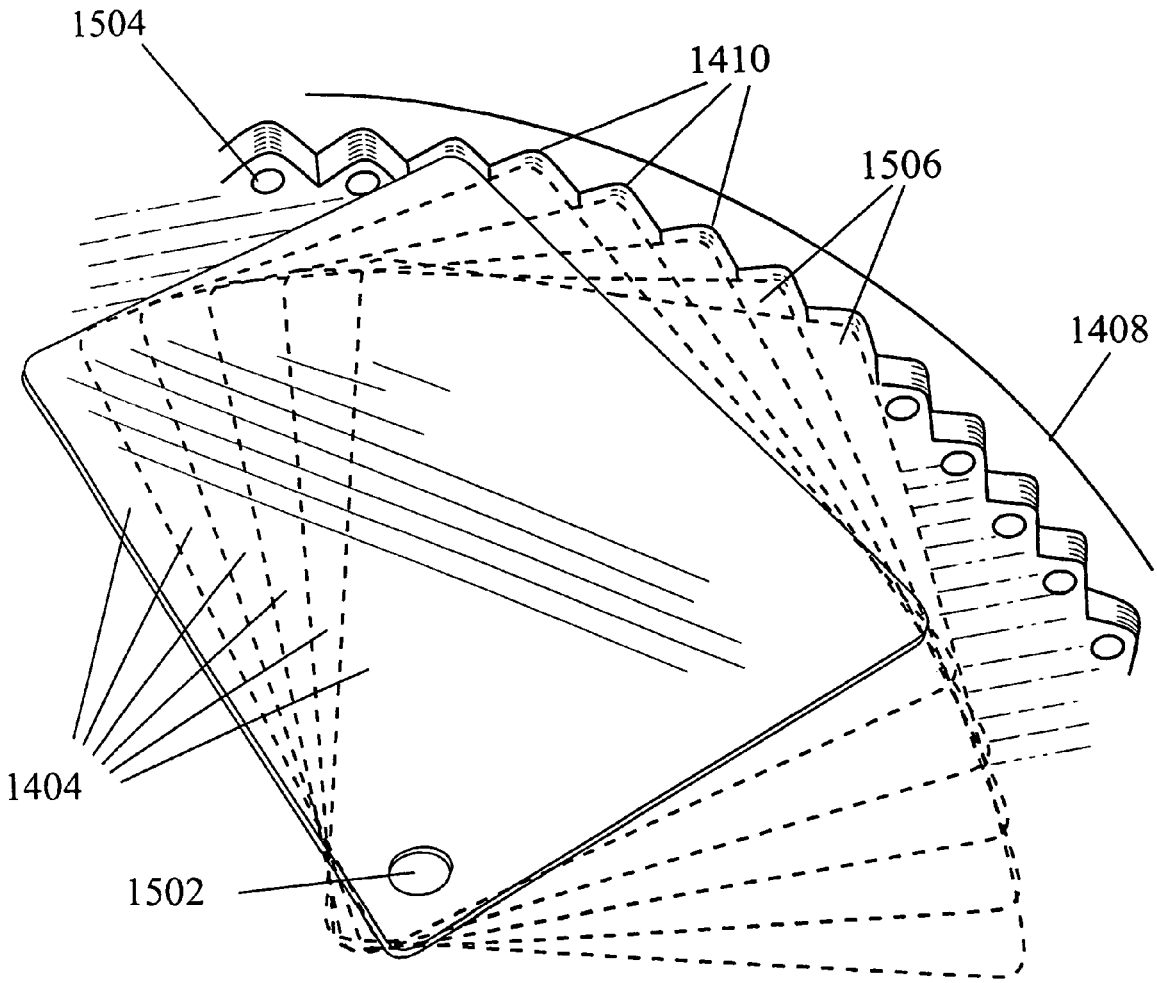
FIG. 15 depicts a magnified view of the stand, recesses, sensors, and anchoring of intermediate cards in accordance with the embodiment of the present invention depicted in FIG. 14.

First, each of topmost, intermediate, and base cards 1402, 1404, and 1406, respectively, are anchored to stand 1408 by inserting the upper right corner of such cards into a corresponding recess 1410 of stand 1408. An enlarged view of the nesting of several intermediate cards 1404 in recesses 1410 is illustrated in FIG. 15. Such insertion anchors each of these cards at a point opposite the second anchor point (i.e., the corner of the cards containing card aperture 1502). In one embodiment of the present invention, the inwardly facing surfaces of the recesses form a 90 degree angle with respect to each other to accommodate insertion of the corners of square or rectangular cards.

After all topmost, intermediate, and base cards 1402, 1404, and 1406, respectively, have been inserted in the corresponding recesses 1410 of stand 1408, topmost, intermediate, and base cards 1402, 1404, and 1406, respectively, are then anchored to stand 1408 via a mechanism such as knob 1412, or a knob and stop combination, as discussed in greater detail above with respect to FIG. 3. This anchoring allows topmost, intermediate, and base cards 1402, 1404, and 1406, respectively, to be fixed in an immovable position such that the entire face of topmost card 1402 and the visible areas of the faces of intermediate and base cards 1404 and 1406, respectively, can be viewed simultaneously. The totality of the face of topmost card 1402 and the exposed areas of the faces of intermediate and base cards 1404 and 1406, respectively, creates one larger coherent image as described in greater detail above with respect to FIGS. 4-11.

Referring now to FIG. 15, illustrated is a magnified view of stand 1408 including, inter alia, intermediate cards 1404, card apertures 1502, magnetic imprints 1506, and sensors 1504. Sensors 1504 are embedded in recesses 1410. Such sensors determine, by electronic or mechanical means, if the correct card has been placed in recess 1410. For example, in the embodiment of the present invention depicted in FIG. 15, sensors 1504 are magnetic sensors that read, or are activated by, magnetic imprints 1506 included in the surface of, or embedded within, the corners of topmost, intermediary and base cards 1402, 1404, and 1406, respectively. These sensors allow the correctness of the inserted cards to be ascertained at any time by pressing button 1414 (FIG. 14), or a similar switch or trigger located on stand 1408, which causes indicator 1416 (FIG. 14) to indicate the accuracy of the inserted cards. Although FIG. 15 discloses an electromagnetic system for detecting and indicating the correctness of inserted cards, other detection and indication may be substituted without departing from the scope of the present invention.

Figure 16A:
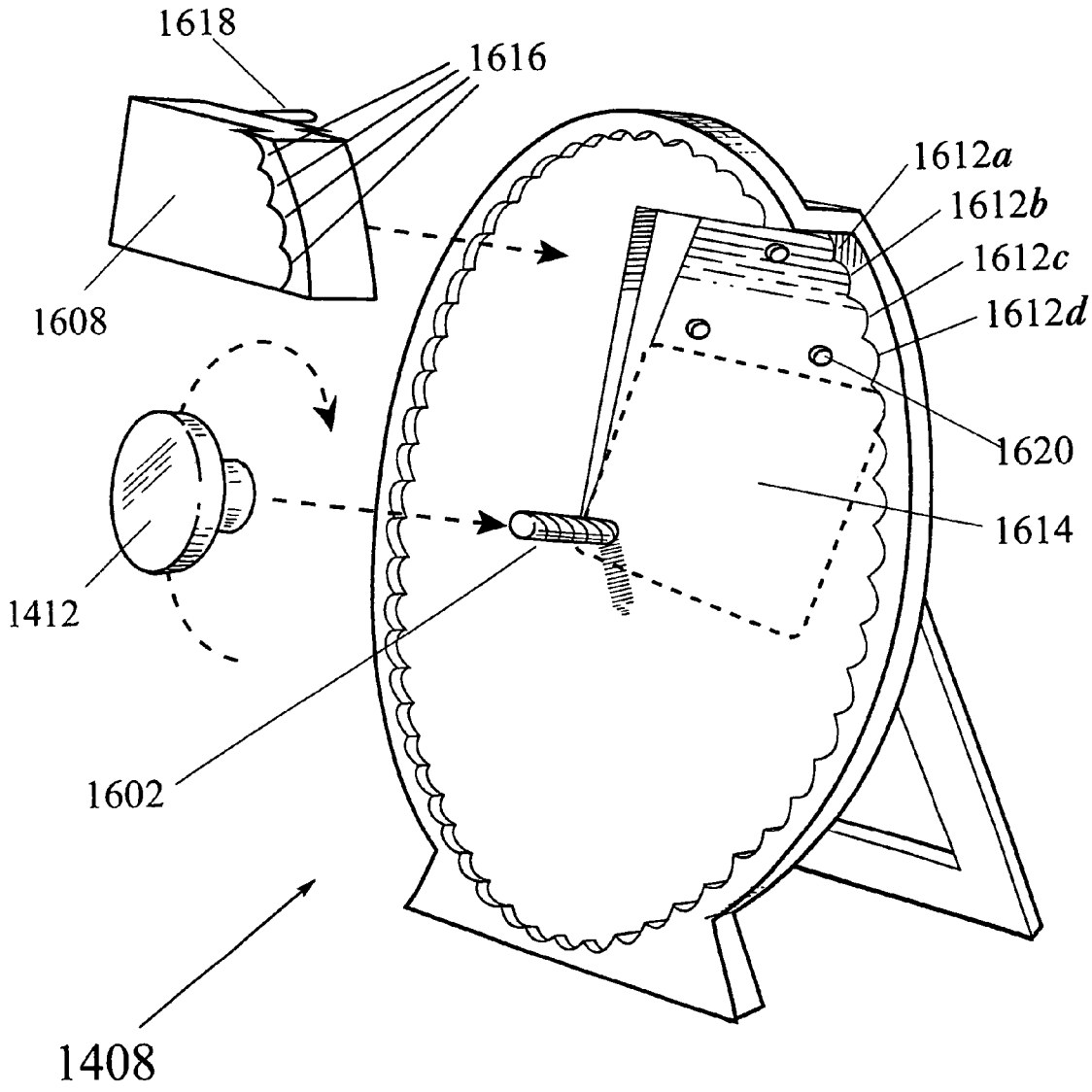
FIG. 16A depicts an angled, front view of the stand illustrated in FIG. 14 with the cards removed in accordance with one embodiment of the present invention including, inter alia, an exploded view of a knob, stand and adaptor.

Referring next to FIG. 16A, depicted is an angled front view of stand 1408 without cards with an exploded view of adaptor 1608 and knob 1412. Adaptor 1608 increases the versatility of the card game such as card game 1400 by providing support for single aperture topmost, intermediate, and base cards 1402, 1404, and 1406, respectively, that are passed over post 1602 in a horizontal orientation (i.e., when the side of the card to be displayed in the final coherent image is facing toward the viewer and the card is oriented such that the aperture is located in the lower left corner of the card, the width of the card is greater than the height of the card) rather than a vertical orientation (i.e., when the side of the card to be displayed in the final coherent image is facing toward the viewer and the card is oriented such that the aperture is located in the lower left corner of the card, the height of the card is greater than the width of the card). In other words, attachment of adaptor 1608 to stand 1408 allows the cards to be passed over post 1602 such that the backs of each card are displayed rather than the faces. Such embodiments allow portions of a second coherent image to be included on the backs of all cards such that a player, at his or her option, may either assemble a first coherent image by combining the images on the faces of all cards or assemble a second coherent image by combining the images on the backs of all cards.

Figure 16B:
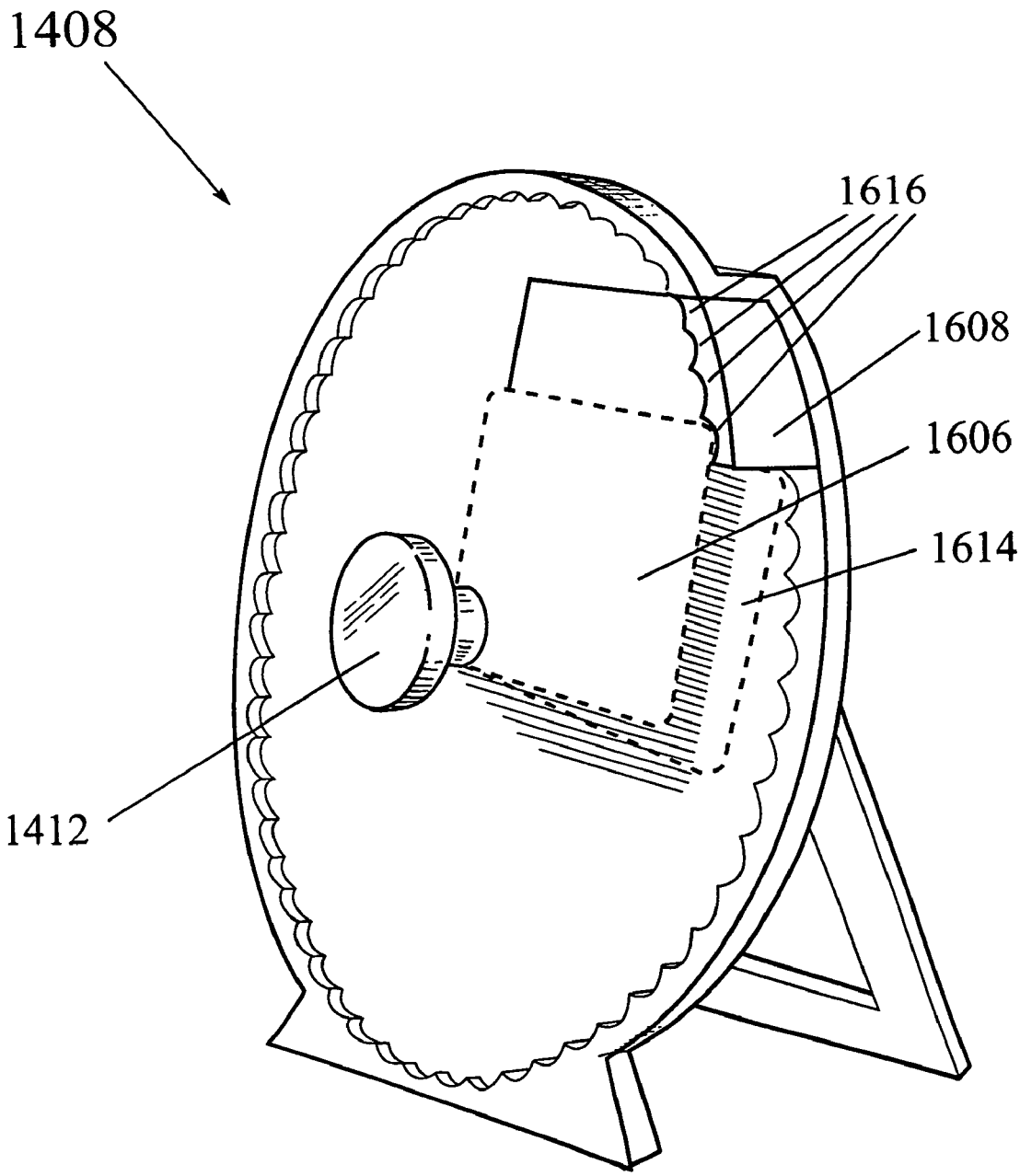
FIG. 16B depicts an angled, front view of the stand illustrated in FIG. 14 with the cards removed in accordance with one embodiment of the present invention including, inter alia, an assembled adaptor and knob, as well as indications of the locations of the base and topmost cards.

In the embodiment of the present invention depicted in FIGS. 16A and 16B, adaptor 1608 attaches to stand 1408 by inserting three adaptor pegs 1618 into three adaptor peg apertures 1620. However, alternate methods of attachment may be substituted without departing from the scope of the present invention. When all cards are assembled, knob 1412 may be attached to post 1602 as discussed above to further render the cards immovable. The quantity of adaptor recesses 1616 on adaptor 1608 may vary depending on factors such as the quantity of cards in the card game, the size and proportion of each card, etc. All such variations are within the scope of the present invention.

Although inclusion of adaptor 1608 is not required, it is preferred when installing the cards in a horizontal orientation to ensure that all cards have the necessary support. To illustrate this point, when assembling the cards in a vertical orientation, a player typically places a single aperture base card such as base card 1406 (FIG. 14) such that the aperture is located in the lower left corner of the card and the upper right corner of such base card nests into first recess 1612*a*. However, when a base card is placed in a horizontal orientation such as horizontally-oriented base card 1614, the orientation causes the base card to bypass first, second, third, and fourth recesses 1612*a*-1612*d*. Consequently, if adaptor 1608 is not attached to stand 1408, several of the cards that are placed atop stand 1408 at the end of the assembly, including the topmost card, will not have an appropriate recess 1612 into which a corner may be nested. This shortcoming may be remedied by attaching adaptor 1608 to stand 1408 whenever the cards are to be installed in a horizontal, rather than vertical, orientation to provide support and adaptor recesses 1616 for the final cards of the assembly.

FIG. 16B depicts an angled front view of stand 1408 with adaptor 1608 inserted into adaptor peg apertures 1620 (FIG. 16A). In the embodiment of the present invention depicted in FIG. 16B, the top edge of base card 1614 when it is in a horizontal orientation aligns with the bottom forward facing surface of adaptor 1608. Also depicted is the position of topmost card 1606 having one corner supported in adaptor recess 1616.

Figure 17:
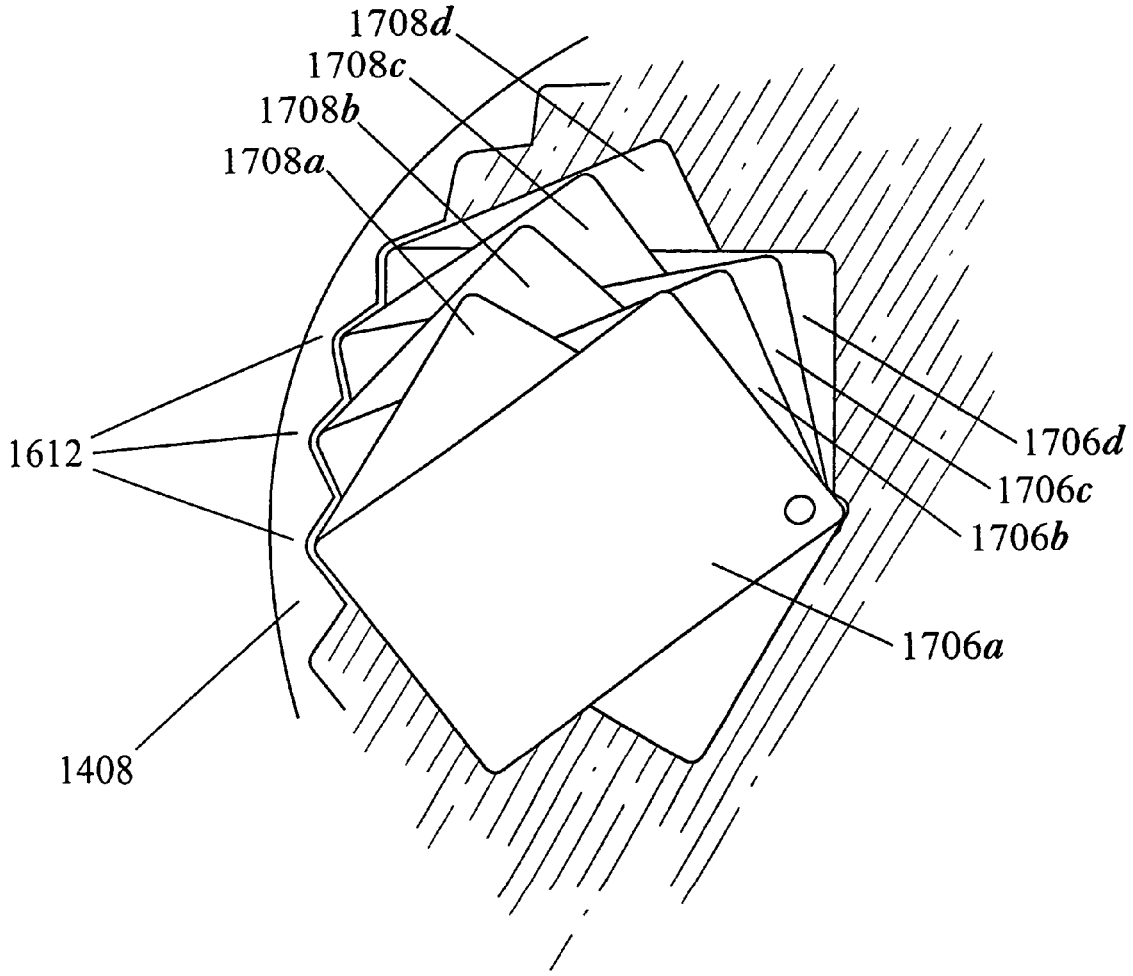
FIG. 17 depicts a magnified view of cards located in both horizontal and vertical orientations.

Turning now to FIG. 17, recesses 1612 having inwardly facing surfaces oriented at an angle greater than the 90 degree angle depicted for recesses 1410 (FIG. 15) are depicted. The greater angle is required on any plate, stand, or the like designed to allow the cards to be installed in either a horizontal or a vertical orientation. Horizontally-oriented intermediate cards 1706*a*-1706*d* and vertically-oriented intermediate cards 1708*a*-1708*d* are depicted to further illustrate the ability of the enlarged angle of the inwardly facing surfaces of recesses 1612 to accommodate both horizontally-oriented and vertically-oriented cards.

Figure 18:
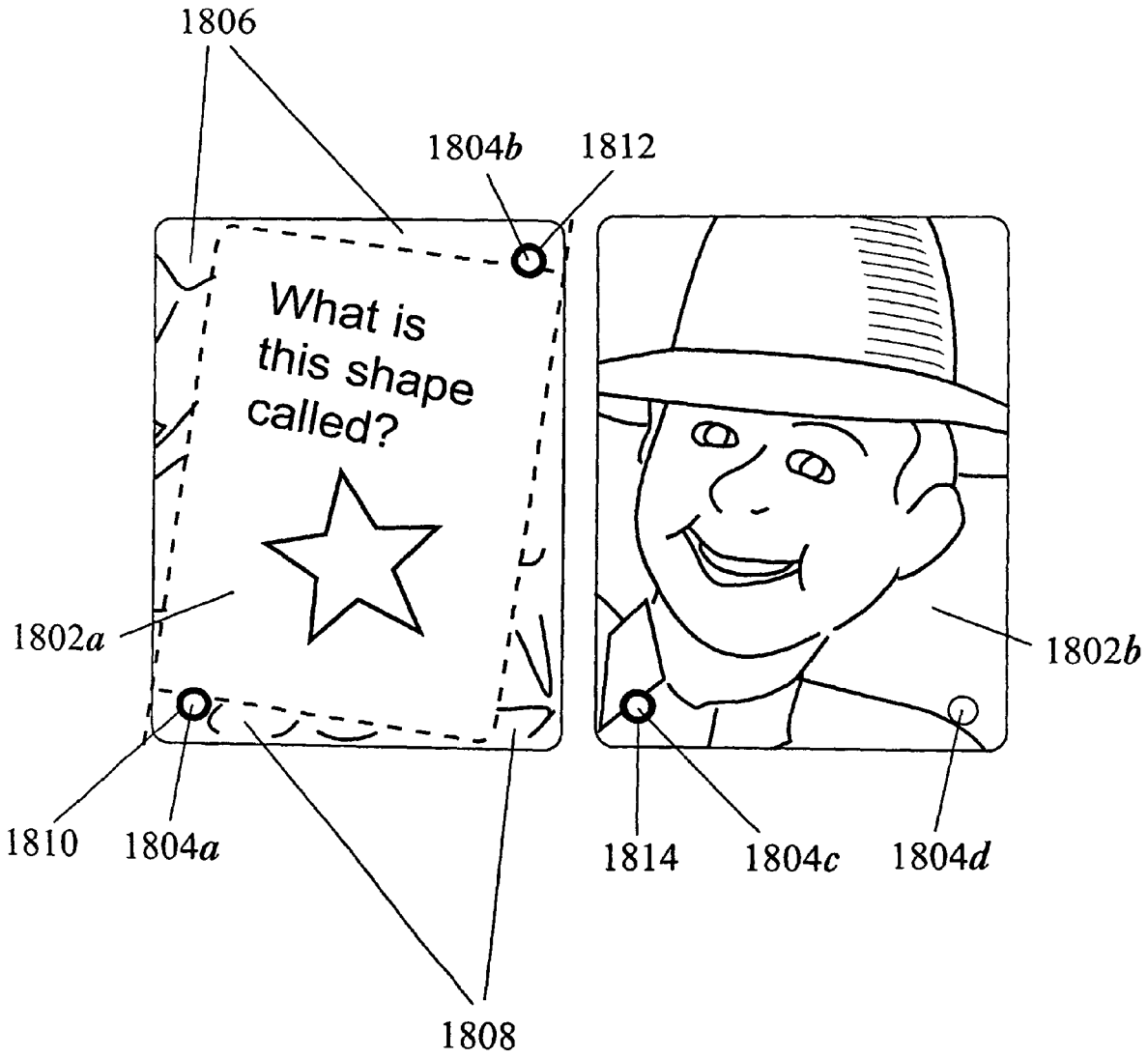
FIG. 18 depicts partially-figured and full-figured embodiments of the present invention having double apertures in each card and dashed lines indicating the obscured portion of the partially-figured card.

Turning now to FIG. 18, depicted are partially-figured and full-figured embodiments of the present invention including double apertures 1804 in each card and dashed lines indicating the obscured portion of the partially-figured card. Increasing the quantity of apertures 1804 increases the quantity of coherent images that may be created using a single deck of cards. Two examples are illustrated in further detail below with respect to cards 1802*a*-1802*b*, however, many more variations may be incorporated without departing from the scope of the present invention.

Card 1802*a* is a partially-figured card having two apertures 1804*a* and 1804*b* in diagonally opposed corners of card 1802*a*. A deck including a plurality of cards such as cards 1802*a* may be assembled in a vertical orientation using either of apertures 1804*a* and 1804*b* as an anchor point. However, use of apertures 1804*a* as anchoring points will result in the assembly of an image comprised of upper segments 1806, whereas use of apertures 1804*b* as anchoring points will result in the assembly of an image comprised of lower segments 1808. Consequently, assembly of a deck of cards such as cards 1802*a* in a vertical orientation may be performed to create either of two resulting coherent images. In addition, if the back of each card 1802*a* is also partially-configured (e.g., similar to the face of card 1802*a*), assembly of the backs of a deck of cards such as cards 1802*a* in a horizontal orientation using either apertures 1804*a* or 1804*b* as anchoring points may be performed to create either of two additional distinct resulting coherent images. In this manner, a single deck of cards such as cards 1802*a* may be assembled to create any one of four independent coherent images. Additionally, the hidden central sections of the faces and backs of each card 1802*a* may include information that is not a part of any resulting coherent image to enhance the utility of the card game as discussed above. For example, this area of each of the cards may depict one of the faces of a card in a standard deck of playing cards to allow cards 1802*a* to be used as such when they are not assembled.

Furthermore, card 1802*a* may optionally include codes, markings, or the like, such as color codes 1810 and 1812 to aid in assembly of the final coherent image. For example, as depicted in FIG. 18, color code 1810 may be a first color (e.g., red). Whenever the user intends to assemble a final coherent image that includes upper segments 1806, only apertures 1804*a* having color code 1810 shall be used as an anchoring point. Similarly, whenever the user intends to assemble a final coherent image that includes lower segments 1808, only apertures 1804*b* having color code 1812 (e.g., a blue color code) shall be used as an anchoring point.

Although card 1802*a* is depicted as partially-figured, such an aperture configuration may also be incorporated in a card having a full-figured face and a partially-figured back, or a partially-figured face and a full-figured back. When using a full-figured card set, a quantity of different rotated versions of the resulting coherent image can be assembled that is equal to the quantity of cards in the deck,-since any full-figured card may be selected as the base card as discussed above.

Card 1802*b* is a full-figured card including two apertures 1804*c* and 1804*d* in both corners of a first end of card 1802*b*. If both the face and the back of cards 1802*b* are similarly configured, a deck of cards 1802*b* may be assembled to create a quantity of rotated coherent images equal to two times the quantity of cards 1802*b* in the deck. That is, each of the cards 1802*b* may be selected as the base card resulting in a quantity of coherent images equal to the quantity of cards as discussed above. As discussed above with respect to card 1802*a*, any combination of partially-figured and full-figured card sides may be substituted without departing from the scope of the present invention.

In embodiments of the present invention such as that depicted in FIG. 18, cards 1802*b* may include a code, marking, or the like to indicate which apertures may be used in conjunction with a specific side (i.e., face or back) of a card. For example, color code 1814 located around the perimeter of aperture 1804*c* may indicate that aperture 1804*c* is an acceptable anchoring point for the side of card 1802*b* depicted in FIG. 18. Likewise, the absence of a color code around the perimeter of aperture 1804*d* indicates that it is not an acceptable anchoring point for the full-figured side of card 1802*b* depicted in FIG. 18.

Although FIG. 18 depicts cards having two apertures, any quantity of apertures may be substituted without departing from the scope of the present invention. Also, embodiments of the present invention are envisioned in which some cards are horizontally-oriented and others are vertically-oriented to achieve a particular coherent image. Such embodiments may provide opportunities to increase the difficulty and therefore the entertainment value of the present invention. Furthermore, although cards are depicted, virtually any other type of segment (e.g., puzzle pieces, blocks, photos, etc.) may be substituted without departing from the scope hereof.

Figure 19:
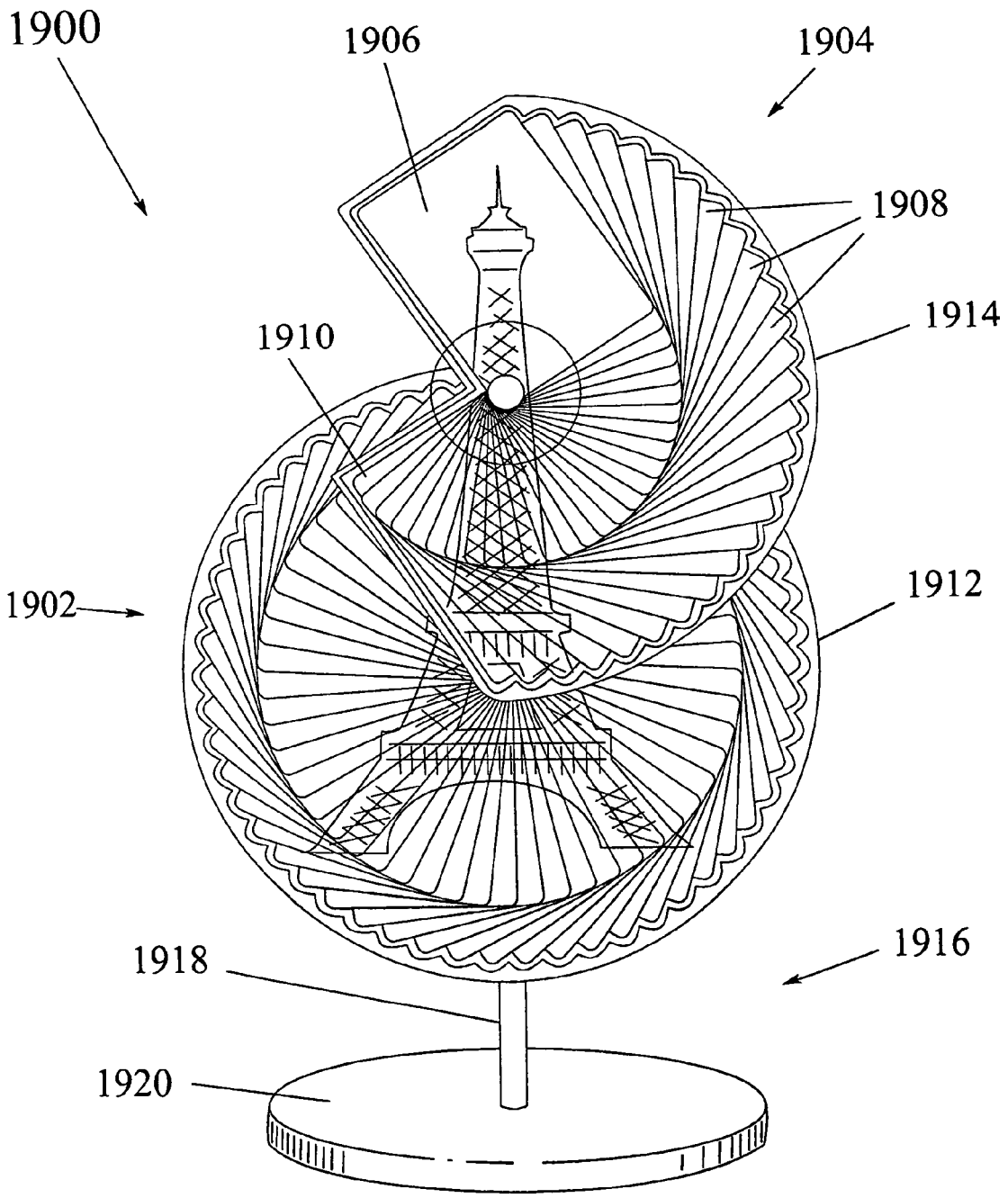
FIG. 19 depicts a front view of an assembled card game having primary and secondary card games in accordance with another embodiment of the present invention including, inter alia, primary and secondary card games, base, and shaft.

FIG. 19 depicts a front view of card game 1900 in accordance with another alternate embodiment of the present invention. Card game 1900 is similar in function to card game 1400 except that it includes both a primary card game 1902, as well as a secondary card game 1904. Both primary card game 1902 and secondary card game 1904 have two anchoring points for all primary topmost, intermediate, and base cards 2002, 2004, and 2006, respectively (FIG. 20B), and all secondary topmost, intermediate, and base cards 1906, 1908, and 1910, respectively. The two anchoring points for each of such cards are similar to those described above with respect to FIGS. 14 and 15.

Figure 20A:
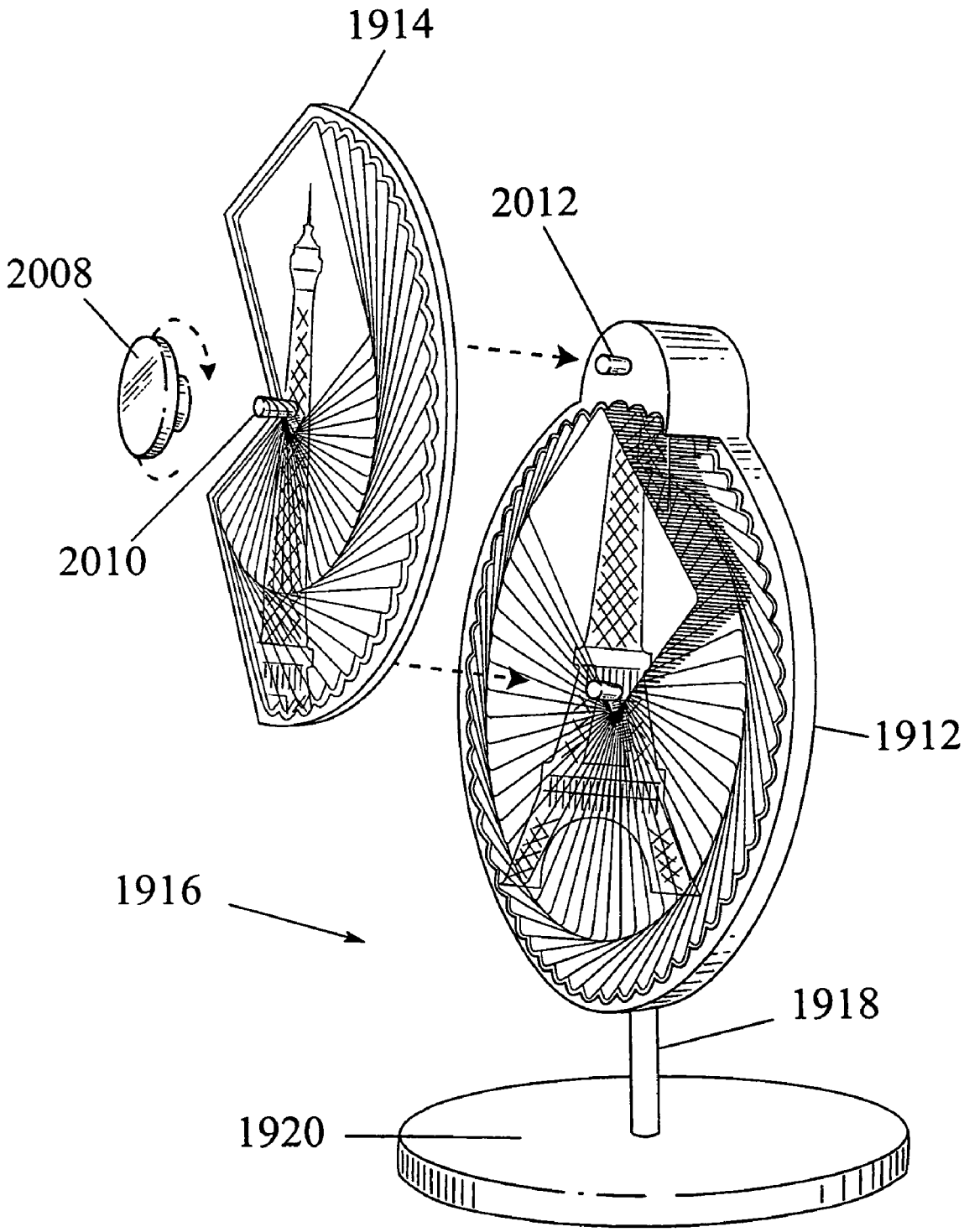
FIG. 20A depicts an angled front view of an assembled primary card game in accordance with the embodiment of the present invention illustrated in FIG. 19 including, inter alia, an exploded view of an assembled secondary card game and knob.
Figure 20B:
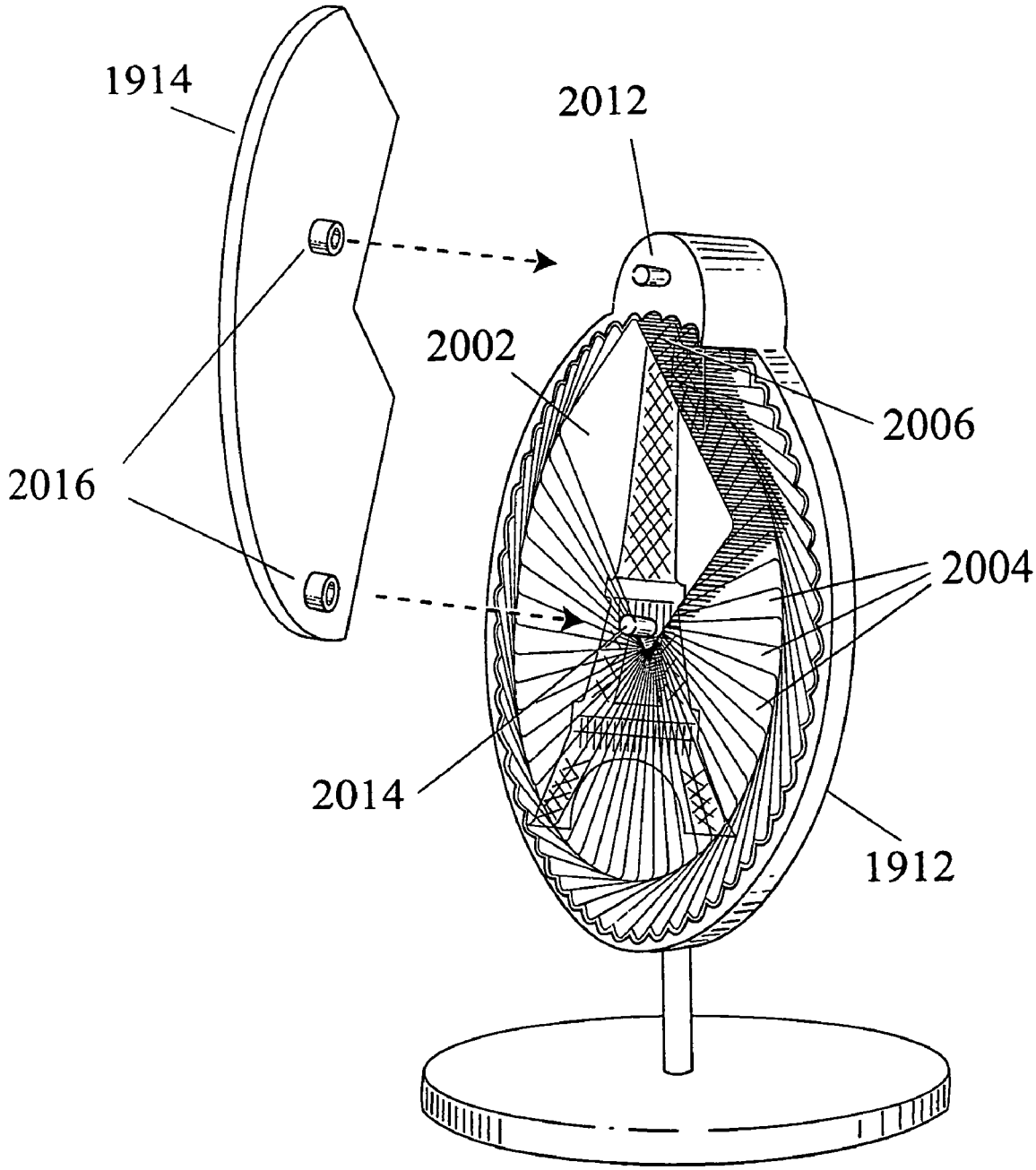
FIG. 20B depicts an angled front view of an assembled primary card game in accordance with the embodiment of the present invention illustrated in FIG. 19 including, inter alia, an exploded view of the back of the plate of a secondary card game.

To assemble card game 1900, first primary card game 1902 is assembled atop primary plate 1912 in the same manner described above with respect to FIGS. 14 and 15, except that there is no knob similar to knob 1412. The purpose of knob 1412 is achieved by attaching secondary plate 1914 to primary plate 1912. Next, an empty secondary plate 1914 is attached to primary plate 1912 as depicted in FIGS. 20A and 20B. As illustrated in FIGS. 20A and 20B, to perform such attachment, secondary plate apertures 2016, located on the rear side of secondary plate 1914, are passed over primary posts 2012 and 2014. Thereafter, secondary plate 1914 is maintained in this position relative to primary plate 1912 due to friction, gravity, and/or the inclined nature of primary plate 1912 when affixed atop stand 1916. Similar to stand 200 as discussed above with respect to FIG. 2, stand 1916 includes shaft 1918 and base 1920.

After attachment of secondary plate 1914 to primary plate 1912; all secondary topmost, intermediate, and base cards 1906, 1908, and 1910, respectively, may be assembled atop secondary plate 1914 in the same manner described above with respect to FIGS. 14 and 15, except that the cards are progressively stacked in a counterclockwise direction with respect to the center of secondary plate 1914. After completion of assembly of the secondary cards, knob 2008 may be tightly threaded onto secondary post 2010 to maintain secondary topmost, intermediate, and base cards 1906, 1908, and 1910, respectively, in an immovable state, thereby maintaining the single coherent image created by assembly of primary topmost, intermediate, and base cards 2002, 2004, and 2006, respectively, and secondary topmost, intermediate, and base cards 1906, 1908, and 1910, respectively.

Although, secondary plate 1914 is depicted as a half circle with four straight edges completing the non-circular half of secondary plate 1914, virtually any shape may be incorporated for primary plate 1912 and secondary plate 1914 without departing from the scope of the present invention. For example, either or both of primary plate 1912 and secondary plate 1914 could be shaped as a full circle, a semicircle, a polygon, etc. without departing from the scope of the present invention.

The stacking of two or more plates, wherein each plate contains a distinct array of cards in its assembled state, provides numerous advantages to the card game of the present invention. First, the addition of second, third, fourth, etc. sets of cards increases the complexity of the card game. The increase in the quantity of cards requires a player of the card game to potentially test and evaluate many additional cards before finding the next piece of the puzzle. Second, the increased complexity of the card game may add to increased enjoyment during assembly of the card game. Third, the added complexity of the resulting arrays of cards may provide enhanced visual satisfaction.

For example, in the embodiment of the present invention depicted in FIG. 19, beyond the addition of secondary plate 1914, card game 1900 is also designed such that primary topmost, intermediate, and base cards, 2002, 2004, and 2006, respectively, assembled on primary plate 1912 are assembled in a clockwise manner, whereas secondary topmost, intermediate, and base cards, 1906, 1908, and 1910, respectively, assembled on secondary plate 1914, are assembled in a counterclockwise manner. These two competing directions provide another aspect of the present invention that adds to the visual enjoyment and complexity of the resulting array of cards. Furthermore, in a satisfying visual surprise, this reversal of direction also modifies the configuration of the primary and secondary topmost, intermediate, and base cards such that the central circular area of the array of cards atop primary plate 1912 is larger than the central circular area of the array of cards atop secondary plate 1914. In alternate embodiments, the directions of the arrays of each set of cards may be reversed without departing from the spirit of the present invention.

Referring next to FIGS. 21A-21D, an alternate embodiment of the present invention is depicted in which rotatable plate 2102 allows cards such as base, intermediate, and topmost cards 2104, 2106, and 2108, respectively, to be assembled thereupon such that either side of each card faces away from rotatable plate 2102 without the need for an adaptor such as adaptor 1608 (FIG. 16A). The configuration of rotatable plate 2102 ensures that one corner of base card 2104 may be positioned to rest within location 2114*c* of primary recess 2112 regardless of which side of base card 2104 faces away from rotatable plate 2102 (i.e., regardless of whether base card 2104 is inserted into primary recess 2112 in a face up or face down orientation). Furthermore, after assembly of all base and intermediate cards 2104 and 2106, respectively, (e.g., fifty three cards if a standard deck of cards is used) the configuration of rotatable plate 2102 allows topmost card 2108 to be displayed with either side facing away from rotatable plate 2102 regardless of the position of base card 2104 (i.e., regardless of which side faces away from rotatable plate 2102), while ensuring that one corner of topmost card 2108 may be positioned to rest within location 2114*d* of primary recess 2112.

In lieu of an adaptor such as adaptor 1608 (FIG. 16A), rotatable plate 2102 includes primary recess 2112, which is configured to allow base card 2104 to be mounted with either side facing away from rotatable plate 2102. However, regardless of the position of base card 2104, a corner of such card may be positioned to rest within location 2114*c* of primary recess 2112. Incorporation of a recess such as primary recess 2112 in a plate such as rotatable plate 2102 also allows all fifty-four cards of a standard deck of cards to be mounted atop the plate regardless of the position of the cards (i.e., regardless of which side of the card faces away from the plate).

Additionally, rotatable plate 2102 may be rotated to allow topmost card 2108 to be positioned at any angle. This allows the resulting image created by assembly of all cards (i.e., base, intermediate, and topmost cards 2104, 2106, and 2108, respectively) to be positioned, or rotated, to an angle that is most desirable to a viewer. Such positioning or rotating may be performed without regard for the position (i.e., face up or face down) in which the base, intermediate, and topmost cards 2104, 2106, and 2108, respectively, have been mounted atop the plate. In one aspect of the present invention such as that depicted in FIG. 21C, such rotation is clockwise relative to the starting position of rotatable plate 2102 as depicted in FIG. 21A. In this specific example, the degree of clockwise rotation equals the circumferential distance of approximately four cards. However, alternate embodiments of the present invention are envisioned in which greater or lesser degrees of rotation are implemented. Furthermore, alternate embodiments of the present invention are envisioned in which such rotation is counterclockwise rather than clockwise without departing from the scope of the present invention.

More specifically, FIG. 21A depicts rotatable plate 2102 rotationally positioned to accept base, intermediate, and topmost cards 2104, 2106, and 2108, respectively, wherein all of the cards are assembled such that the same first side of each card faces away from rotatable plate 2102. To accommodate this, rotatable plate 2102 includes, inter alia, primary recess 2112. Primary recess 2112 is a recess in the surface of rotatable plate 2102 that allows the base card of a set of cards to be recessed such that the thickness of the resulting cards assembled atop the base card is stable atop rotatable plate 2102 and is aesthetically pleasing. However, primary recess 2112 is also specifically configured to accommodate mounting of the base, intermediate, and topmost cards in either of two orientations (i.e., a first side facing away from rotatable plate 2102 or a second side facing away from rotatable plate 2102).

Figure 21B:
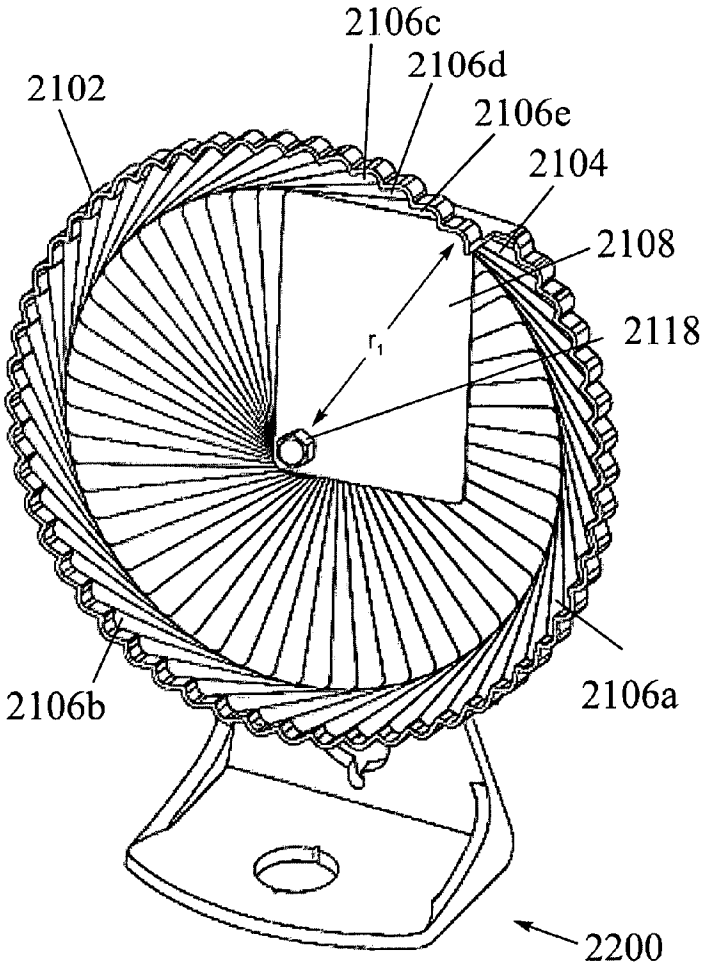
FIG. 21B depicts an angled, front view of the rotatable plate of FIG. 21A with cards assembled thereon in a face up orientation.
Figure 21A:
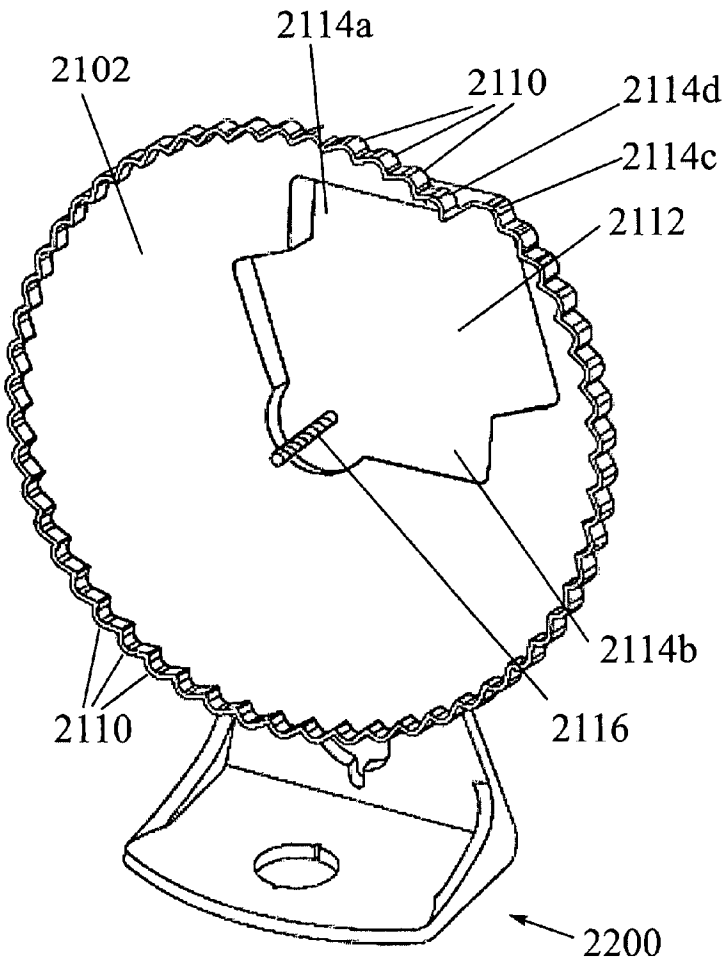
FIG. 21A depicts an angled, front view of a rotatable plate positioned to receive cards in a face up orientation in accordance with one embodiment of the present invention.

To mount base, intermediate, and topmost cards 2104, 2106, and 2108, respectively, with a first side facing away from rotatable plate 2102 such as depicted in FIG. 21B, base card 2104 is assembled within primary recess 2112 with the desired image facing upward such that its top, leftmost corner sits within primary recess 2112 at location 2114*a* and its bottom, rightmost corner sits within primary recess 2112 at location 2114*b*. Thereafter, intermediate cards 2106 are assembled atop base card 2104 and each other in a clockwise manner by passing the aperture of each card over a post such as post 2116 as discussed in greater detail above. Secondary recesses 2110 support each of the cards as they are placed atop rotatable plate 2102 as also discussed in greater detail above. When all intermediate cards 2106 have been assembled, topmost card 2108 is assembled and a knob such as knob 2118 is affixed to post 2116 to retain base, intermediate, and topmost cards 2104, 2106, and 2108, respectively, securely in place. In one possible assembly of the cards, the resulting card assembly is similar to that depicted in FIG. 21B.

Figure 21D:
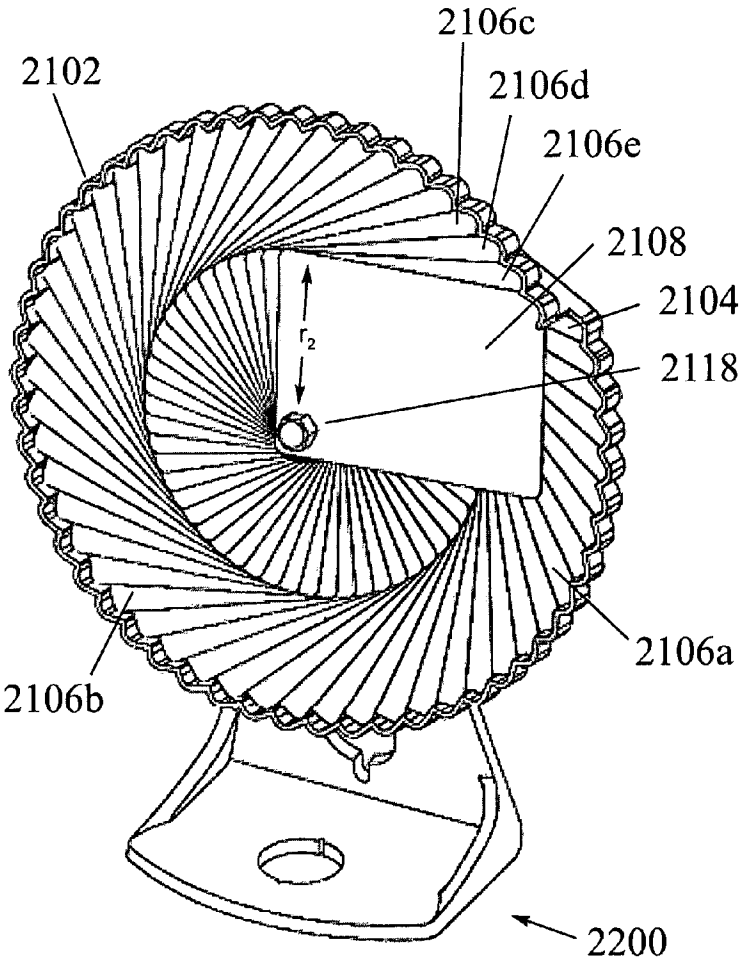
FIG. 21D depicts an angled, front view of the rotatable plate of FIG. 21C with cards assembled thereon in a face down orientation.
Figure 21C:
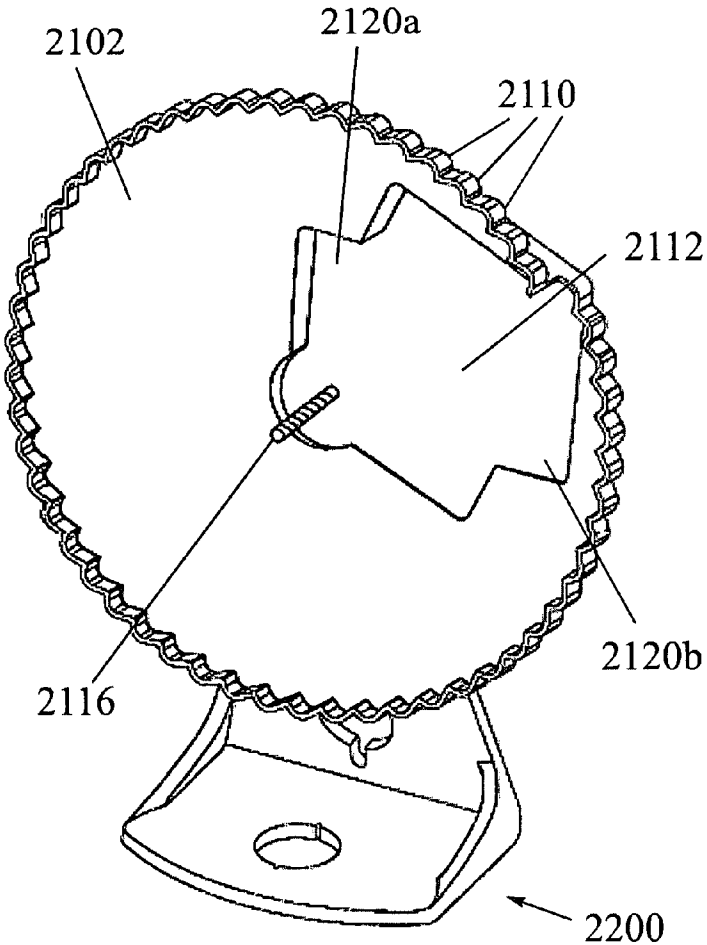
FIG. 21C depicts an angled, front view of the rotatable plate of FIG. 21A positioned to receive cards in a face down orientation in accordance with one embodiment of the present invention.

Referring now to FIG. 21C, rotatable plate 2102 is rotationally positioned to accept base, intermediate, and topmost cards 2104, 2106, and 2108, respectively, wherein all of the cards are assembled such that the same first side of each card faces toward rotatable plate 2102. The position depicted in FIG. 21C is rotated clockwise with respect to the position depicted in FIG. 21A. In one aspect of the present invention such as that depicted in FIG. 21C, the degree of clockwise rotation is equivalent to the circumferential distance of approximately four cards relative to the position of rotatable plate 2102 as depicted in FIG. 21A. However, alternate embodiments of the present invention are envisioned in which greater or lesser degrees of rotation are implemented.

To mount base, intermediate, and topmost cards 2104, 2106, and 2108, respectively, such that the same first side of each card faces toward rotatable plate 2102 as depicted in FIG. 21D, base card 2104 is assembled within primary recess 2112 with the desired image facing upward such that its top, leftmost corner sits within primary recess 2112 at location 2120*a* and its bottom, rightmost corner sits within primary recess 2112 at location 2120*b*. Thereafter, intermediate cards 2106 are assembled atop base card 2104 and each other in a clockwise manner by passing the aperture of each card over a post such as post 2116 as discussed in greater detail above. Secondary recesses 2110 support each of the cards as they are placed atop rotatable plate 2102 as also discussed in greater detail above. When all intermediate cards 2106 have been assembled, topmost card 2108 is assembled and a knob such as knob 2118 is affixed to post 2116 to retain base, intermediate, and topmost cards 2104, 2106, and 2108, respectively, securely in place. The resulting card assembly is similar to that depicted in FIG. 21D.

FIGS. 21B and 21D also depict the varying diameters of the resulting circular configuration created when cards are assembled atop rotatable plate 2102 in an orientation in which a first side of all cards faces away from rotatable plate 2102 ("face up" orientation) versus an orientation in which a first side of all cards faces toward rotatable plate 2102 ("face down" orientation). As depicted, the radius $r_1$ of a circular configuration created by cards assembled in a face up orientation, as depicted in FIG. 21B, is greater than the radius $r_2$ of a circular configuration created by cards assembled in a face down orientation as depicted in FIG. 21D. Such diameters may also be varied using other methods including without limitation varying the size of the cards and their corresponding rotatable plate without departing from the scope hereof.

Attachment of rotatable plate 2102 to a stand such as stand 2200, as discussed in greater detail below with respect to FIGS. 22-25, allows rotatable plate 2102 to rotate three hundred and sixty degrees, thereby allowing the cards attached thereto to be displayed at any rotational position. However, although rotatable plate 2102 is shown in FIGS. 21A-21D attached to stand 2200, rotatable plate 2102 may be configured for attachment to an alternate stand or for standalone use without departing from the scope of the present invention. In addition, although FIGS. 21A-21D depict embodiments of the present invention in which all cards are assembled with the same side facing toward or away from rotatable plate 2102, other embodiments are envisioned in which one or more cards face a first direction and one or more cards face a second direction without departing from the scope of the present invention. Furthermore, rotatable plate 2102 may be positioned at any orientation and is not limited to those orientations depicted in FIGS. 21A-21D. In addition, although FIGS. 21A-21D depict a rotatable plate 2102 upon which cards are assembled in a clockwise direction, alternate rotatable plates are envisioned in which the cards are assembled in a counterclockwise direction without departing from the scope of the present invention.

Referring now to FIGS. 22A-22D, depicted are perspective, front, bottom, and side views, respectively, of stand 2200 in accordance with one embodiment of the present invention. In one aspect of the present invention, stand 2200 includes, inter alia, four stand apertures 2202*a* through 2202*d*. The angular configuration of stand 2200 and the location of stand apertures 2202 allow stand 2200 to display a plate such as, but not limited to, rotatable plate 2102 (FIGS. 21A-21D) in at least nine different configurations as discussed in greater detail below with respect to FIGS. 24A-24I. Although stand 200 is depicted with a specific angular configuration and four stand apertures 2202, alternate embodiments of the present invention are envisioned in which the stand has varying angular configurations and/or a varying quantity of stand apertures.

Figure 22B:
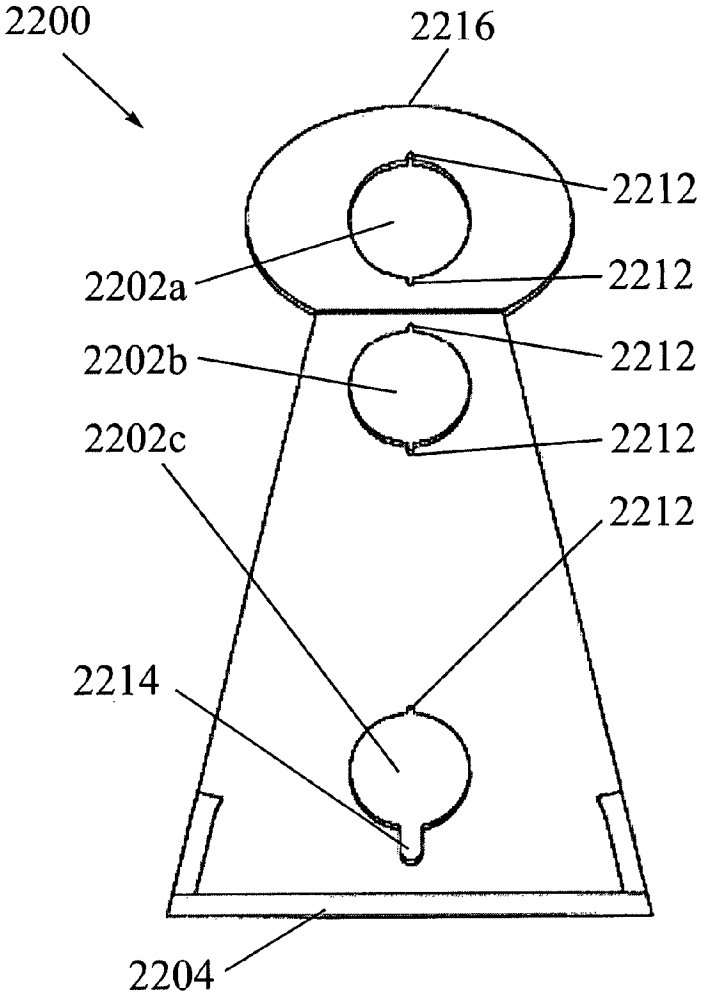
FIG. 22B depicts a front view of the stand of FIG. 22A.
Figure 22A:
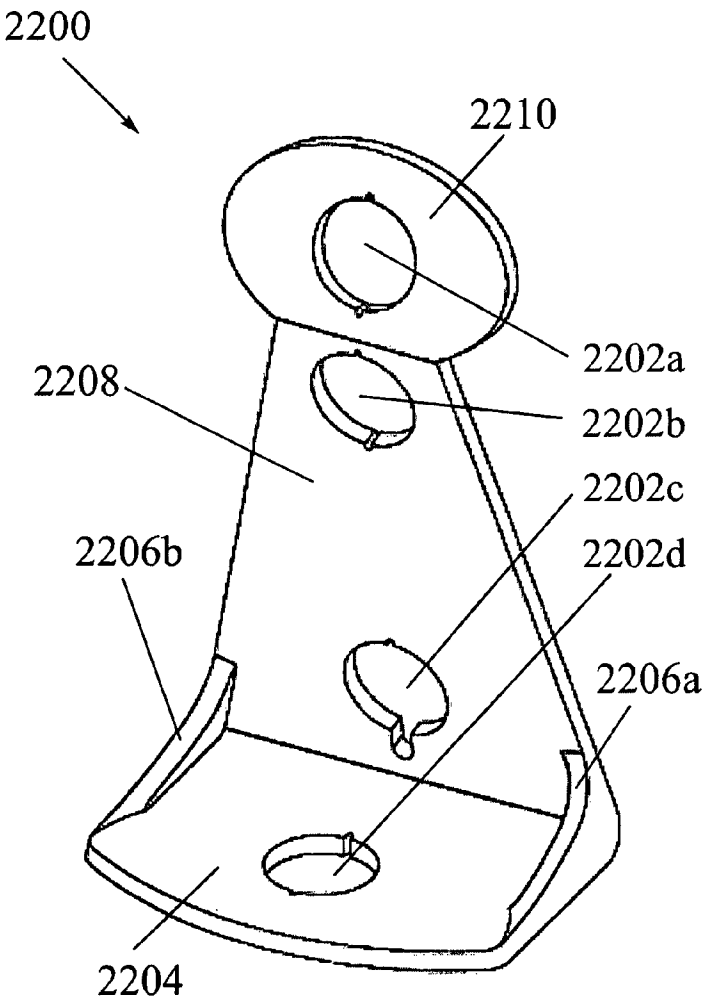
FIG. 22A depicts a perspective view of a stand in accordance with one embodiment of the present invention.

As depicted in FIG. 22A, stand 2200 includes stand apertures 2202, first stand section 2204, first stand section flanges 2206, second stand section 2208, and third stand section 2210. The functions of stand apertures 2202 and first, second, and third stand sections 2204, 2208, and 2210, respectively, vary upon the orientation in which stand 2200 is used. Therefore, such functions are discussed in greater detail below with respect to FIGS. 24A-24I. First stand section flanges 2206 are provided to provide structural stability to stand 2200, however, the configuration of such flanges may be varied, or such flanges may be omitted without departing from the scope of the present invention.

Figure 22C:
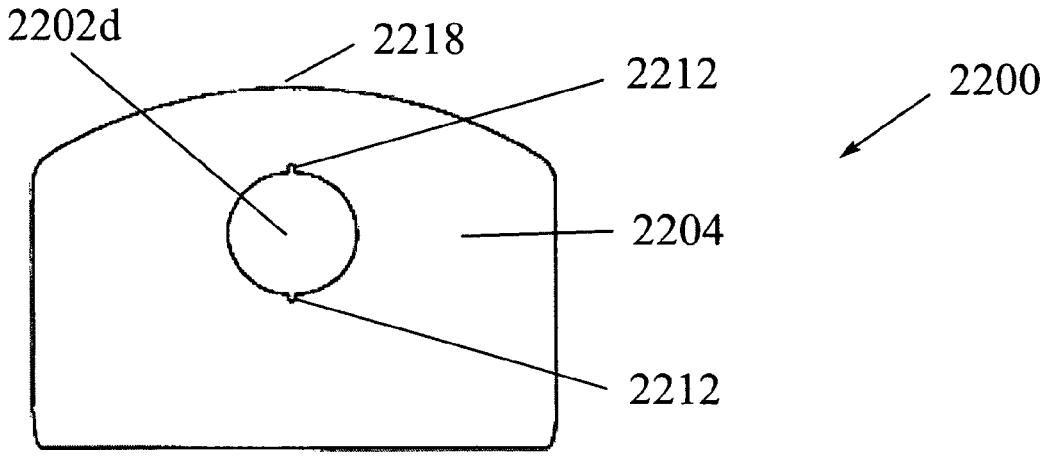
FIG. 22C depicts a bottom view of the stand of FIG. 22A.

Referring now to FIG. 22B, depicted is a front view of stand 2200. As depicted in this figure, the configuration of stand aperture 2202*c* varies with respect to stand apertures 2202*a*, 2202*b*, and 2202*d* (FIG. 22C). That is, whereas each of stand apertures 2202*a*, 2202*b*, and 2202*d* include two relatively minor slits 2212, which accommodate mounting of caps such as caps 2312 (FIG. 23) thereto, stand aperture 2202c includes a minor slit 2212 and a major slit 2214. Major slit 2214 has a greater length and width as compared to minor slit 2212 such that it is large enough to encircle the stem of a bolt, nail, screw, or the like. Such dimensions allow stand 2200 to be mounted to a wall as discussed in greater detail below with respect to FIG. 24C. Additionally, first stand section 2204 and third stand section 2210 include rounded edges 2216 and 2218, respectively, which facilitate rocking of a plate mounted to stand 2200 as discussed in greater detail below with respect to FIGS. 24E-24G.

FIG. 22C depicts a bottom view of first stand section 2204. As depicted, first stand section 2204 includes rounded edge 2218 and stand aperture 2202d, the latter of which includes two minor slits 2212. Rounded edge 2218 facilitates rocking of a plate mounted to stand 2200 as discussed in greater detail below with respect to FIGS. 24E-24G.

Figure 22D:
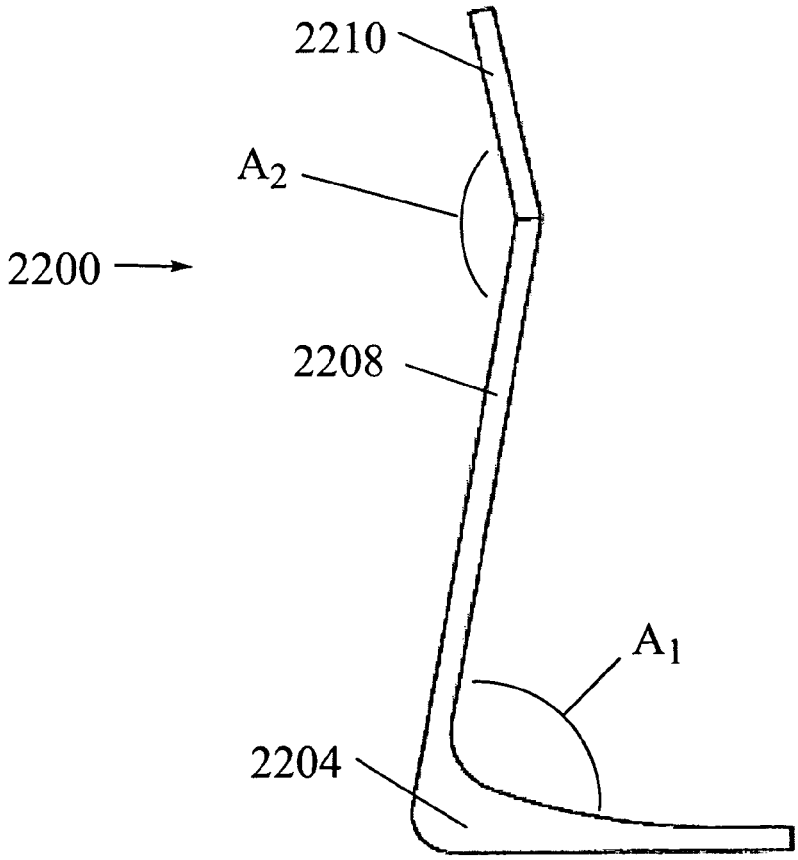
FIG. 22D depicts a side view of the stand of FIG. 22A.

FIG. 22D is a side view of stand 2200 depicting the angular orientation of first, second, and third stand sections 2204, 2208, and 2210, respectively, relative to each other. As depicted, second stand section 2208 is located at an angle $A_1$ of approximately eighty degrees relative to first stand section 2204, and third stand section 2210 is located at an angle $A_2$of approximately one hundred fifty eight degrees relative to second stand section 2208. However, such angles may be varied without departing from the scope of the present invention. In one aspect of the present invention such as that depicted in FIGS. 22A-22D, curved edges 2216 (FIG. 22B) and 2218 (FIG. 22C), as well as angle $A_2$, allow stand 2200 to wobble or rock when placed in a configuration such as those depicted in FIGS. 24E-24G.

Figure 23:
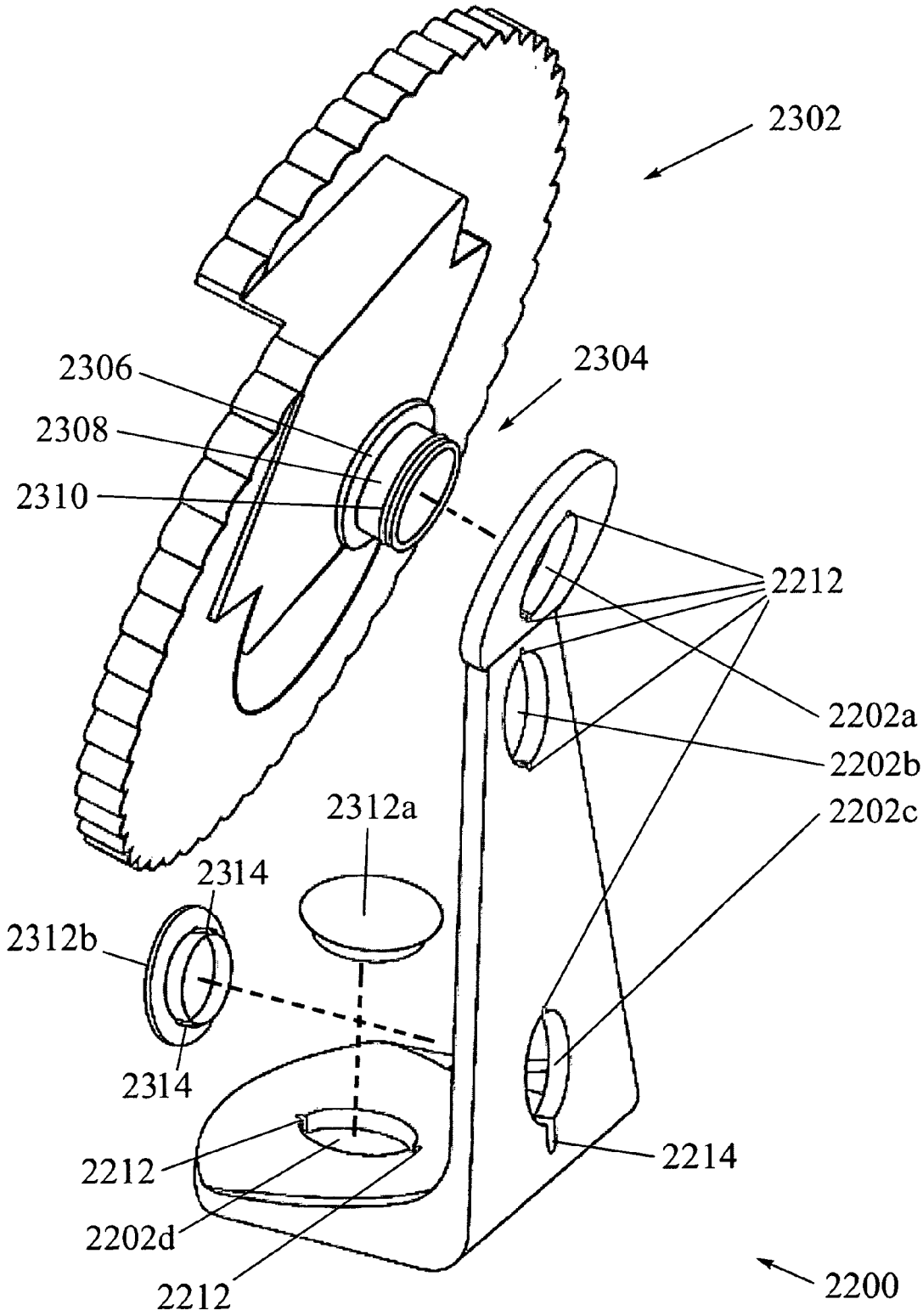
FIG. 23 depicts an exploded view of the attachment of a plate and caps to the stand of FIGS. 22A-22D in accordance with one embodiment of the present invention.

Turning next to FIG. 23, depicted is an exploded view of the attachment of plate 2302 to stand 2200. In one aspect of the present invention, plate 2302 includes, inter alia, plug 2304, which is designed to mate with any one of stand apertures such as stand apertures 2202*a*-2202*d*. In one aspect of the present invention, plug 2304 includes first plug end 2306, intermediate plug section 2308, and second plug end 2310. In some embodiments of the present invention, second plug end 2310 is ridged and is formed from a compressible material such as an elastomer. The compressible nature of second plug end 2310 allows plate 2302 to be mounted to stand 2200 by passing second plug end 2310 through a stand aperture 2202 until second plug end 2310 clears such stand aperture and such stand aperture encircles intermediate plug section 2308. As second plug end 2310 is passing through stand aperture 2202, it compresses as the diameter of stand aperture 2202 is sized to be less than the diameter of second plug end 2310. After passing completely therethrough, second plug end 2310 expands, thereby minimizing the potential for plug 2304, and therefore plate 2302, to dislodge from stand aperture 2202. Furthermore, the larger diameter of first plug end 2306 and second plug end 2310 relative to stand aperture 2202, as well as the matched sizing of intermediate plug section 2308 and stand aperture 2202 (i.e., the length of intermediate plug section 2308 and the depth of stand aperture 2202 are approximately equal), retain plate 2302 in a stationary position by minimizing the potential that intermediate plug section 2308 will slide within the respective stand aperture. This configuration allows a user to rotate plate 2302 relative to stand 2200 by applying force thereto. However, upon rotation of plate 2302 to the desired position, the friction created between plug 2306 and stand aperture 2202 holds plate 2302 in the desired position.

After plate 2302 has been mounted to stand 2200, one or more stand apertures 2202 may be visible to a viewer. For aesthetic purposes, the present invention may be provided with caps 2312, which snap into the unused, visible stand apertures 2202. In one aspect of the present invention, caps 2312 are designed to remain in apertures 2202 via friction. However, other methods may be substituted without departing from the scope hereof.

In one embodiment of the present invention, caps 2312 are equipped with ridges 2314, which are designed to mate with minor slits 2212 such that caps 2312 are retained at a specific orientation within the respective stand apertures 2202. In some embodiments, caps 2312 may be imprinted with any one of a number of designs or logos without departing from the scope of the present invention. The retention of caps 2312 at a specific orientation allows such caps to be imprinted and/or designed with images that will create a specific visual effect when mounted within stand apertures 2202 as such caps may be displayed to the viewer at a fixed, predetermined, desirable angle. However, caps 2312 and/or such imprinting are not necessary to achieve the goals of the present invention. Although circular caps 2312 are depicted, such caps may be created in any form without departing from the scope hereof.

Figure 24B:
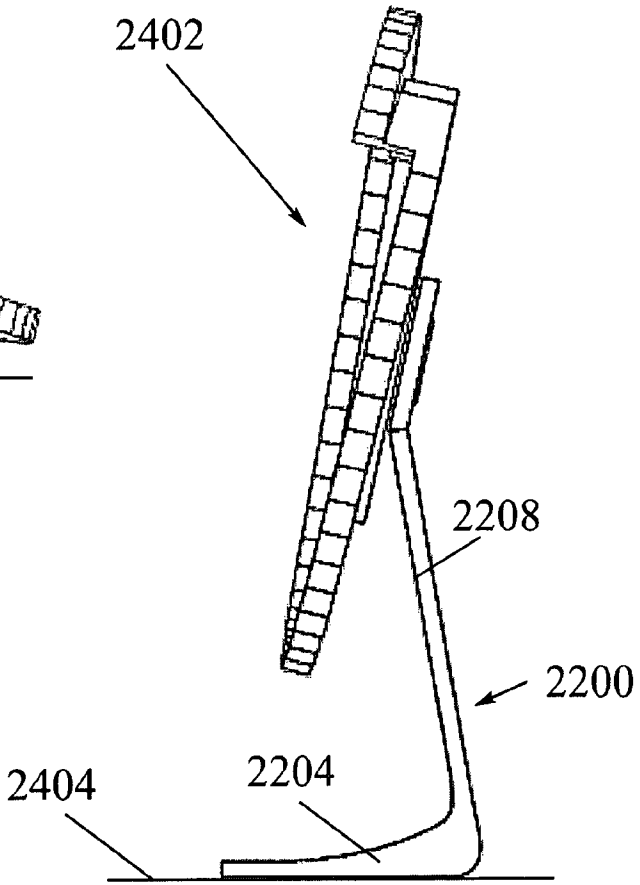
FIGS. 24A through 24D depict four configurations for displaying a plate mounted upon the stand of FIGS. 22A-22D in accordance with one embodiment of the present invention.
Figure 24A:
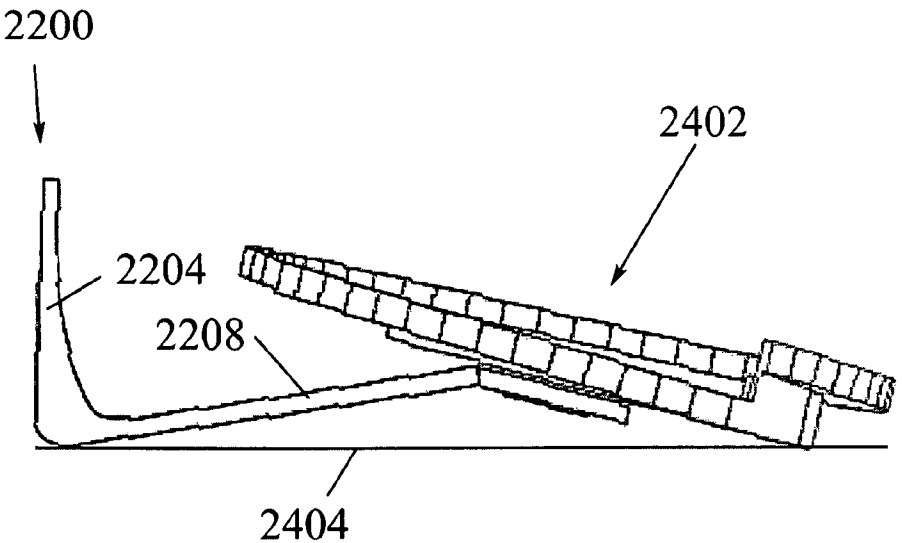

Referring now to FIGS. 24A-241, depicted are nine positions in which stand 2200 (FIGS. 22A-22D) may be attached to and displayed with plate 2402 such that the display of stand 2200, plate 2404, and the base, intermediate, and topmost cards mounted thereupon are varied. Or, the position of stand 2200 and/or plate 2404 may be varied to facilitate card assembly (prior to display of the resulting image).

Referring specifically now to FIG. 24A, in one aspect of the present invention, plate 2402 is similar to plate 2102 (FIGS. 21A-21D), however, varying plates may be substituted without departing from the scope of the present invention. Horizontal surface 2404 may be any approximately horizontal surface (e.g., a countertop, a table, etc.) upon which stand 2200 may be placed. In this particular configuration, stand 2200 is oriented such that first stand section 2204 is in an upright position and the intersection of first and second stand sections 2204 and 2208, respectively, rests upon the approximately horizontal surface. The distal end of stand 2200 is supported by the attached plate 2402, which is attached to stand aperture 2202*a*, and a circumferential portion of which rests upon the approximately horizontal surface. Such position of plate 2402 is generally preferred during assembly of the cards atop plate 2402 as it places plate 2402 in an approximately level and easily accessible, non-rocking position.

Turning next to FIG. 24B, stand 2200 is oriented such that the outwardly facing surface of first stand section 2204 is downwardly facing. The angular orientation of stand 2200 provides a stable stand upon which plate 2402 may be mounted. In this configuration, plate 2402 is mounted to stand aperture 2202*a*. This particular configuration may be preferred for display of the assembled cards to a viewer as the image is directly in the line of sight of any viewer looking straight ahead or slightly downward. Furthermore, whenever a rotatable plate is attached to stand 2200, the rotational orientation of the assembled cards may be adjusted by a user to alter the aesthetics or to achieve the correct orientation of the image created by the card assembly.

Figure 24D:
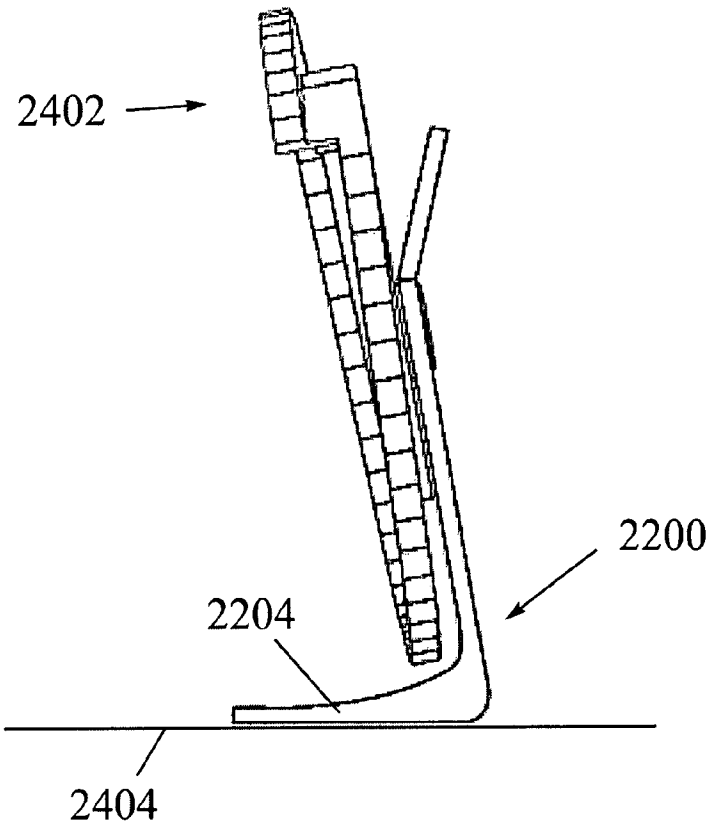
Figure 24C:
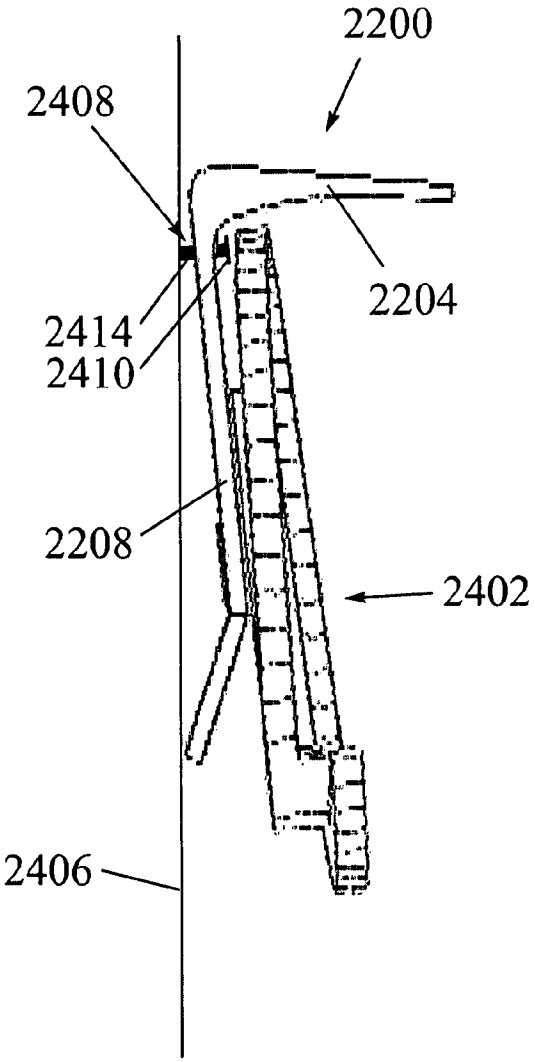

Referring now to FIG. 24C, stand 2200 is oriented such that the outwardly facing surface of first stand section 2204 is upwardly facing and the outwardly facing surface of second stand section 2208 is located adjacent to vertical surface 2406 (e.g., a wall). In this particular configuration, plate 2402 is mounted to stand aperture 2202*b*. This orientation involves the use of major slit 2214 (FIG. 22B). To mount stand 2200 to vertical surface 2406, a fastener 2408 (e.g., a screw, nail, etc.) is first attached to vertical surface 2406. Thereafter, head 2410 of fastener 2408 is passed through stand aperture 2202*c* (FIG. 22A). Once head 2410 has completely passed therethrough, stand may be lowered such that stem 2414 of fastener 2408 enters major slit 2214 until the upper end of such slit rests atop the stem. Preferably, fastener 2408 is selected such that the width of head 2410 is greater than the width of major slit 2214 to minimize the possibility that stand 2200 will fall from its attachment to vertical surface 2406.

Turning now to FIG. 24D, stand 2200 is oriented in the same position as depicted in FIG. 24B, however, plate 2402 is mounted to stand aperture 2202*b* rather than stand aperture 2202*a*. Such mounting orients plate 2402 in a slightly downwardly facing direction such as may be desired if stand 2200 is rested atop a high shelf.

Figure 24E:
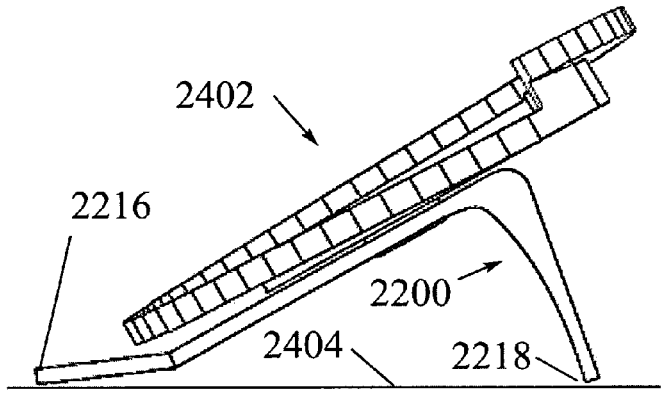
FIGS. 24E through 24G depict three configurations for displaying a plate mounted upon the stand of FIGS. 22A-22D in a rocking manner in accordance with one embodiment of the present invention.
Figure 24F:
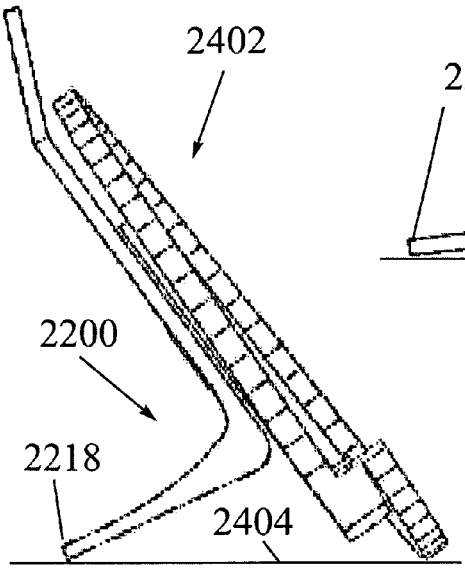
Figure 24G:
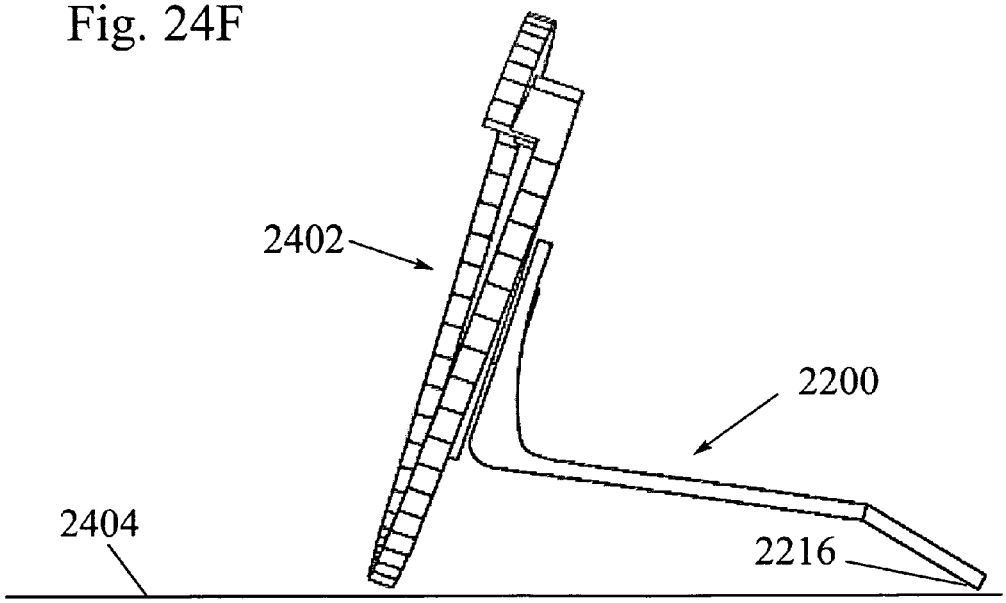

Referring next to FIGS. 24E-24G, all three positions for stand 2200 are rocking configurations. That is, the portions of stand 2200 or plate 2402 that rest upon approximately horizontal surface 2404 are curved (e.g., curved edges 2216 (FIG. 22B) and 2218 (FIG. 22C) and/or the circumferential edge of plate 2402). Such curved edges, as well as angle $A_2$ (FIG. 22D), allow stand 2200 to wobble or rock when rested atop an approximately horizontal surface. Rocking may be initiated by slightly tapping stand 2200. Such rocking adds an entertaining element to the display of the assembled cards.

FIG. 24E depicts stand 2200 oriented such that curved edges 2216 and 2218 rest atop horizontal surface 2404 and plate 2402 is mounted to stand aperture 2202*c*. This configuration places the card assembly in a slightly angled viewing position.

In contrast, FIG. 24F depicts stand 2200 oriented such that curved edge 2218 and a circumferential edge of plate 2402 rest atop horizontal surface 2404 and plate 2402 is mounted to stand aperture 2202*c*. This configuration places the card assembly at an approximately forty five degree angle relative to horizontal surface 2404.

In yet another rocking embodiment, FIG. 24G depicts stand 2200 oriented such that curved edge 2216 and a circumferential edge of plate 2402 rest atop horizontal surface 2404 and plate 2402 is mounted to stand aperture 2202*d*. This configuration places the card assembly in an almost vertical viewing position. Although FIGS. 24E-24G depict three rocking configurations, alternate rocking configurations are envisioned within the scope of the present invention.

Figure 24H:
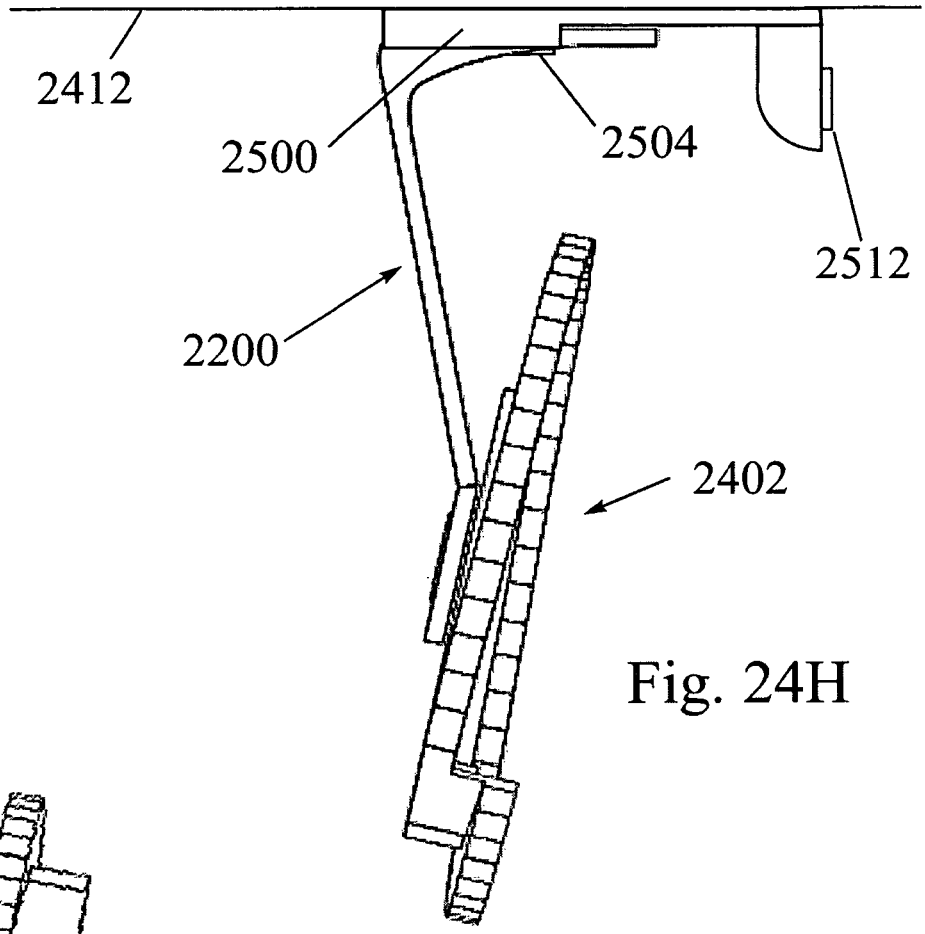

Referring now to FIGS. 24H and 241, depicted are configurations for stand 2200 in which an adaptor 2500 is utilized. As depicted, adaptor 2500 is configured for attachment to an approximately horizontal downwardly facing surface 2412 (e.g., a downwardly facing side of a cabinet, a downwardly facing surface of a shelf, etc.).

Figure 25:
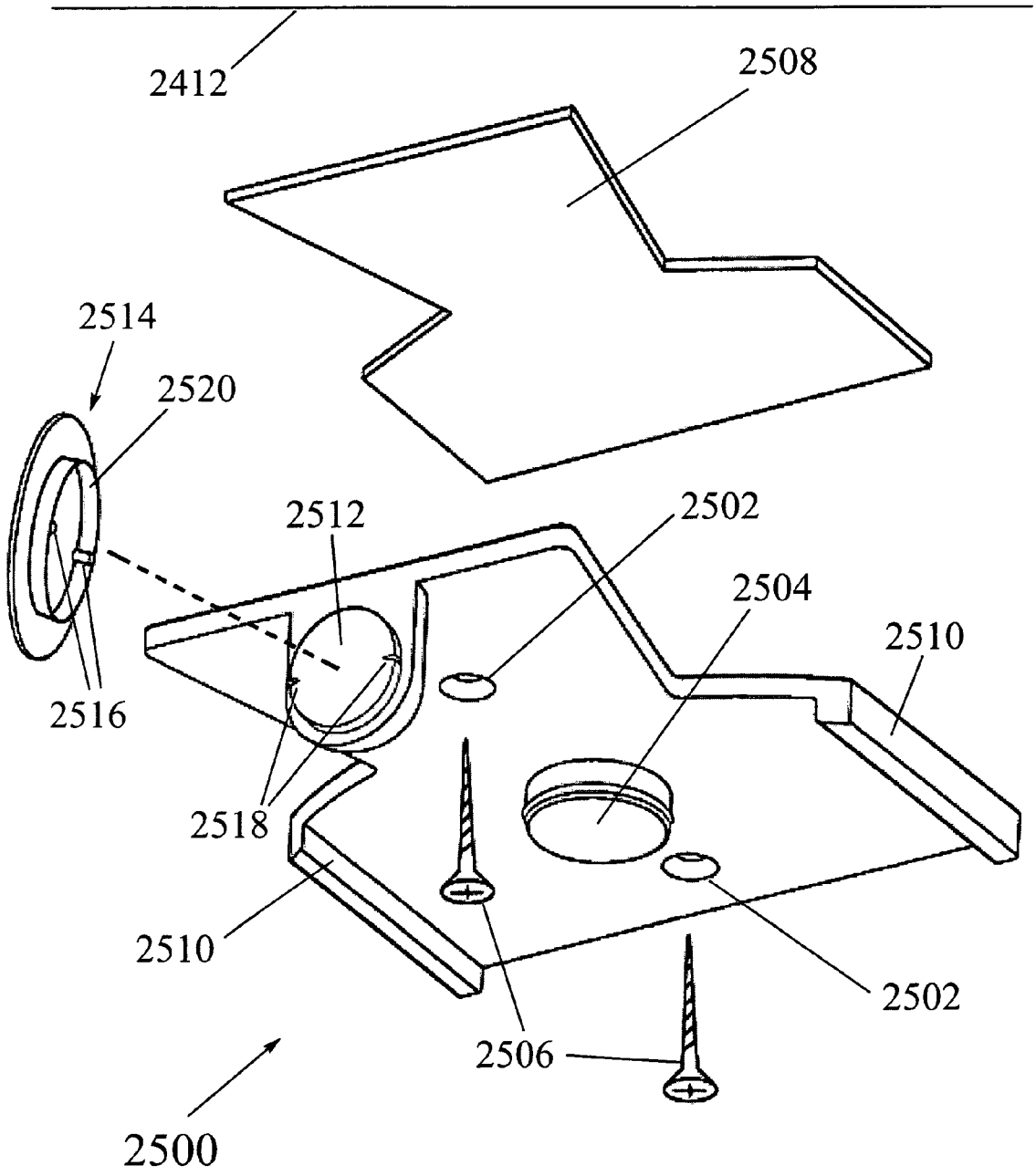
FIG. 25 depicts a stand adaptor in accordance with one embodiment of the present invention.

FIG. 25 depicts an angled, bottom view of adaptor 2500 including adaptor mounting apertures 2502, adaptor plug 2504, adaptor flanges 2510, and adaptor cap plug 2512. Adaptor 2500 may be mounted to an approximately horizontal downwardly facing surface 2412 using any one of a variety of methods including, without limitation, two-sided self-adhesive tape 2508 and/or fastening fasteners such as screws 2506 through adaptor mounting apertures 2502 into approximately horizontal downwardly facing surface 2412, wherein such fasteners are selected such that the head thereof has a greater diameter than the diameter of adaptor mounting apertures 2502. However, other methods of mounting adaptor 2500 to an approximately horizontal downwardly facing surface 2412 may be substituted without departing from the scope of the present invention.

Once adaptor 2500 has been mounted to an approximately horizontal downwardly facing surface 2412, stand 2200 may be mounted thereto. Such mounting is performed by passing one of the plurality of stand apertures 2202 over plug 2504. Plug 2504 is similar to plug 2304 as discussed in greater detail above with respect to FIG. 23. Plug 2504 retains stand 2200 in a stationary position relative to adaptor 2500 in the same manner that plug 2304 (FIG. 23) retains plate 2302 in a stationary manner with respect to stand 2200. In addition, adaptor flanges 2510 may protrude from a downwardly facing surface of adaptor 2500 to minimize the rotation of stand 2500 relative to adaptor 2500. However, alternate embodiments of the present invention are envisioned in which adaptors such as adaptor 2500 do not include flanges. Such embodiments allow stand 2200 to rotate with respect to plug 2504 in a manner similar to that in which plate 2303 (FIG. 23) rotates relative to stand 2200 as discussed in greater detail above.

Furthermore, similar to caps 2312 (FIGS. 23), cap 2514 may be snapped onto adapter cap plug 2512 for aesthetic purposes. In one aspect of the present invention such as that depicted in FIG. 25, collar 2520 of cap 2514 is pushed onto adaptor cap plug 2512 and is held in place by friction. In some embodiments of the present invention, collar 2520 includes ridges 2516. In such embodiments, mating minor slits 2518 are included in adaptor cap plug 2512. Such ridges and minor slits retain cap 2514 in a fixed position such that any design (e.g., logo, graphic, etc.) imprinted on the face of cap 2514 is displayed at a predetermined angle. Furthermore, the similarity of cap 2312 (FIG. 23) and cap 2514 (FIG. 25) allow a single cap to be produced for either use (i.e., use as cap 2312 or cap 2514). Such caps will typically include both sets of ridges (i.e., ridges 2314 (FIG. 23) and ridges 2516 (FIG. 25). However, alternate cap configurations and methods of mounting same to adaptor 2500 may be substituted without departing from the scope of the present invention.

FIG. 24H depicts a first orientation for stand 2200 and plate 2402. As depicted, stand 2200 is attached to adaptor 2500 by passing stand aperture 2202*d* over adaptor plug 2504. Plate 2402 is attached to stand 2200 by passing plug 2304 through stand aperture 2202*a*. This orientation is useful for mounting below a high horizontal surface as it orients the assembled card display at a downward angle. Additionally, such configuration is useful for mounting under a cabinet or the like having an operable door as it does not impede the operation thereof.

Figure 24I:
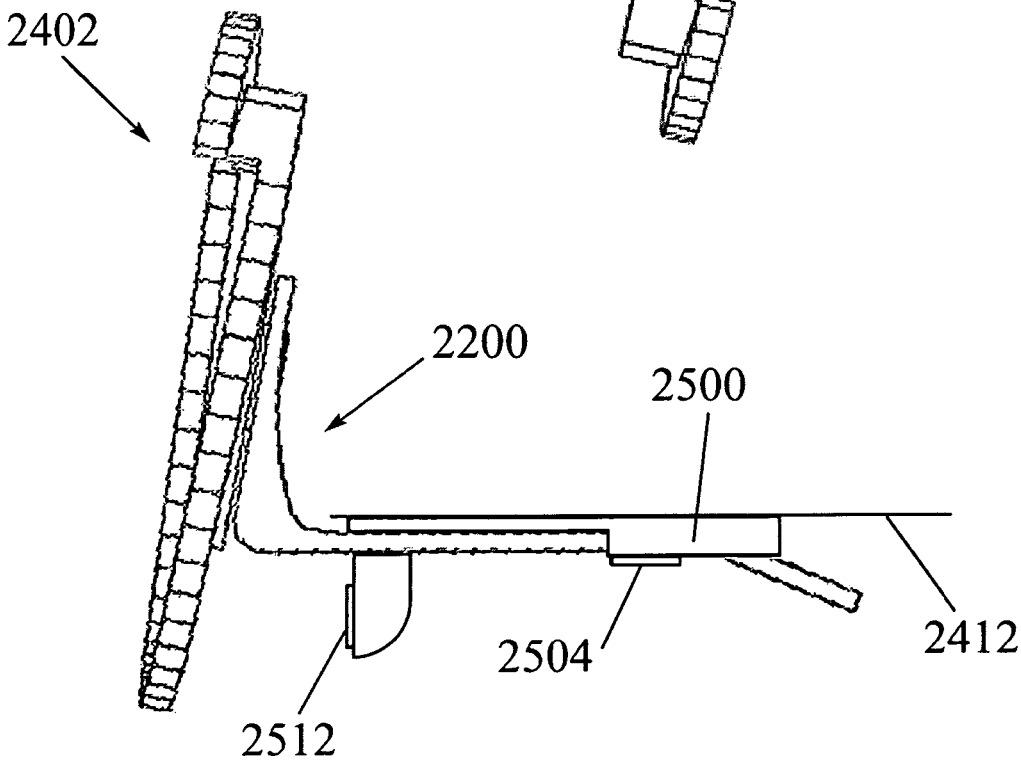

In contrast, FIG. 241 depicts a second orientation for stand 2200 and plate 2402. As depicted, stand 2200 is attached to adaptor 2500 by passing stand apertures 2202*b* and 2202*c* over adaptor plug 2504 and adaptor cap plug 2512, respectively, wherein stand aperture 2202*c* passes over adaptor cap plug 2512 at a ninety degree angle. Plate 2402 is attached to stand 2200 by passing plug 2304 through stand aperture 2202*d*. This orientation is useful for mounting below a horizontal surface located at eye level as it orients the assembled card display in an approximately upright position. Although FIGS. 24H-24I depict two configurations that may be achieved via use of an adaptor such as adaptor 2500, alternate configurations are envisioned within the scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A game apparatus comprising:

at least one support, said at least one support including at least one face, said at least one face including at least two recesses arranged radially about said face in at least one of the group consisting of a clockwise direction of said face and a counterclockwise direction of said face, each of said at least two recesses being progressively more shallow than a preceding one of said at least two recesses along at least one of the group consisting of said clockwise direction of said face and said counterclockwise direction of said face, said at least two recesses including one primary recess for providing at least one of said at least two segments with an orientation guide;

at least one post protruding from said at least one face of said at least one support, said at least one post attached to said at least one support at a proximal end of said at least one post; and at least two segments, each of said at least two segments including at least two sides, each of said at least two segments including at least one segment aperture configured to mate with said at least one post, each of said at least two segments including at least one subsection of at least one resultant image;

wherein overlapping each of said at least two segments in at least one predetermined orientation combines at least two of said subsections to form said at least one resultant image.

2. An apparatus according to claim 1, wherein said support is rotatable.

3. An apparatus according to claim 1, wherein said primary recess includes at least two recessed areas; and wherein a first of said recessed areas accepts one of said segments in a face down orientation and a second of said recessed areas accepts one of said segments in a face up orientation.

4. An apparatus according to claim 1, wherein a radius of said at least one resultant image varies based upon said predetermined orientation of said at least two segments.

5. An apparatus according to claim 1, wherein a rotational position of said support is adjusted based upon said predetermined orientation.

* * * * *